US009367017B2

(12) United States Patent
Fujita

(10) Patent No.: US 9,367,017 B2
(45) Date of Patent: Jun. 14, 2016

(54) POST-PROCESSING DEVICE AND IMAGE FORMING SYSTEM

(71) Applicant: KONICA MINOLTA, INC., Chiyoda-ku, Tokyo (JP)

(72) Inventor: Yuji Fujita, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/930,405

(22) Filed: Nov. 2, 2015

(65) Prior Publication Data

US 2016/0124371 A1 May 5, 2016

(30) Foreign Application Priority Data

Nov. 5, 2014 (JP) ..... 2014-225024

(51) Int. Cl.
*G03G 15/00* (2006.01)
*G03G 21/00* (2006.01)
*G03G 21/14* (2006.01)

(52) U.S. Cl.
CPC ..... *G03G 15/70* (2013.01)

(58) Field of Classification Search
CPC ..... G03G 15/00; G03G 15/70; G03G 21/00; G03G 21/14
USPC ..... 399/407, 408
See application file for complete search history.

(56) References Cited

U.S. PATENT DOCUMENTS 5,032,876 A * 7/1991 Murakami ..... B42C 1/12 399/410
5,106,067 A * 4/1992 Higaki ..... B42C 1/125 270/58.02
7,738,809 B2 * 6/2010 Tao ..... G03G 15/50 399/18
8,246,032 B2 * 8/2012 Nakajima ..... B65H 29/60 270/58.01
8,260,158 B2 * 9/2012 Goto ..... G03G 15/6573 399/20
2004/0262832 A1 * 12/2004 Kaneko ..... B42C 1/12 270/58.08
2007/0210511 A1 * 9/2007 Ferrara ..... B65H 29/58 271/275
2009/0116059 A1 * 5/2009 Buskens ..... G03G 15/50 358/1.15

FOREIGN PATENT DOCUMENTS

JP 62290655 A * 12/1987 ..... G03G 15/00
JP 2925712 B2 * 7/1999
JP 3046717 B2 * 5/2000
JP 2001010763 A 1/2001
JP 2001249597 A * 9/2001 ..... G03G 21/14
JP 2005043613 A 2/2005

(Continued)

*Primary Examiner* — Nguyen Ha
(74) *Attorney, Agent, or Firm* — Holtz, Holtz & Volek PC

(57) ABSTRACT

A post-processing device receives sheets ejected one by one from an image forming device, stores, in a storage tray, a number of sheets included in one set on which post processing is to be performed at a post-processing position at once, performs conveyance processing of one stored set of a sheet stack to the post-processing position, ejects the sheet stack to an ejection unit, detects a paper jam of the sheet stack during conveyance processing, when detecting the paper jam, predicts a first time when a beginning sheet of a subsequent ejected set arrives at the storage tray and a second time when the sheet stack with the paper jam is completely ejected in case of retrying conveyance processing, judges that retrial of conveyance processing is possible when the first time is no earlier than the second time, and when judging that the retrial is possible, retries conveyance processing.

9 Claims, 42 Drawing Sheets

(56) References Cited

FOREIGN PATENT DOCUMENTS

| | | | | | |
|---|---|---|---|---|---|
| JP | 2005324933 | A | | 11/2005 | |
| JP | 2005335903 | A | | 12/2005 | |
| JP | 2010168210 | A | * | 8/2010 | ..... G03G 15/00 |
| JP | 2010269908 | A | * | 12/2010 | ..... B65H 43/06 |

* cited by examiner 100
110
120
130
140
150
160
170
180
190
STC 290
291
292
293
294
295
296
297
270
272
273
276
277
X
Y

POST-PROCESSING DEVICE AND IMAGE FORMING SYSTEM

CROSS-REFERENCE TO RELATED APPLICATIONS

This application is based on application No. 2014-225024 filed in Japan, the contents of which are hereby incorporated by reference.

BACKGROUND OF THE INVENTION (1) Field of the Invention

The present invention relates to a post-processing device that is mounted in an image forming apparatus and an image forming system that includes the image forming apparatus and the post-processing device. The present invention relates particularly to an art of improving process for jammed papers in the case where a paper jam occurs during post-processing.

(2) Related Art

According to a general image forming system that includes an image forming apparatus and a post-processing device, one set of a sheet stack that is ejected from the image forming apparatus is conveyed to a post-processing position where post-processing such as stapling is to be performed, and then the sheet stack on which the post-processing has been performed is ejected to an ejection unit that is included in the post-processing device.

In such a post-processing device, a paper jam sometimes occurs during conveyance of the sheet stack. When a paper jam occurs, the system is halted. Accordingly, a user needs to perform a work for restarting post-processing for example by removing the sheet stack in which the paper jam occurs. Such a work increases processing burden imposed on the user, and needs time, and as a result deteriorates productivity of the post-processing.

On the other hand, there is a case where the system does not need to be halted by retrying to convey the sheet stack in which a paper jam occurs depending on the cause for the paper jam. For example, in the case where a paper jam is erroneously detected by a sensor, the system does not need to be halted.

Patent Literature 1 (Japanese Patent Application Publication No. 2010-269908) discloses, as an art of reducing processing burden imposed on a user and preventing deterioration of the productivity of post-processing in the case as above, an art of retrying to convey the sheet stack prior to suspending the post-processing.

However, in the case where conveyance is always retried without suspension of the system, processing for removing jammed papers becomes further complicated and this increases the processing burden imposed on the user. Specifically, while retrial operations of the sheet stack in which a paper jam occurs are performed, the beginning sheet included in a set on which the post-processing is to be subsequently performed is ejected from the image forming apparatus to the post-processing device, and the sheet stack under the retrial contacts the beginning sheet, and as a result another paper jam occurs.

Another paper jam as above is likely to occur in the case where a post-processing device has configuration for example in which one set of a sheet stack on which post-processing is to be subsequently performed is ejected from an image forming apparatus and is stored in a storage tray, and then the sheet stack stored in the storage tray is conveyed to a post-processing position and post processing is performed at the post-processing position.

The present invention was made in view of the above problem, and aims to provide a post-processing device capable of retrying conveyance and preventing increase of a burden of processing for removing jammed papers imposed on a user, and an image forming system including the post-processing device.

SUMMARY OF THE INVENTION

In order to achieve the above aim, one aspect of the present invention provides a post-processing device for receiving sheets ejected one by one from an image forming device, and storing, in a storage tray, a number of sheets included in one set on which post processing is to be performed at a post-processing position at once, the post-processing device comprising: a conveyance unit configured to perform conveyance processing of conveying one set of a sheet stack stored in the storage tray to the post-processing position, and ejecting the sheet stack on which the post processing has been performed from the storage tray to an ejection unit; a detection unit configured to detect a paper jam of the sheet stack during the conveyance processing; a retrial judgment unit configured, when the detection unit detects the paper jam, to predict a first time and a second time, and judge that retrial of the conveyance processing is possible when the first time is no earlier than the second time, the first time being a time when a beginning sheet included in a subsequent set that is ejected from the image forming apparatus arrives at the storage tray, the second time being a time when ejection of the sheet stack in which the paper jam is detected is complete in the case where the conveyance processing is retried; and a retrial control unit configured to, when the retrial judgment unit judges that the retrial is possible, control the conveyance unit to retry the conveyance processing.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings.

DESCRIPTION OF PREFERRED EMBODIMENTS

The following describes a sheet post-processing device and an image forming system relating to a preferred embodiment of the present invention, with reference to the drawings.

<External Appearance of Image Forming System>

Figures 1A, 1B:
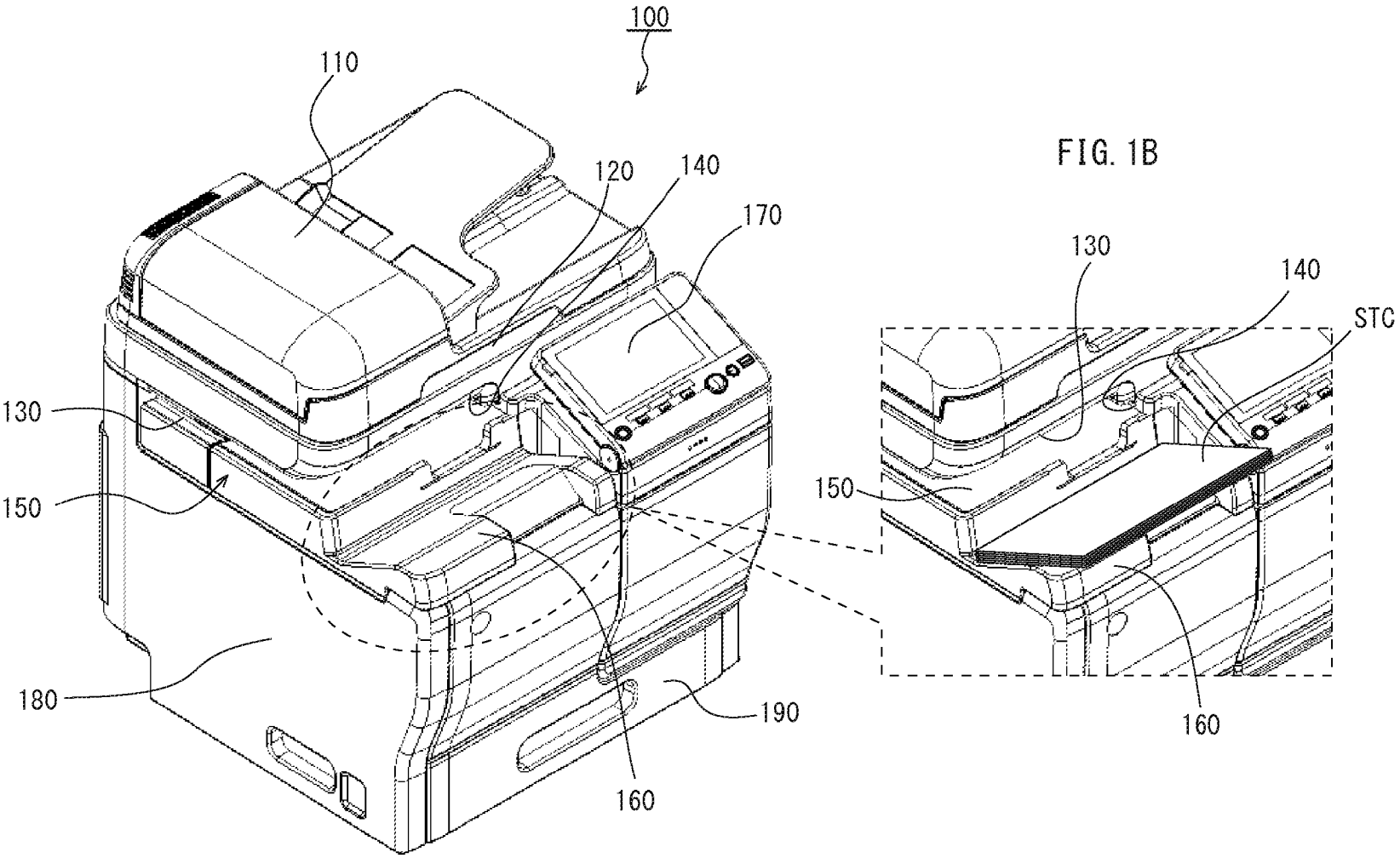
FIG. 1A is a perspective view of an external appearance of an image forming system relating to an embodiment of the present invention.
FIG. 1B is an enlarged view of the vicinity of a second tray shown in FIG. 1A.

FIG. 1A is a perspective view of an external appearance of an image forming system relating to an embodiment of the present invention. The image forming system includes a multi-function peripheral (MFP) 100 as an image forming apparatus. Further, a post-processing device 150 is incorporated into a housing of the MFP 100 so as to be unified with the MFP 100.

The MFP 100 has functions of a scanner, a color copier, and a color laser printer. Referring to FIG. 1A, the MFP 100 is of a desktop type, and has the housing whose height is short so as to be placed on a desktop. An auto document feeder (ADF) 110 is mounted in a top surface of the housing so as to be openable and closable. A scanner 120 is embedded in the housing that is directly under the ADF 110. A space 130 exists directly under the scanner 120, and a paper ejection unit 140 is disposed behind the space 130. In other words, the MFP 100 is of an in-body paper ejection type, and uses the space 130 as a paper ejection space. The post-processing device 150 is mounted in the exit space 130. On a front surface of the MFP 100, a paper ejection tray 160 is disposed in front of the paper ejection space 130, and an operation panel 170 is embedded next to the paper ejection tray 160. A printer 180 is embedded in the housing that is directly under the post-processing device 150, the paper ejection tray 160, and the operation panel 170. A paper feed cassette 190 is attached to a bottom of the printer 180 so as to be able to be pulled out.

FIG. 1B is an enlarged view of the vicinity of the paper ejection tray 160. The post-processing device 150 performs post-processing on a sheet stack STC that is ejected from the paper ejection unit 140 to the paper ejection space 130, and then pushes out the sheet stack STC toward the outside of the paper ejection space 130. The sheet stack STC is loaded on the paper ejection tray 160 as shown in FIG. 1B. The post-processing includes for example processing of aligning the sheet stack STC, processing of stapling the sheet stack STC by a stapler, and processing of sorting the sheet stack STC by shifting position of the sheet stack STC for each set and ejecting the sheet stack STC to the paper ejection tray 160.

<Internal Configuration of Image Forming Apparatus>

Figure 2:
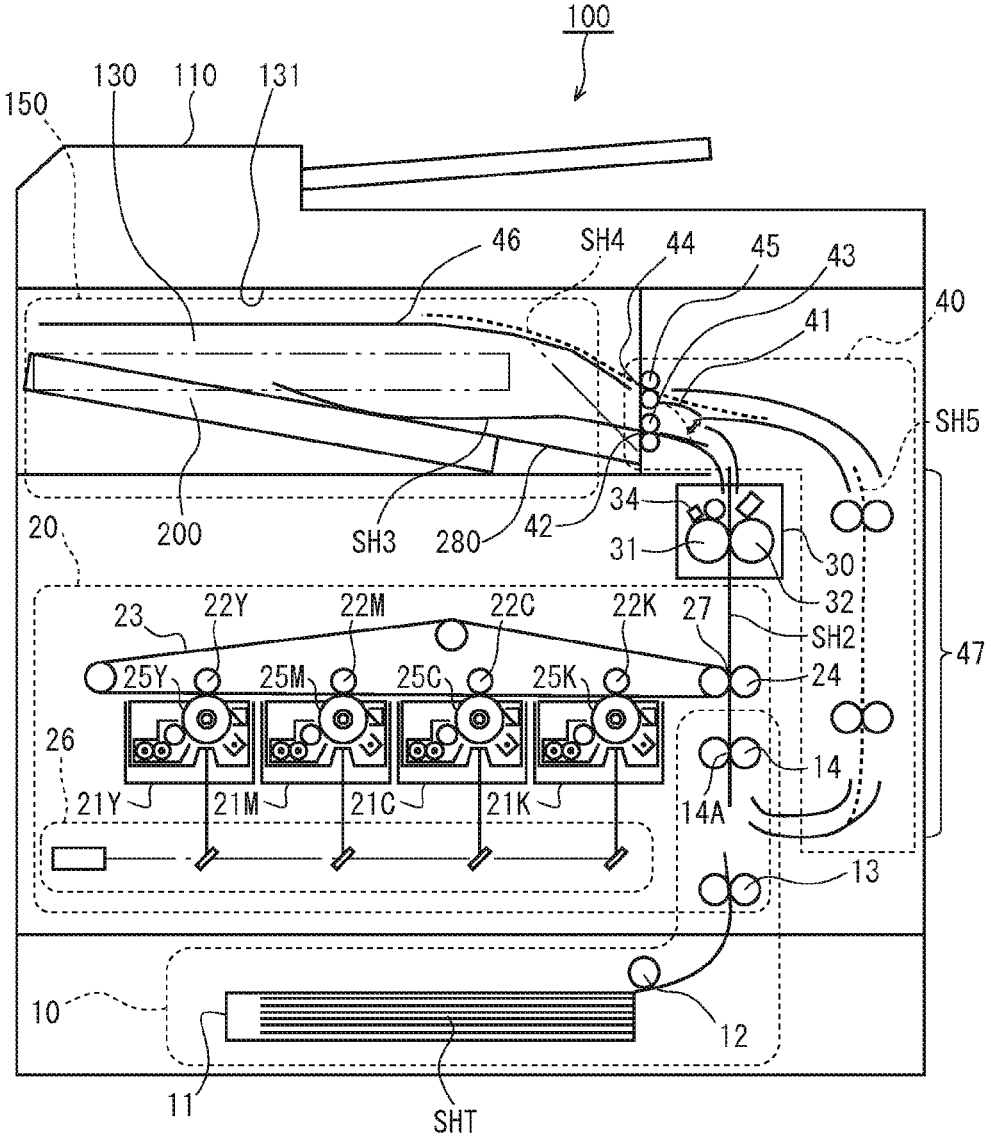
FIG. 2 is a front view schematically showing internal configuration of an image forming apparatus shown in FIG. 1A.

FIG. 2 is a front view schematically showing internal configuration of the MFP 100. Elements included in the MFP 100 are shown in FIG. 2 as if the elements were viewable through the front surface of the housing of the MFP 100. Referring to FIG. 2, the MFP 100 has an image forming unit embedded therein. The image forming unit is an element that forms a toner image on a sheet based on image data, and includes a paper feed unit 10, an image creation unit 20, a fixing unit 30, and a paper ejection unit 40.

The paper feed unit 10 feeds sheets SHT from the paper feed cassette 11 to the image creation unit 20 piece by piece, with use of a pickup roller 12 that picks up the sheets SHT to a conveyance path piece by piece, a pair of conveyance rollers 13, and a pair of resist rollers 14. The pair of resist rollers 14 are rollers that are used for adjusting a timing of transferring a toner image, which is formed by the image creation unit 20, onto a sheet at a transfer position 27. The toner image is formed by the image forming subunit 20 in accordance with an image writing instruction from a first control unit 60, which is described later. The image writing instruction is output after a predetermined default standby period has elapsed since a sheet, which is conveyed, has been temporarily suspended due to contact with a nip part 14A of the pair of resist rollers 14. Driving of the pair of resist rollers 14 is controlled such that the suspended sheet is supplied to the transfer position 27 at a timing when a toner image is conveyed to the transfer position 27.

A paper pass sensor, which is not shown in the figure (a paper pass sensor 15 described later), is disposed near the nip part 14A on the upstream side with respect to the nip part 14A in a sheet conveyance direction. The paper pass sensor detects that the front edge of a sheet has been conveyed to the pair of resist rollers 14. The paper pass sensor is an optical sensor that detects the front edge of the sheet conveyed from the pair of conveyance rollers 13 has arrived at the nip part 14A.

The sheet SHT, which is storable in the paper feed cassette 11, is made of paper or resin, and the size of the sheet SHT is A3, A4, A5, B4, or the like.

The image creation unit 20 forms a toner image on a sheet SH2 that is fed by the paper feed unit 10. Specifically, four image formers 21Y, 21M, 21C, and 21K first each expose a pattern of image data on a surface of a corresponding one of photosensitive drums 25Y 25M, 25C, and 25K, with use of laser beam emitted by an exposure unit 26, thereby to form a latent image on the surface. Then, the image formers 21Y, 21M, 21C, and 21K each develop the latent image by toner of a corresponding one of colors of yellow (Y), magenta (M), cyan (C), and black (K). The developed toner images of the four colors are each transferred onto the same position on a surface of an intermediate transfer belt 23 in order from a surface of the photosensitive drum by the action of an electric field generated between a corresponding one of primary transfer rollers 22Y, 22M, 22C, and 22K and a corresponding photosensitive drum. In this way, a single color toner image is generated on the position. By the action of an electric field generated between the intermediate transfer belt 23 and a secondary transfer roller 24, the color toner image is transferred onto a surface of the sheet SH2, which is passed from the paper feed unit 10 to a nip (the transfer position 27) between the intermediate transfer belt 23 and the secondary transfer roller 24. Then, the secondary transfer roller 24 sends the sheet SH2 to the fixing unit 30.

The fixing unit 30 thermally fixes the toner image on the sheet SH2, which is sent from the image creation unit 20. Specifically, when the sheet SH2 passes through a nip between a fixing roller 31 and a pressure roller 32, the fixing roller 31 applies heat of a heater included therein to the surface of the sheet SH2, and the pressure roller 32 applies pressure to the heated part of the surface of the sheet SH2 and presses the heated part against the fixing roller 31. The toner image is thermally fixed onto the surface of the sheet SH2 by the action of the heat applied by the fixing roller 31 and the pressure applied by the pressure roller 32.

The paper ejection unit 40 delivers the sheet SH2, onto which the toner image is thermally fixed, to the paper ejection space 130. Referring to FIG. 2, the paper ejection unit 40 includes a switching plate 41, a paper ejection outlet 42, a pair of paper ejection rollers 43, an inversion outlet 44, a pair of inversion rollers 45, an inversion guide plate 46, and an inversion path 47.

The switching plate 41 forms a path to the paper ejection outlet 42 in case of storing the sheet, which is sent from an upper part of the fixing unit 30, in the post-processing device 150, and forms a path to the inversion outlet 44 in case of returning the sheet to the image creation unit 20 after causing the sheet to stand by and then inverse. The paper ejection outlet 42 and the inversion outlet 44 are each a slit that is elongated in the horizontal direction, is open toward the housing of the MFP 100, and faces the paper ejection space 130. The pair of paper ejection rollers 43 are disposed inside the paper ejection outlet 42. While rotating, the pair of paper ejection rollers 43 send a sheet SH3, which is moved along the switching plate 41, using a circumferential surface thereof, to a lower part of the paper ejection space 130 through the paper ejection outlet 42, and store the sheet SH3 in the post-processing device 150. The inversion guide plate 46 extends from the outside of the inversion outlet 44 toward a ceiling 131 of the paper ejection space 130, and is supported at a position slightly distant from the ceiling 131. The inversion guide plate 46 provides a place between the inversion guide plate 46 and the ceiling 131 for causing a sheet SH4, on which two-sided printing is to be performed, to stand by.

The pair of inversion rollers 45 are disposed inside the inversion outlet 44. The pair of pair of inversion rollers 45 rotate to send the sheet SH4, which moves along the switching plate 41, to an upper part of the paper ejection space 130 through the inversion outlet 44, by using a circumferential surface thereof, and place the sheet SH4 on the inversion guide plate 46. Further, immediately before the rear edge of the sheet SH4 passes through the pair of inversion rollers 45, the pair of inversion rollers 45 inversely rotate to send the sheet SH4 from the inversion guide plate 46 into the inversion outlet 44 and further send the sheet SH4 to the inversion path 47. The inversion path 47 reverses a sheet SH5, which is sent by the pair of inversion rollers 45, by the action of a driving force of a plurality of pairs of rollers, and returns the sheet SH5 to the pair of resist rollers 14 included in the paper feed unit 10. Then, the sheet SH5 is sent to the image creation unit 20 by the paper feed unit 10 in the same manner as the sheet SHT stored in the paper feed cassette 11. On the reverse side of the surface of the sheet SH5 where the toner image has already been formed, another toner image is formed. The sheet SH5 again undergoes processing performed by the fixing unit 30, and is stored in the post-processing device 150 by the paper ejection unit 40.

<Electronic Control System of Image Forming Apparatus>

Figure 3:
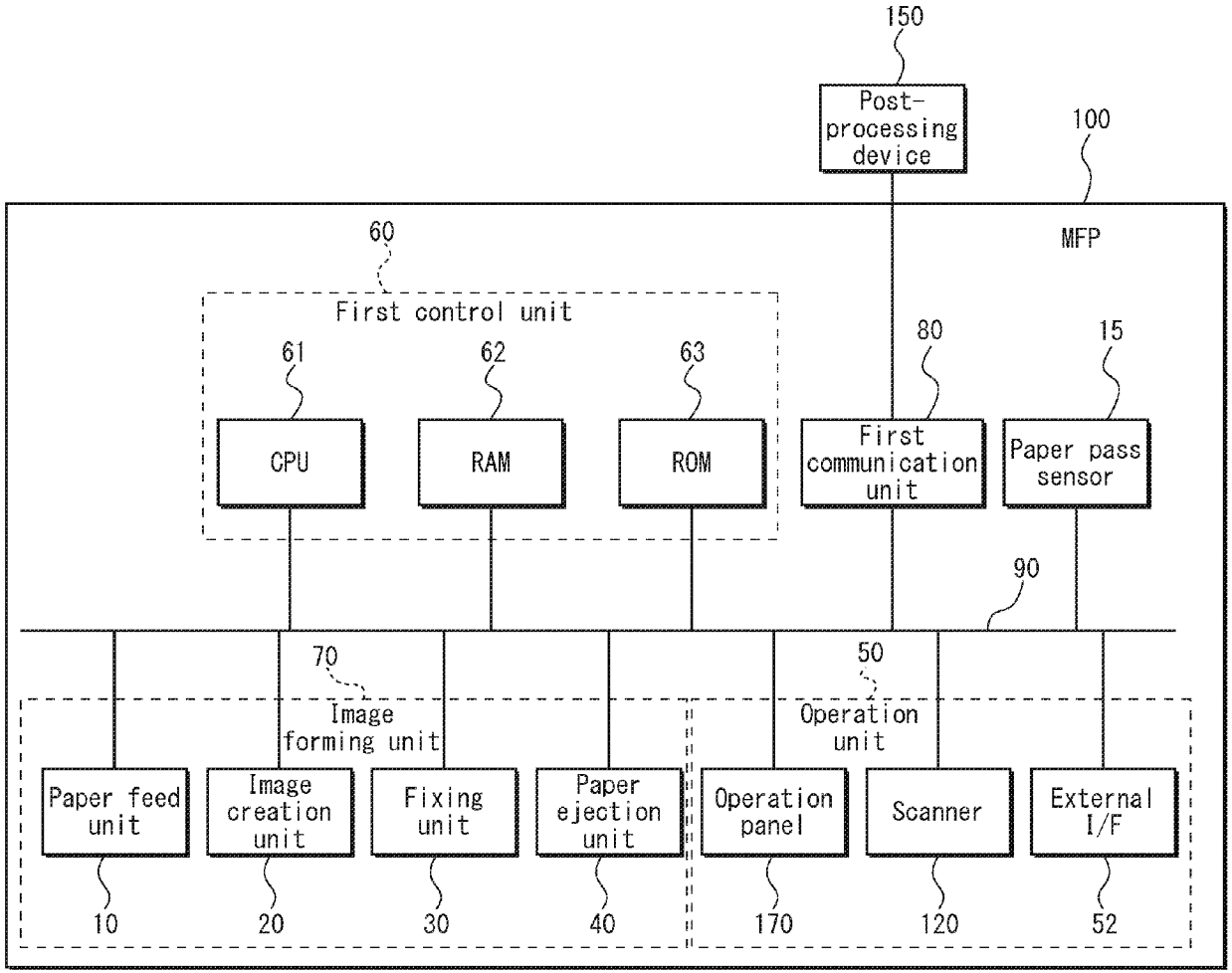
FIG. 3 is a block diagram of configuration of an electronic control system of the image forming apparatus shown in FIG. 1A.

FIG. 3 is a block diagram showing configuration of the MFP 100. Referring to FIG. 3, an image forming unit 70, an operation unit 50, a first control unit 60, a first communication unit 80, and a paper pass sensor 15 in the electronic control system are connected to each other via a bus 90 so as to be communicatable with each other.

The operation unit 50 receives a request for a print job and image data that is a print target via an operation performed by the user or via a communication with an external electronic device, and notifies the first control unit 60 of reception of the print job and the image data. Referring to FIG. 3, the operation unit 50 includes the operation panel 170, the scanner 120, and an external interface (I/F) 52. The operation panel 170 includes a press button, a touchpanel, and a display, as shown in FIG. 1A. The operation panel 170 displays, on the display, a graphic user interface (GUI) screen such as an operation screen and an input screen for various parameters. The operation panel 170 identifies a position of the press button or the touchpanel the user has pressed, and transmits information relevant to the identification as operation information to the first control unit 60. The scanner 120 irradiates, with light, a surface of a document that is automatically fed by the ADF 110 or a surface of a document that is placed on a document tray disposed directly under the ADF 110 by the user, reads characters, patterns, or photographs from intensity distribution of reflected light, and converts the scanned characters, patterns, or photographs to image data. The external I/F 52 includes either one of a USB port, a memory interface such as a memory card slot, and a network interface that is wired or wirelessly connected to an external network. The external I/F 52 acquires image data that is a print target directly from an external storage device such as a USB memory and a hard disk drive (HDD) through such an interface, or communicates with another electric device connected to a network, and thereby to receive the image data that is a print target from the electric device.

The first control unit 60 is an electronic circuit that is mounted on a single substrate disposed inside the MFP 100. Referring to FIG. 3, the first control unit 60 includes a CPU 61, a RAM 62, and a ROM 63. The CPU 61 controls other elements 50, 70, 80, and 15 that are connected to the bus 90, in accordance with firmware. The RAM 62 provides the CPU 61 with a work area for the CPU 61 to execute the firmware, and stores therein image data that is a print target, which is received by the operation unit 50. The ROM 63 includes a non-rewritable semiconductor memory device, and further includes a rewritable semiconductor memory device such as an EEPROM, or an HDD. The non-rewritable semiconductor memory device stores therein the firmware, and the rewritable semiconductor memory device or the HDD provides the CPU 61 with a storage region for environmental variables.

The first control unit 60 first controls, by the CPU 61 executing the firmware, the other elements included in the MFP 100 based on operation information transmitted from the operation unit 50. Specifically, the first control unit 60 controls the operation unit 50 to display the operation screen and receive the user's operation. In accordance with this operation, the first control unit 60 determines an operation mode such as a running mode, a standby mode, a sleep mode, and notifies the other elements of the determined operation mode by a driving signal, and controls the other elements to perform processing in accordance with the determined operation mode.

In accordance with the firmware executed by the CPU 61, the first control unit 60 also controls the operation unit 50 to receive an instruction relevant to post-processing from the user, and transmits control information relevant to the post-processing to the post-processing device 150 based on the instruction. The control information defines whether each type of post-processing is necessary, the number of copies, the size of sheets, the number of sheets per set on which post processing is to be performed at a post-processing position at once (here, one set includes at least one sheet), the orientation of the sheets while being ejected (vertically placed or horizontally placed), and so on. The first control unit 60 transmits, to the post-processing device 150, a signal for pre-notifying paper ejection to be performed by the paper ejection unit 40, in other words, for notifying of a timing of the paper ejection in advance.

When the operation unit 50 receives a print job from the user for example, the first control unit 60 first controls the operation unit 50 to transfer image data that is a print target to the RAM 62. Next, in accordance with a print condition indicated by the print job, the first control unit 60 transmits designation of a type of sheets to be fed and a feeding timing of the sheets to the paper feed unit 10, provides the image creation unit 20 with image data representing a toner image to be formed, transmits designation of a surface temperature of the fixing roller 31 to be maintained to the fixing unit 30, and transmits designation indicating whether the sheets are to be stored in the post-processing device 150 or inversed on the inversion guide plate 46 to the paper ejection unit 40. Further, when a print job is started, the first control unit 60 transmits control information relevant to post-processing to the post-processing device 150. While the print job is executed, the first control unit 60 continues to pre-notify the post-processing device 150 of paper ejection to be performed by the paper ejection unit 40.

Also, while the print job is executed, the first control unit 60 monitors a conveyance position of a sheet, and notifies the post-processing device 150 of information relevant to the conveyance position (hereinafter, referred to as conveyance information) in response to an acquisition request issued by the post-processing device 150 (a second control unit 300 described later).

Specifically, the first control unit 60 first acquires an elapsed period (T) and delay availability information. The elapsed period indicates a period elapsed since notification of start of sheet feeding is received from the image forming unit 70. The delay availability information indicates whether the current conveyance position of the front edge of the sheet is positioned at a conveyance delayable position based on output by the paper pass sensor 15.

Here, the conveyance delayable position indicates a position that is before a conveyance position of the front edge of a beginning sheet that is conveyed arrives at (contacts) the nip part 14A of the pair of resist rollers 14, or a position at a time when a default standby period does not elapse since the front edge of the beginning sheet has arrived at the nip part 14A. The default standby period indicates a standby period since the arrival at the nip part 14A until the first control unit 60 outputs image data to the image creation unit 20 and instructs the image creation unit 20 to write an image and controls the pair of resist rollers 14 which have temporarily suspended to redrive.

In the case where the rollers that convey the sheet have a stepper motor for example, the number of pulses of a driving signal of the stepper motor is used for measuring the elapsed period. In the case where the rollers that convey the sheet have a driving motor that includes an encoder for example, the number of rotations of the driving motor is used for measuring the elapsed period.

Further, the first control unit 60 calculates a period (AR) that is necessary for the front edge of the sheet to arrive at the paper ejection outlet 42 from the current position of the sheet, and notifies the post-processing device 150 of the calculated period AR and the acquired delay availability information as conveyance information via the first communication unit 80.

Here, the first control unit 60 stores, for each type and size of sheets, in the ROM 63 in advance, a period (TO) that is necessary for the front edge of a sheet to arrive at the paper ejection outlet 42 from a feed start position of the sheet. The period AR is calculated by calculating a difference between the period TO and the elapsed period T.

The first communication unit 80 performs wired or wireless communication with the electronic control system of the post-processing device 150. Especially, the first communication unit 80 relays information exchange performed between the first control unit 60 and the control unit included in the post-processing device 150.

<Configuration of Post-Processing Device>

Figure 4:
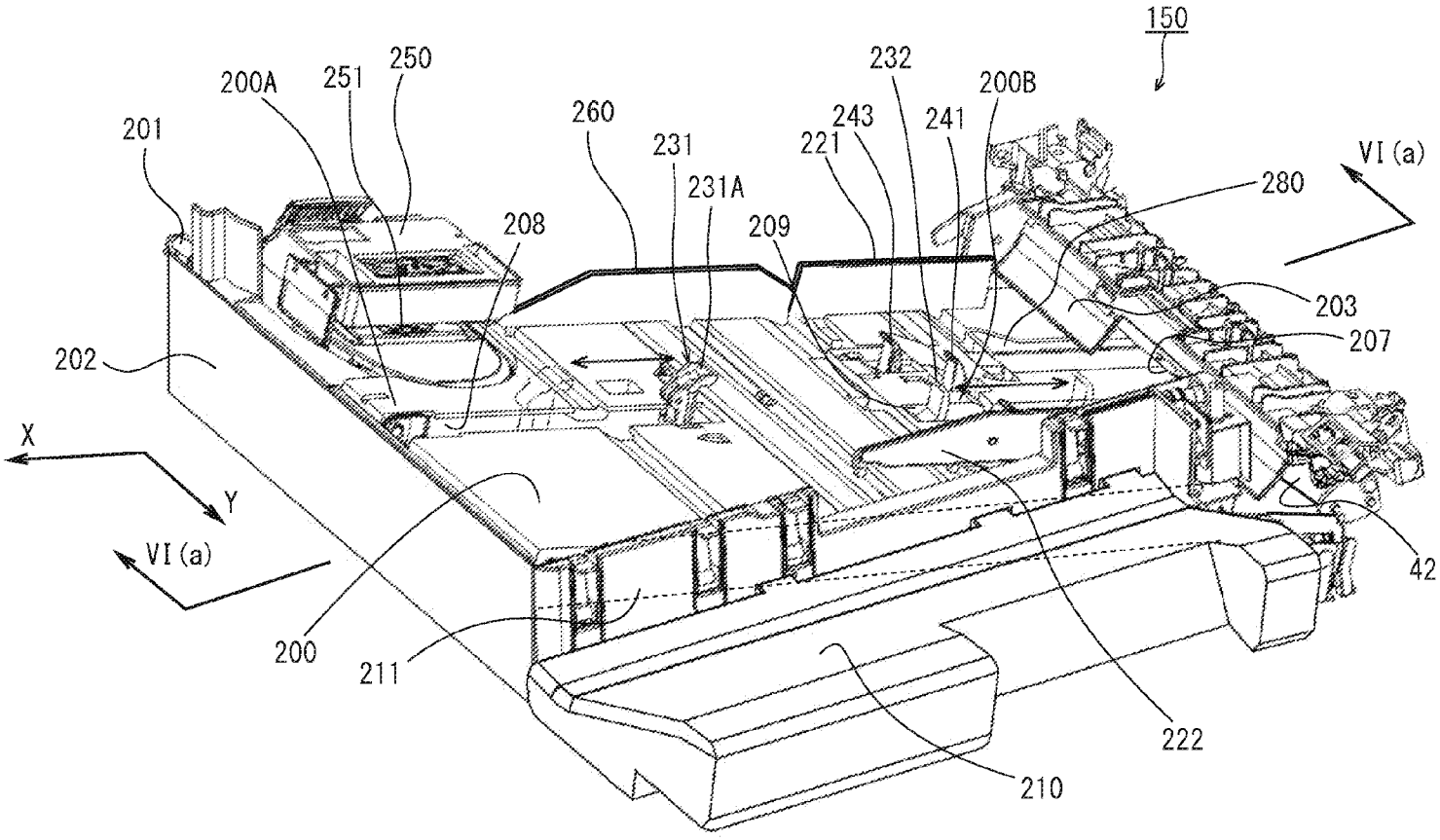
FIG. 4 is a perspective view of the external appearance of a post-processing device shown in FIG. 1A.
Figure 5:
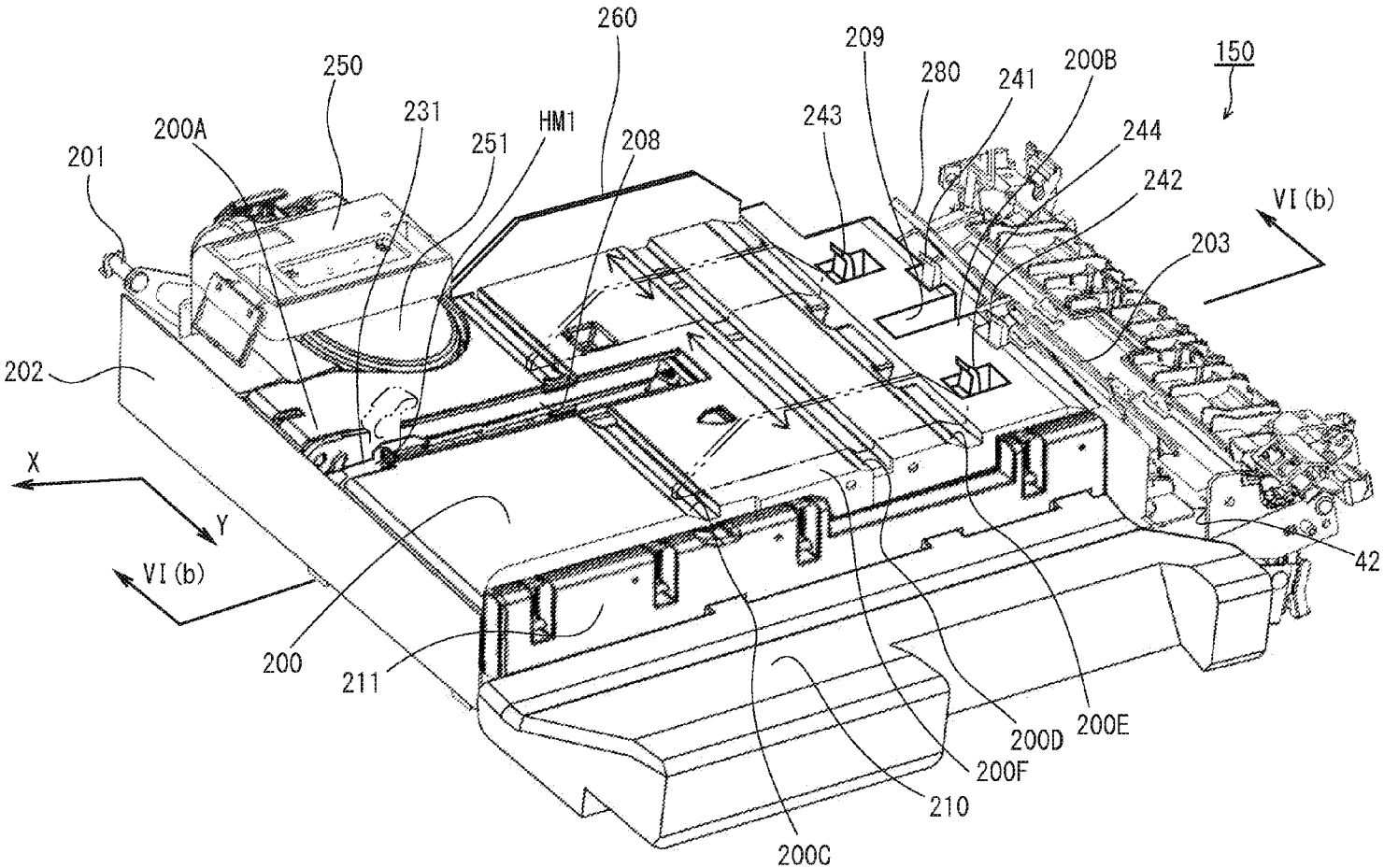
FIG. 5 is a perspective view of the external appearance of the post-processing device shown in FIG. 4 in the state where a placement surface of a first tray is horizontal.
Figure 6A:
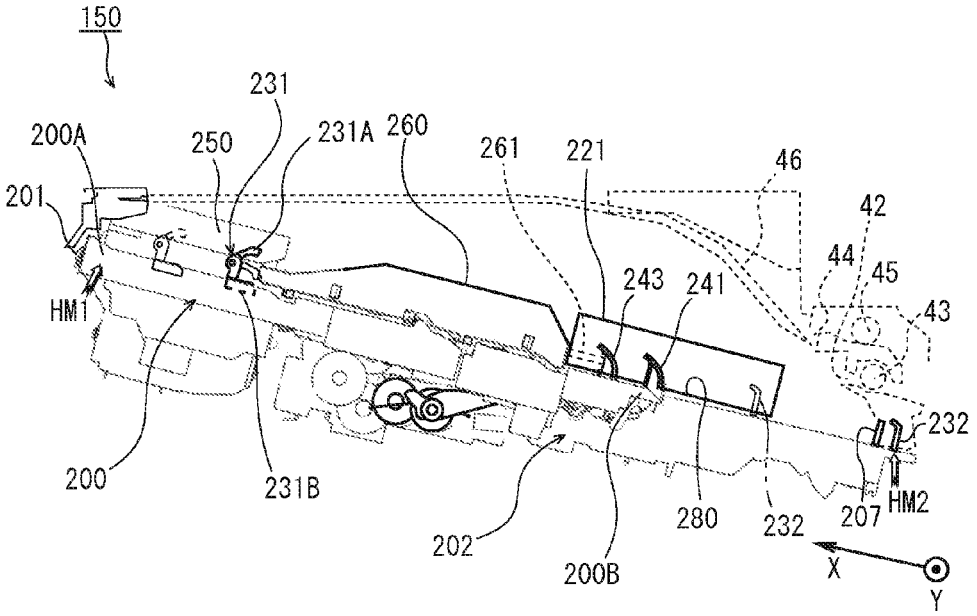
FIG. 6A is a cross-sectional view taken along a line VI(a)-VI(a) in FIG. 4.
Figure 6B:
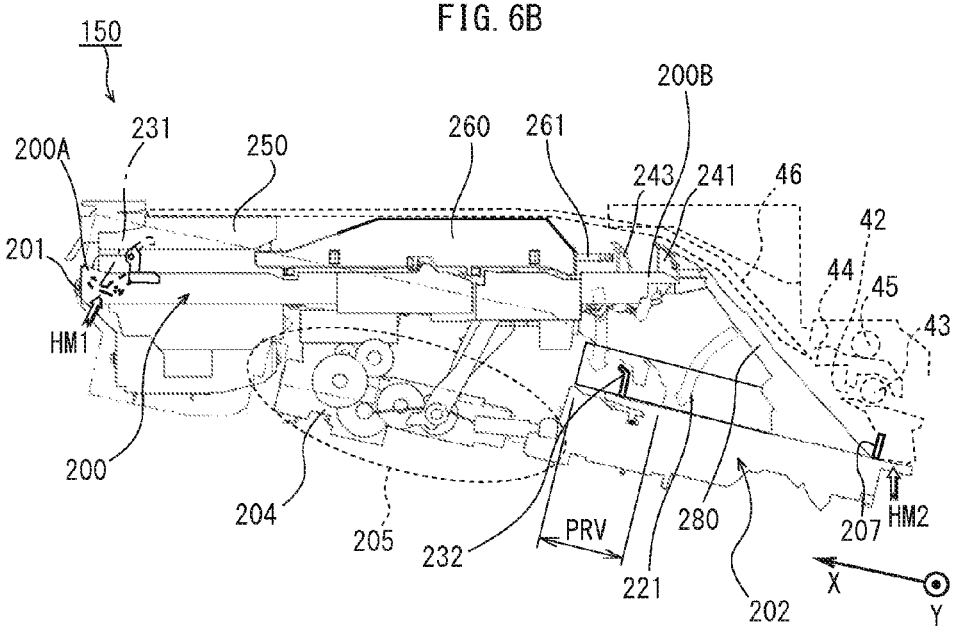
FIG. 6B is a cross-sectional view taken along a line VI(b)-VI(b) in FIG. 5.

FIGS. 4 and 5 are perspective views showing an external appearance of the post-processing device 150. FIG. 6A is a cross-sectional view taken along a line VI(a)-VI(a) in FIG. 4, and FIG. 6B is a cross-sectional view taken along a line VI(b)-VI(b) in FIG. 5. Referring to FIGS. 4-6B, the post-processing device 150 includes a first tray 200, a second tray 210, a first alignment member 221 and a second alignment member 222, a front edge conveyance member 231, a rear edge conveyance member 232, holding members 241 and 243, process units 250 and 251, a push-out member 260, and a guide member 280.

The first tray 200 is a tray that stores therein sheets that are ejected through the paper ejection outlet 42 included in the MFP 100. The first tray 200 has a placement surface whose inclination is variable with respect to a paper ejection direction (an X-axis direction in FIGS. 4-6B, and hereinafter referred to as an FD direction). As shown in FIGS. 4-6B, the FD direction is inclined with respect to the horizontal direction.

The second tray 210 is the paper ejection tray 160 in FIG. 1, and is adjacent to the first tray 200 with a vertical wall 211 interposed therebetween in a direction perpendicular to the paper ejection direction (the FD direction). The perpendicular direction is a Y-axis direction in FIGS. 4 and 5, and is hereinafter referred to as a CD direction. As shown in FIGS. 4-6B, the CD direction is substantially horizontal.

The first alignment member 221 and the second alignment member 222 align a sheet stack by sandwiching a sheet stack therebetween on the first tray 200 in the CD direction.

The front edge conveyance member 231 and the rear edge conveyance member 232 convey the sheet stack on the first tray 200 in the FD direction by sandwiching the sheet stack therebetween. The front edge conveyance member 231 and the rear edge conveyance member 232 especially convey the sheet stack to directly under the process unit 250, or place the entire sheet stack on the placement surface of the first tray 200.

When the placement surface of the first tray 200 is inclined with respect to the horizontal direction, the holding members 241 and 243 protrude from the placement surface to hold the sheet stack from the lower side in the inclination direction.

The process units 250 and 251 process sheets which are stored in the first tray 200.

The push-out member 260 moves back-and-forth on the first tray 200 in the CD direction to push out a sheet stack, which is stored in the first tray 200, to the second tray 210 and ejects the sheet stack.

The guide member 280 is pivotable up and down. Especially, the guide member 280 has an upper surface whose inclination is variable with respect to the FD direction. With this configuration, while the placement surface of the first tray 200 is inclined with respect to the horizontal direction, the guide member 280 moves a sheet, which is ejected through the paper ejection outlet 42, to the placement surface. While the placement surface is horizontal, the guide member 280 prevents the sheet from moving to the placement surface.

The following explains these members in detail.

—First Tray—

Referring to FIGS. 4-6B, the first tray 200 includes a support shaft 201 in an end part 200A thereof in the FD direction that is positioned more distant from the paper ejection outlet 42 than the other end part is. Hereinafter, the end part 200A is referred to as an upper end part 200A of the first tray 200. The support shaft 201 connects the first tray 200 to a housing 202 of the post-processing device 150 so as to make the first tray to be pivotable. The first tray 200 pivots about the support shaft 201, and thereby displaces up and down the other end part 200B of thereof, which is positioned closer to the paper ejection outlet 42 in the FD direction, so as to vary inclination of the placement surface with respect to the FD direction. Hereinafter, the other end part 200B is referred to as a lower end part 200B of the first tray 200. Specifically, until one set of a sheet stack is stored in the first tray 200 from the MFP 100, the first tray 200 inclines the placement surface with respect to the horizontal direction and keeps the placement surface parallel to the FD direction as shown in FIGS. 4 and 6A. During this period, the first tray 200 is used as a work space for performing post-processing such as alignment on sheets ejected from the MFP 100. On the other hand, during a period while one set of a sheet stack is pushed out and ejected from the first tray 200 to the second tray 210, the first tray 200 returns the placement surface so as to be kept horizontal as shown in FIGS. 5 and 6B. As a result, the sheet stack, which is ejected from the first tray 200 moves to the second tray 210 while a surface of the sheet stack is substantially horizontal.

Referring to FIG. 4, a paper ejection guide plate 203 is disposed immediately outside the paper ejection outlet 42. The paper ejection guide plate 203 moves a sheet, which is ejected through the paper ejection outlet 42, to the placement surface of the first tray 200. When the entire sheet is completely ejected to the outside of the paper ejection outlet 42, the edge of the sheet that is positioned on a lower side of inclination of the placement surface of the first tray 200 is aligned, due to the inclination of the placement surface, at a position where the edge contacts a lateral surface 207 of the housing 202 (hereinafter, referred to as a lateral surface 207 of a lower end part of the housing 202) of the post-processing device 150, which is positioned on the same side as the edge of the sheet. In this way, sheets to be stored in the first tray 200 are aligned in the FD direction.

Although not shown in FIGS. 4-6B, respective sheet rear edge sensors are embedded in the vicinity of each of the lower end part 200B of the first tray 200 and in the vicinity of a marginal part 200F of the placement surface of the first tray 200 in the CD direction (see FIG. 5). The sheet rear edge sensors are each for example an optical sensor, and optically detect the rear edge of a sheet stack, which moves from the paper ejection outlet 42 to the placement surface of the first tray 200, and detect the rear edge of the sheet stack, which is pushed out from the first tray 200 in the CD direction. Especially when the rear edge of the sheet stack arrives at the lower end part 200B of the first tray 200 and when the rear edge arrives at the marginal part 200F of the placement surface of the first tray 200 in the CD direction, the sheet rear edge sensors react.

Referring to FIG. 5, the placement surface of the first tray 200 is higher than an upper edge of the vertical wall 211 which separates between the first tray 200 and the second tray 210. Accordingly, the sheet stack stored in the first tray 200 moves to the second tray 210 only by being pushed out in the CD direction (the positive direction on the Y-axis), without being disrupted by any member such as the alignment member 222.

Referring to FIG. 6B, the post-processing device 150 includes a lift motor 204 and a cam mechanism 205 in a lower region of the first tray 200. The lift motor 204 rotates a shaft in accordance with a driving signal transmitted from the second control unit 300, which is descried later. The cam mechanism 205 converts a rotational force of the shaft to a pivoting force of the first tray 200. The first tray 200 pivots about the support shaft 201 by the action of the pivoting force.

—Second Tray—

Referring to FIGS. 4 and 5, the placement surface of the second tray 210 is inclined obliquely upward from the vertical wall 211, which separates between the first tray 200 and the second tray 210, with respect to the CD direction (the Y-axis direction). Since the placement surface of the second tray 210 is inclined in this way, the sheet stack which is pushed out from the first tray 200 is aligned at a position where the lower edge in the inclination direction contacts the vertical wall 211. In this way, the sheets to be stored in the second tray 210 are aligned in the CD direction.

—Alignment Members—

Referring to FIG. 4, the first alignment member 221 and the second alignment member 222 are disposed in both the respective marginal parts of the placement surface of the first tray 200 in the CD direction (the Y-axis direction). While the placement surface of the first tray 200 is inclined with respect to the horizontal direction, the first alignment member 221 and the second alignment member 222 is movable back and forth on the placement surface in the CD direction.

The first alignment member 221 is coupled to the housing 202 of the post-processing device 150 via a tension spring (not shown in FIG. 4). The first alignment member 221 is pulled by an elastic force of the tension spring, and as a result a back surface of the first alignment member 221 contacts an extension part 261 (see FIGS. 5 and 6B) of the push-out member 260, which is adjacent to the first alignment member 221. When the push-out member 260 advances toward the second tray 210, the first alignment member 221 advances in the same direction as that in the push-out member 260 advances by being pushed by the extension part 261 of the push-out member 260. When the push-out member 260 recedes toward its original position, the first alignment member 221 recedes in the same direction as that in the push-out member 260 recedes by being pulled by the tension spring. In this way, the first alignment member 221 moves in conjunction with the push-out member 260.

A CD alignment motor that applies a driving force to the second alignment member 222 and a driving mechanism thereof are disposed in the lower region of the first tray 200 of the post-processing device 150 shown in FIGS. 6A and 6B (these elements are not shown in FIGS. 6A and 6B). The CD alignment motor rotates the shaft in accordance with a driving signal transmitted from the second control unit 300 which is described below, and the driving mechanism converts a rotational force of the shaft to a driving force of back-and-forth movement of the second alignment member 222. In this way, the second alignment member 222 moves back and forth independently from the first alignment member 221.

—Front Edge Conveyance Member (Leading Member)—

Referring to FIG. 4, the front edge conveyance member 231 is disposed in an upper end part 200A of the first tray 200. While the placement surface of the first tray 200 is inclined with respect to the horizontal direction, the front edge conveyance member 231 protrudes from a groove 208 formed in the upper end part 200A in the FD direction (the X-axis direction), and movable back and forth along the groove 208. The front edge conveyance member 231 contacts the front edge in the FD direction of a sheet stack stored in the first tray 200, and leads a sheet stack in the FD direction. Hereinafter, the front edge conveyance member is referred to as a leading member for the purpose of simplifying the description. During conveyance of a sheet in the FD direction, the leading member 231 prevents the sheet from diagonally deviating from the FD direction, prevents the sheet from becoming inclined, or losing alignment of a sheet stack.

As shown in FIGS. 4 and 6A, the leading member 231 further includes a gripping claw 231A attached to a front end part thereof so as to be pivotable. The leading member 231 grips the front edge of a sheet stack by bringing the gripping claw 231A down and pushing the front edge of the sheet stack down onto an upper surface of a base part 231B thereof from above. Also, as shown in FIGS. 5 and 6B, when being positioned at the upper end part 200A of the first tray 200, the leading member 231 causes the front end part thereof to pivot about the base part 231B to be brought down in the groove 208 of the placement surface of the first tray 200. This allows the leading member 231 to retract to a position HM1 in the groove 208. Hereinafter, this position HM1 is referred to as a retraction position of the leading member 231. Note that the retraction position is referred to also as a home position.

An FD alignment motor that applies a driving force to the second alignment member 222 and a driving mechanism thereof are disposed in the lower region of the first tray 200 of the post-processing device 150 shown in FIGS. 6A and 6B (these elements are not shown in FIGS. 6A and 6B). The FD conveyance motor is for example a stepping motor, and intermittently rotates a shaft in accordance with pulse of a driving signal transmitted from the second control unit 300 described later. The driving mechanism converts a rotational force of the shaft to a driving force of back-and-forth movement of the leading member 231 and a driving force of flexion and extension movement of the main body of the leading member 231 and pivot of the gripping claw 231A. Especially when the forcing member 231 is retracted to the retraction position HM1 after conveyance of the sheet stack, torque of the FD conveyance motor is set such that speed of the forcing member 231 is maintained to a constant value.

—Rear Edge Conveyance Member (Forcing Member)—

Referring to FIG. 4, the rear edge conveyance member 232 is disposed in the lower end part 200B of the first tray 200. While the placement surface of the first tray 200 is inclined with respect to the horizontal direction, the rear edge conveyance member 232 protrudes from a groove 209 that is formed in a lower end part of the placement surface in the FD direction, and is movable back and forth along the groove 209. The rear edge conveyance member 232 contacts the rear edge in the FD direction of a sheet stack stored in the first tray 200, and forces the sheet stack in the FD direction. Hereinafter, the rear edge conveyance member is referred to as a forcing member for the purpose of simplifying the description.

As shown in FIG. 6A, the forcing member 232 continues to further descend in the inclination direction thereof, and this allows the forcing member 232 to retract to a position HM2 that is lower than the lateral surface 207 of the lower end part of the housing 202. Hereinafter, the position HM2 is referred to as treat position of the forcing member 232.

An FD conveyance motor that applies a driving force to the forcing member 232 and a driving mechanism thereof are disposed in a region from the lower side of the first tray 200 to the lower side of the paper ejection outlet 42 in the post-processing device 150 shown in FIGS. 6A and 6B (these elements are not shown in FIGS. 6A and 6B). The FD conveyance motor is for example a stepping motor, and intermittently rotates a shaft in accordance with pulse of a driving signal transmitted from the second control unit 300 described later. The driving mechanism converts a rotational force of the shaft to a driving force of back-and-forth movement of the forcing member 232. In this way, the forcing member 232 moves independently from the leading member 231. Especially when the forcing member 232 is retracted to the retraction position HM2 after conveyance of the sheet stack, a torque of the FD conveyance motor is set such that speed of the forcing member 232 is maintained to a constant value.

When the leading member 231 and the forcing member 232 convey a sheet stack, the respective torques of the FD alignment motor and the FD conveyance motor are adjusted in accordance with standard weight of the sheet stack such that speed of the sheet stack reaches a predetermined target value. The target speed is set to a value according to which the post-processing device 150 does not impair the productivity of the MFP 100. A conveyance force obtained by the adjusted torques, that is, a driving force applied to the sheet stack by the leading member 231 and the forcing member 232, is referred to as a conveyance force in the normal state, or a driving force of the leading member 231 and the forcing member 232 in the normal state. The conveyance force in the normal state is large to a degree that speed of a sheet stack with standard weight can be increased to the target speed against a friction force between the sheet stack and the first tray 200.

—Holding Members—

Referring to FIGS. 4 and 5, a pair of two first holding members 241 and 242 and a pair of two second holding members 243 and 244 are disposed in the lower end part 200B of the first tray 200. The holding members are each embedded in the placement surface of the first tray 200, and have a front end part that is protrudable from the placement surface. FIGS. 4-6B show the states where all the holding members 241-244 protrude from the placement surface.

When the placement surface of the first tray 200 is inclined with respect to the horizontal direction, the pair of first holding members 241 and 242 or the pair of second holding members 243 and 244 protrude from the placement surface, and hold a sheet stack, which is stored in the first tray 200, from the lower side in the inclination direction. This prevents the sheet stack from moving toward the lower side in the inclination direction, that is, a direction (the negative direction on the X-axis) inverse to the FD direction. Also, the first holding members 241 and 242 are positioned in the lower end part 200B of the first tray 200, and the second holding members 243 and 244 are positioned closer to the center of the placement surface in the FD direction than the first holding members 241 and 242 are. Accordingly, a sheet stack, which is held by the second holding members 243 and 244, is positioned higher in the inclination direction than that, which is held by the first holding members 241 and 242.

The first holding members 241 and 242 are connected to a first solenoid and a tension spring that are disposed in the lower part of the first tray 200 shown in FIGS. 6A and 6B (these elements are not shown in FIGS. 6A and 6B). The second holding members 243 and 244 are connected to a second solenoid and a tension spring that are disposed in the lower part of the first tray 200 (these elements are also not shown in FIGS. 6A and 6B). While receiving a driving force applied by the connected solenoid, the holding members 241-244 each protrude from the placement surface. While application of the driving force is suspended, the holding members 241-244 each retract into the placement surface by an elastic force of the tension spring. In this way, the pair of first holding members 241 and 242 simultaneously protrude and retract, and the pair of second holding members 243 and 244 simultaneously protrude and retract. On the other hand, the pair of first holding members 241 and 242 protrude and retract independently from the pair of second holding members 243 and 244.

—Process Units—

Referring to FIGS. 4 and 5, the process units 250 and 251 are disposed in the vicinity of the support shaft 201 of the first tray 200. Specifically, a clincher 250 is disposed above the placement surface of the first tray 200, and a stapler 251 is disposed in a region of the placement surface facing the clincher 250. The process units use these elements 250 and 251 as shown below. The clincher 250 is movable back and forth in a normal direction of the placement surface, and is contactable the stapler 251, which faces the clincher 250. The clincher 250 presses a corner of a sheet stack disposed thereunder against the stapler 251, in accordance with a driving signal transmitted from the second control unit 300 described later. In response to this, the stapler 251 staples a staple in the corner. The clincher 250 distorts the front end of the staple, which protrudes from the corner, so as to be flat. In this way, the sheet stack is stapled.

—Push-Out Member—

Referring to FIG. 4, while the placement surface of the first tray 200 is inclined with respect to the horizontal direction, the push-out member 260 is positioned at one of the marginal parts of the placement surface in the CD direction (the Y-axis direction) and is in contact with the first alignment member 221. Further, while keeping this state, the push-out member 260 is movable back and forth on the placement surface in the CD direction.

Referring to FIG. 5, the placement surface of the first tray 200 has provided therein grooves 200C, 200D, and 200E in the CD direction (the Y-axis direction) for guiding the push-out member 260. While the placement surface of the first tray 200 is kept horizontal, the push-out member 260 is movable back and forth on the placement surface from one margin to the opposite margin in the CD direction along the grooves 200C-200E. Further, the push-out member 260 can retract to the outside of the placement surface by moving in the CD direction (the negative direction on the Y-axis) from the position thereof at a time when the placement surface is inclined with respect to the horizontal direction.

A CD conveyance motor that applies a driving force to the push-out member 260 and a driving mechanism thereof are disposed in the lower part of the first tray 200 shown in FIGS. 6A and 6B (these elements are not shown in FIGS. 6A and 6B). The CD conveyance motor rotates a shaft in accordance with a driving signal transmitted from the second control unit 300, which is descried later. The driving mechanism includes a plurality of pulleys and a wire that is tensioned between the pulleys. One of the pulleys is connected to the shaft of the CD conveyance motor, and rotates together with the shaft. The wire converts, by rotating together with the pulley, a rotational force of the shaft to a driving force of back-and-forth movement of the push-out member 260. In this way, the push-out member 260 moves back and forth on the placement surface of the first tray 200 in the CD direction.

—Guide Member—

Referring to FIGS. 4-6B the guide member 280 is disposed in a region of the post-processing device 150 that is lower than the lower end part 200B in the first tray 200 (the negative side on the X-axis). The guide member 280 has an upper surface that is pivotable about a shaft that is located at one of end parts thereof that is closer to the paper ejection outlet 42. As shown in FIGS. 4 and 6A, while the first tray 200 inclines the placement surface with respect to the horizontal direction, the guide member 280 parallelizes the upper surface in the FD direction so as to coincide with an extension part of the placement surface of the first tray 200. As a result, a sheet, which is ejected through the paper ejection outlet 42, moves to the placement surface of the first tray 200 along the upper surface of the guide member 280. As shown in FIGS. 5 and 6B, on the other hand, while the first tray 200 keeps the placement surface horizontal, the guide member 280 inclines the upper surface with respect to the FD direction. As a result, the guide member 280 prevents the sheet, which is ejected through the paper ejection outlet 42, from intruding into the lower part of the first tray 200.

The guide member 280 is connected to a driving mechanism of the forcing member 232 through a cam mechanism that is disposed in a lower part of the guide member 280 (these elements are not shown in FIGS. 6A and 6B). As shown in FIG. 6B, while the position of the forcing member 232 is kept in a range PRV, the cam mechanism converts a rotational force of the shaft of the FD conveyance motor to a pivoting force of the guide member 280 through the driving mechanism of the forcing member 232. The range PRV is a range distant from the retraction position HM2 by a predetermined distance (a distance from the retraction position HM2 to the lower end of the placement surface of the first tray 200) or greater. The guide member 280 varies inclination of the upper surface owing to the pivoting force in conjunction with the forcing member 232.

[Electronic Control System of Post-Processing Device]

Figure 7:
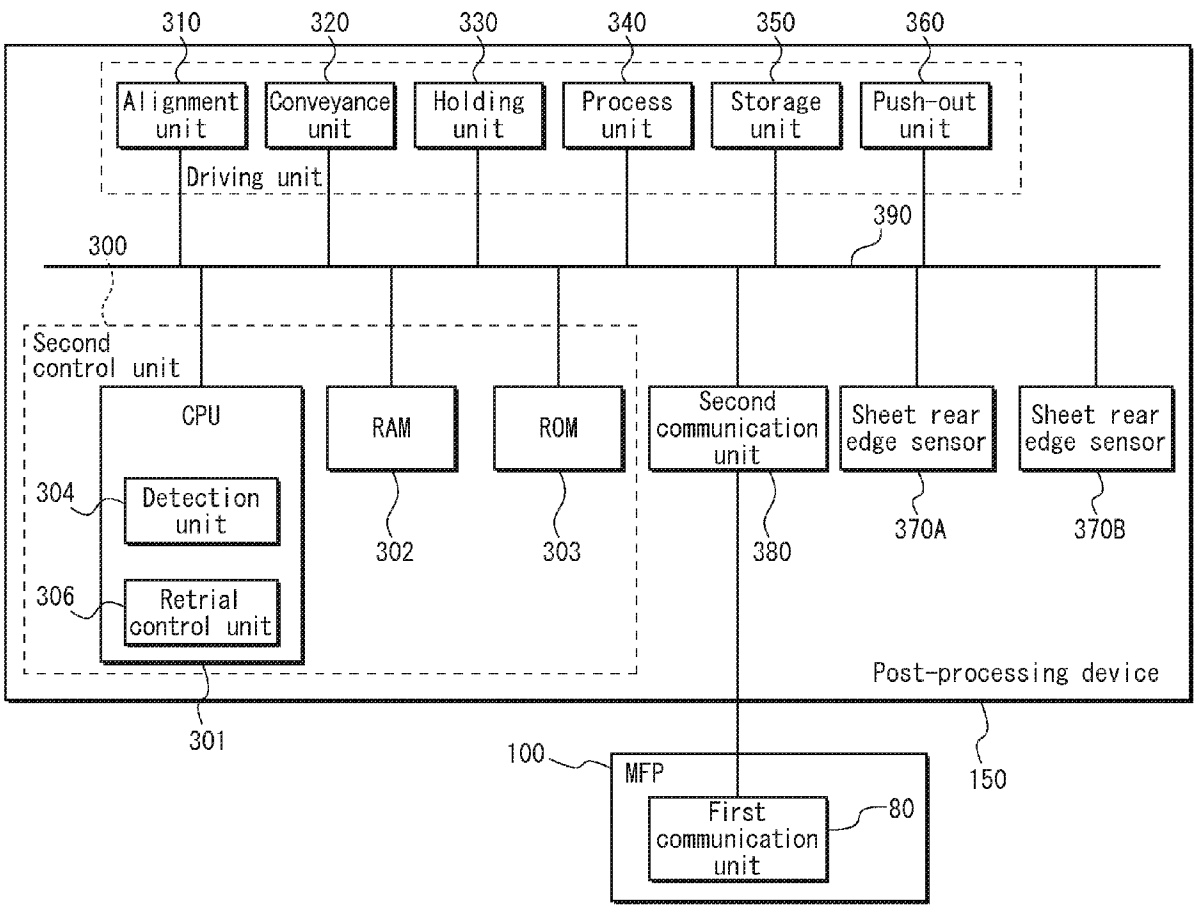
FIG. 7 is a block diagram of configuration of an electronic control system of the post-processing device shown in FIG. 4.

FIG. 7 is a block diagram of configuration of the electronic control system of the post-processing device 150. Referring to FIG. 7, the second control unit 300 is connected to each of driving units 310-360, sheet rear edge sensors 370A and 370B, and a second communication unit 380 via a bus 390 in the electronic control system.

—Driving Units—

Referring to FIG. 7, the driving units 310-360 are specifically an alignment unit 310, a conveyance unit 320, a holding unit 330, a process unit 340, a storage unit 350, and a push-out unit 360, respectively. The driving units 310-360 are each a driver for a source of power of a corresponding movable member. In order to operate the movable member, the driver units 310-360 each control the source of power of the movable member in accordance with a driving signal transmitted from the second control unit 300.

The alignment unit 310 controls the CD alignment motor, the FD alignment motor, and the CD conveyance motor in order to control the first alignment member 221 and the second alignment member 222, the leading member 231, and the push-out member 260 to align sheets. The conveyance unit 320 controls the FD alignment motor and the FD conveyance motor in order to control the leading member 231 and the forcing member 232 to convey a sheet stack in the FD direction. The holding unit 330 controls the first solenoid and the second solenoid in order to protrude or retract the holding members 241-244. The process unit 340 controls stack process of sheets performed by the clincher 250 and the stapler 251. The storage unit 350 controls the lift motor 204 in order to control the first tray 200 to pivot about the support shaft 201. The push-out unit 360 controls the CD conveyance motor in order to control the push-out member 260 to convey (push out) a sheet stack in the CD direction.

The conveyance unit 320 and the push-out unit 360 have a function of conveying the sheet stack stored in the first tray 200 to the second tray 210 via the process units 250 and 251 in collaboration with each other.

The driving units 310-360 each include a position sensor for detecting position or orientation of a movable member, and notify the second control unit 300 of the position or orientation of the movable member detected by the position sensor. The position sensor is for example an optical sensor that includes a light emitting unit and a light receiving unit. The light emitting unit emits light of a predetermined wavelength such as infrared ray, and the light receiving unit detects the light of the predetermined wavelength. The light emitting unit and the light receiving unit are disposed with a movable member that is a detection target interposed therebetween, such that while the movable member is in a specific position or orientation, light emitted from the light emitting unit is blocked from reaching the light receiving unit. The driving units 310-360 each detect that the movable member is in the specific position or orientation, owing to an output from the light receiving unit indicating that the emitted light is blocked. Alternatively, the light emitting unit and the light receiving unit may be disposed on the same side facing a movable member that is a detection target such that while the movable member is in a specific position or orientation, light emitted from the light emitting unit is reflected toward the light receiving unit. In this case, the driving units 310-360 each detect that the movable member is in the specific position or orientation, owing to an output from the light receiving unit indicating that the emitted light reaches the light receiving unit.

The conveyance unit 320 especially detects that the leading member 231 and the forcing member 232 are positioned at the respective retraction positions HM1 and HM2, with use of the respective position sensors which are disposed at the retraction positions HM1 and HM2.

—Second Control Unit—

The second control unit 300 is an electronic circuit that is mounted on a single substrate disposed inside the post-processing device 150. Referring to FIG. 7, the second control unit 300 includes a CPU 301, a RAM 302, and a ROM 303. The CPU 301 controls the driving units 310 to 360 in accordance with firmware. The RAM 302 provides the CPU 301 with a work area for the CPU 301 to execute the firmware. The ROM 303 includes a non-rewritable semiconductor memory device, and further includes a rewritable semiconductor memory device such as an EEPROM, or an HDD. The non-rewritable semiconductor memory device stores therein the firmware, and the rewritable semiconductor memory device or the HDD provides the CPU 301 with a storage region for environmental variables.

The second control unit 300 controls, by the CPU 301 executing the firmware, the driving units 310-360 based on a pre-notification of paper ejection and control information transmitted from the first control unit 60 of the MFP 100 and notification transmitted from the driving units 310-360. Specifically, the second control unit 300 interprets the control information, which is transmitted from the first control unit 60, to read information such as the type of post-processing to be performed, the type of sheets that is a target of the post-processing, the size of the sheets, the number of sheets per set, the number of copies, and so on. Further, the second control unit 300 transmits designation of an operation timing to each of the driving units 310 to 360 based on the read information and the pre-notification of paper ejection. In other words, the second control unit 300 transmits designation of a timing for aligning sheets to the alignment unit 310, transmits designation of a timing and a distance for conveying a sheet stack in the FD direction to the conveyance unit 320, transmits designation of a timing and a position for holding the sheet stack to the holding unit 330, transmits designation of a type of a process to be executed and a timing for executing the process to the process unit 340, transmits designation a timing for varying inclination to the first tray 200 to the storage unit 350, and transmits designation of a timing for pushing out the sheet stack from the first tray 200 to the push-out unit 360.

Especially when controlling the leading member 231 and the forcing member 232 to convey a sheet stack, the second control unit 300 adjusts the respective torques of the FD alignment motor and the FD conveyance motor in accordance with weight of the sheet stack which is conveyed such that speed of the sheet stack reaches a predetermined target value, and transmits designation of the adjusted torques to the conveyance unit 320. Here, the second control unit 300 estimates the weight of the sheet stack based on for example the type, the size, the number of sheets per set, which are indicated by the control information.

Further, with use of the notifications transmitted from the driving units 310-360, the second control unit 300 monitors the respective positions and orientations of the movable members, namely, the first tray 200, the first alignment member 221, the alignment member 222, the leading member 231, the forcing member 232, the holding members 241-244, the push-out member 260, and the guide member 280. When moving the leading member 231, which is standing by at the retraction position HM1, for example, the second control unit 300 measures a period elapsed since the second control unit 300 has received notification from the conveyance unit 320, which notifies of that output from the position sensor disposed in the retraction position HM1 indicates that the leading member 231 has departed from the retraction position HM1. In the case where the FD alignment motor is a stepper motor for example, the number of pulses of a driving signal of the steppe motor is used for measuring the elapsed period. In the case where the FD alignment motor includes an encoder for example, the number of rotations of the stepper motor is used for measuring the elapsed period. The second control unit 300 further estimates a movement distance of the leading member 231 from the elapsed period and a standard movement pattern. With respect to each of the other movable members, the second control unit 300A similarly measures a period elapsed since a time when notification from the driving unit which notifies of that output from the position sensor indicates that a particular reaction has been detected. The second control unit 300A estimates, from the elapsed period, a movement distance from a position where the particular reaction has been detected or a variation amount from an orientation at a time when the particular reaction has been detected.

The second control unit 300 detects a paper jam of a sheet stack inside the post-processing device 150 with use of reaction of the sheet rear edge sensors 370A and 370B. Here, the paper jam indicates a general phenomenon that a sheet stack has not been moved yet to a target position at a predetermined timing.

With use of the reaction of the sheet rear edge sensors 370A and 370B, the second control unit 300 especially detects a paper jam of a sheet stack, which is conveyed on the first tray 200 in the FD direction by the leading member 231 and the forcing member 232, and a paper jam of a sheet stack, which is conveyed on the first tray 200 in the CD direction by the push-out member 260. In other words, the second control unit 300 detects delay of the conveyance timing in each of the FD direction and the CD direction. When detecting the paper jam during conveyance in the FD direction or the CD direction, the second control unit 300 controls the conveyance unit 320 and the push-out unit 360 to suspend conveying the sheet stack and then retry to convey the sheet stack. The details of the control on the retrial are described later.

—Sheet Rear Edge Sensors—

The sheet rear edge sensor 370A is an optical sensor that is embedded in the vicinity of the lower end part 200B of the first tray 200 shown in FIGS. 4-6B. The sheet rear edge sensor 370B is an optical sensor that is embedded in the vicinity of the marginal part 200F of the placement surface of the first tray 200 facing the vertical wall 211 shown in FIG. 5. Like the respective position sensors included in the driving units 310-360, the sheet rear edge sensors 370A and 370B each include a light-emitting unit and a light receiving unit, and detect light, which is emitted from the light emitting unit, by the light receiving unit. The light emitting unit and the light receiving unit are disposed such that a sheet stack, which passes through the lower end part 200B and the marginal part 200F of the first tray 200, reflects light emitted from the light emitting unit toward the light receiving unit (or the sheet stack blocks the emitted light from reaching the light receiving unit). The sheet rear edge sensors 370A and 370B each detect that the rear edge of the sheet stack has passed through the lower end part 200B and the marginal part 200F of the first tray 200, based on an output from the light receiving unit indicating that the light emitted from the light emitting unit has been detected and then has become undetected (or the light that has become undetected and then has been detected again). The second control unit 300 is notified of the reactions of the sheet rear edge sensors 370A and 370B.

—Second Communication Unit—

The second communication unit 380 performs wired or wireless communication with the first communication unit 80 (see FIG. 3) included in the MFP 100. In collaboration with the first communication unit 80, the second communication unit 380 relays especially information exchange performed between the first control unit 60 and the second control unit 300.

<Control on Sheet Conveyance Retrial>

Referring again to FIG. 7, the CPU 301 includes a detection unit 304 and a retrial control unit 306. These functional units 304 and 306 are embodied by the CPU 301 reading specific firmware from the ROM 303 and executing the read firmware. The detection unit 304 monitors a sheet stack, which is conveyed by the leading member 231 and the forcing member 232, and the sheet stack, which is pushed out by the push-out member 260, and detects a paper jam while the sheet stack is conveyed in the FD direction or the CD direction. In the case where a paper jam in the FD direction is detected by the detection unit 304, the retrial control unit 306 controls the conveyance unit 320 to retry to convey the sheet stack. In the case where the paper jam in the CD direction is detected, the retrial control unit 306 controls the push-out unit 360 to retry to convey the sheet stack.

—Detection Unit—

(1) Detection of Paper Jam During Conveyance in FD Direction

First, the detection unit 304 sets a threshold value for detecting a paper jam. This threshold value indicates a period necessary for the leading member 231 and the forcing member 232 to increase speed of a sheet stack with standard weight to a target speed and convey a sheet from the lateral surface 207 of the lower end part of the housing 202 to the lower end part 200B of the first tray 200.

Next, the detection unit 304 monitors output from the sheet rear edge sensor 370A since a time when the forcing member 232 has started moving from the retraction position HM2, and measures a period elapsed since the time. In the case where the sheet rear edge sensor 370A does not react even after the elapsed period reaches the threshold value, the detection unit 304 judges that a paper jam has occurred during conveyance of the sheet stack in the FD direction, and starts up the retrial control unit 306.

(2) Detection of Paper Jam During Conveyance in CD Direction

First, the detection unit 304 sets a threshold value for detecting a paper jam, in the same manner as in the case (1). This threshold value indicates a period necessary for the push-out member 260 to convey a sheet stack from a predetermined standby position (a default position described later) to the marginal part 200F of the first tray 200.

Next, the detection unit 304 monitors output from the sheet rear edge sensor 370B since a time when the push-out member 260 has started moving from the standby position, and measures a period elapsed since the time. In the case where the sheet rear edge sensor 370B does not react even after the elapsed period reaches the threshold value, the detection unit 304 judges that a paper jam has occurred during conveyance of the sheet stack in the CD direction, and starts up the retrial control unit 306.

—Retrial Control Unit—

When the detection unit 304 detects a paper jam, the retrial control unit 306 performs retrial preparation processing shown below.

When the detection unit 304 detects a paper jam in the FD direction, the retrial control unit 306 first controls the conveyance unit 320 to suspend a conveyance operation of a sheet stack, and move the leading member 231 from a position at a time when the paper jam has been detected (hereinafter, referred to as a position at the paper jam detection time) to the retraction position HM1 at a predetermined movement speed. Also, the retrial control unit 306 measures a period elapsed until the leading member 231 moves to the retraction position HM1, and calculates a movement distance of the leading member 231 from the retraction position HM1 to the position at the paper jam detection time based on a measurement result. Then, the retrial control unit 306 controls the conveyance unit 320 to move the leading member 231 by the movement distance calculated from the retraction position HM1, retract the leading member 231 to the position at the paper jam detection time, and grip the front edge of the sheet stack by the gripping claw 231A.

Next, the retrial control unit 306 controls the conveyance unit 320 to move the forcing member 232 from a position at the paper jam detection time to the retraction position HM2 at a predetermined movement speed. Also, the retrial control unit 306 measures a period elapsed until the forcing member 232 moves to the retraction position HM2, and calculates a movement distance of the forcing member 232 from the retraction position HM2 to the position at the paper jam detection time based on a measurement result. Then, the retrial control unit 306 controls the conveyance unit 320 to move the forcing member 232 by the movement distance calculated from the retraction position HM2, and retract the forcing member 232 to the position at the paper jam detection time. Note that the above processing may be performed on the forcing member 232 prior to the leading member 231.

In the case where conveyance is determined to be retried in retrial control processing, which is described later, after the retrial preparation processing, the retrial control unit 306 controls the conveyance unit 320 to retry to convey the sheet stack in the FD direction from the position at the paper jam detection time.

When the detection unit 304 detects a paper jam in the CD direction, the retrial control unit 306 first controls the push-out unit 360 to suspend push-out operation of a sheet stack, and move the push-out member 260 from a position at a paper jam detection time to a retraction position (the one of the marginal parts of the placement surface of the first tray 200 in the CD direction (the Y-axis direction) shown in FIG. 4 (the marginal part on the side where the process unit 250 is positioned)) at a predetermined movement speed. Also, the retrial control unit 306 measures a period elapsed until the push-out member 260 moves to the retraction position, and calculates a movement distance of the push-out member 260 from the retraction position to the position at the paper jam detection time based on a measurement result. Then, the retrial control unit 306 controls the push-out unit 360 to move the push-out member 260 from the retraction position by the calculated movement distance.

In the case where conveyance is determined to be retried in retrial control processing, which is described later, after the retrial preparation processing, the retrial control unit 306 controls the push-out unit 360 to retry to convey the sheet stack in the CD direction from the position at a paper jam detection time.

<Operations of Post-Processing Device in Normal State>

FIGS. 8-16 are figures showing operations of post-processing performed by the post-processing device 150 on sheets ejected from the MFP 100, in order of procedures. The following explains the operations of the post-processing device 150 in ascending order of these figure numbers.

—Alignment Operation—

When one set of a sheet stack is ejected from the MFP 100 to the post-processing device 150, the first control unit 60 included in the MFP 100 pre-notifies the second control unit 300 included in the post-processing device 150 of paper ejection to be performed. In accordance with the pre-notification, the second control unit 300 first controls the alignment unit 310 to move the alignment members 221 and 222 and the push-out member 260 to respective predetermined positions (hereinafter, referred to as default positions) before a beginning sheet included in the set starts to be ejected, and cause the alignment members 221 and 222 and the push-out member 260 to stand by on the respective default positions.

Specifically, the second control unit 300 first acquires control information relevant to post-processing to be performed on the sheet stack from the first control unit 60, and reads size and orientation of sheets of the sheet stack from the control information. The orientation of a sheet indicates whether a short side of the sheet is parallel to the FD direction (landscape) or perpendicular to the FD direction (portrait). Then, the second control unit 300 calculates respective default positions of the leading member 231, the alignment members 221 and 222, and the push-out member 260 based on the read control information, and transmits designation of the calculated default positions to the alignment unit 310. The default position of the leading member 231 is determined, such that a distance from the default position to the lateral surface 207 of the lower end part of the housing 202 coincides with the size of the sheet in the FD direction. On the other hand, the respective default positions of the alignment members 221 and 222 and the push-out member 260 are determined, such that a distance between the alignment members 221 and 222 and a distance between the push-out member 260 and the alignment member 222 each coincide with the size of the sheet in the CD direction and such that a corner of the sheet is aligned at the same position of the process units 250 and 251 in the CD direction. The alignment unit 310 sets respective driving periods of the FD alignment motor and the CD alignment motor (specifically, the number of pulses of a driving signal, the number of rotations, or the like of each of the alignment motors) based on the default positions. As a result of driving of the alignment motors in accordance with the respective set driving periods, the alignment members 221 and 222 and the push-out member move to the respective default positions and stand by at the respective default positions before start of paper ejection, which is pre-notified.

The first control unit 60 pre-notifies the second control unit 300 of a timing at which each sheet is ejected from the MFP 100. Each time the second control unit 300 receives a pre-notification, the second control unit 300 controls the alignment unit 310 to move the alignment members 221 and 222 and the push-out member 260 little by little in accordance with the pre-notified timing to align sheet stack which is ejected.

Figure 8:
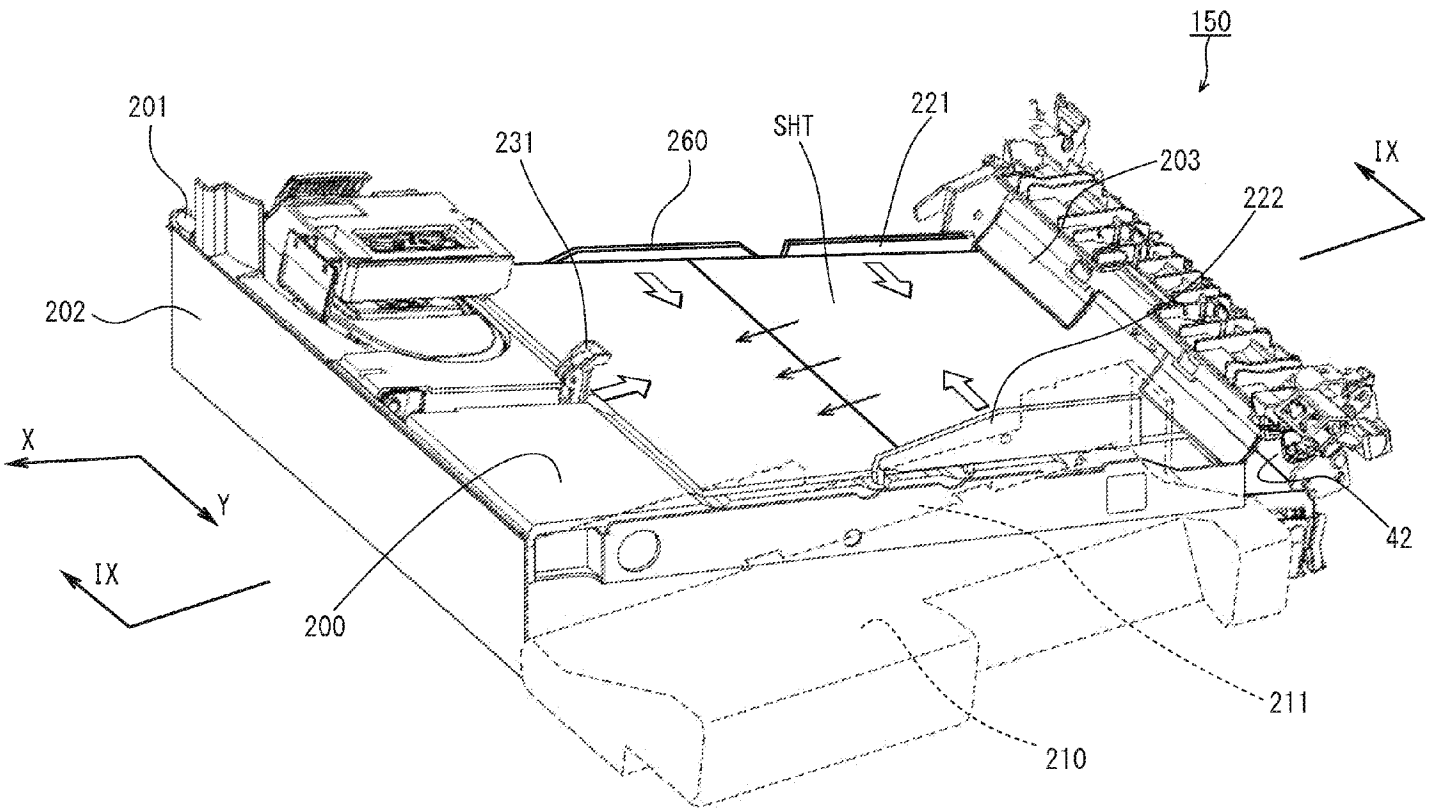
FIG. 8 is a perspective view of the external appearance of the post-processing device in the state where a sheet stack that is ejected from the image forming apparatus is aligned in the first tray shown in FIG. 4.

FIG. 8 is a perspective view of the external appearance of the post-processing device 150 in the state where a sheet stack that is ejected from the MFP 100 is aligned in the first tray 200. Referring to FIG. 8, a sheet SHT, which is ejected through the paper ejection outlet 42 of the MFP 100, moves downward immediately outside the paper ejection outlet 42 by the paper ejection guide plate 203, and further moves along the placement surface of the first tray 200. The sheet SHT moves by a rotational force of the pair of paper ejection rollers 43 (see FIG. 2). The pair of paper ejection rollers 43 continue to rotate to move the sheet SHT until the rear edge of the sheet SHT passes through the pair of paper ejection rollers 43.

Here, the second control unit 300 controls the alignment unit 310 to slightly move the alignment members 221 and 222 and the push-out member 260 from the respective default positions toward the margin of the placement surface of the first tray 200 in the CD direction (the Y-axis direction), and slightly moves the leading member 231 from the default position to the edge of the placement surface in the FD direction (the X-axis direction). As a result, a region on the placement surface that is surrounded by the alignment members 221 and 222, the push-out member 260, and the leading member 231 is enlarged so as to have an area that is slightly larger than an area of the sheet SHT. The sheet SHT enters the enlarged region.

Figure 9:
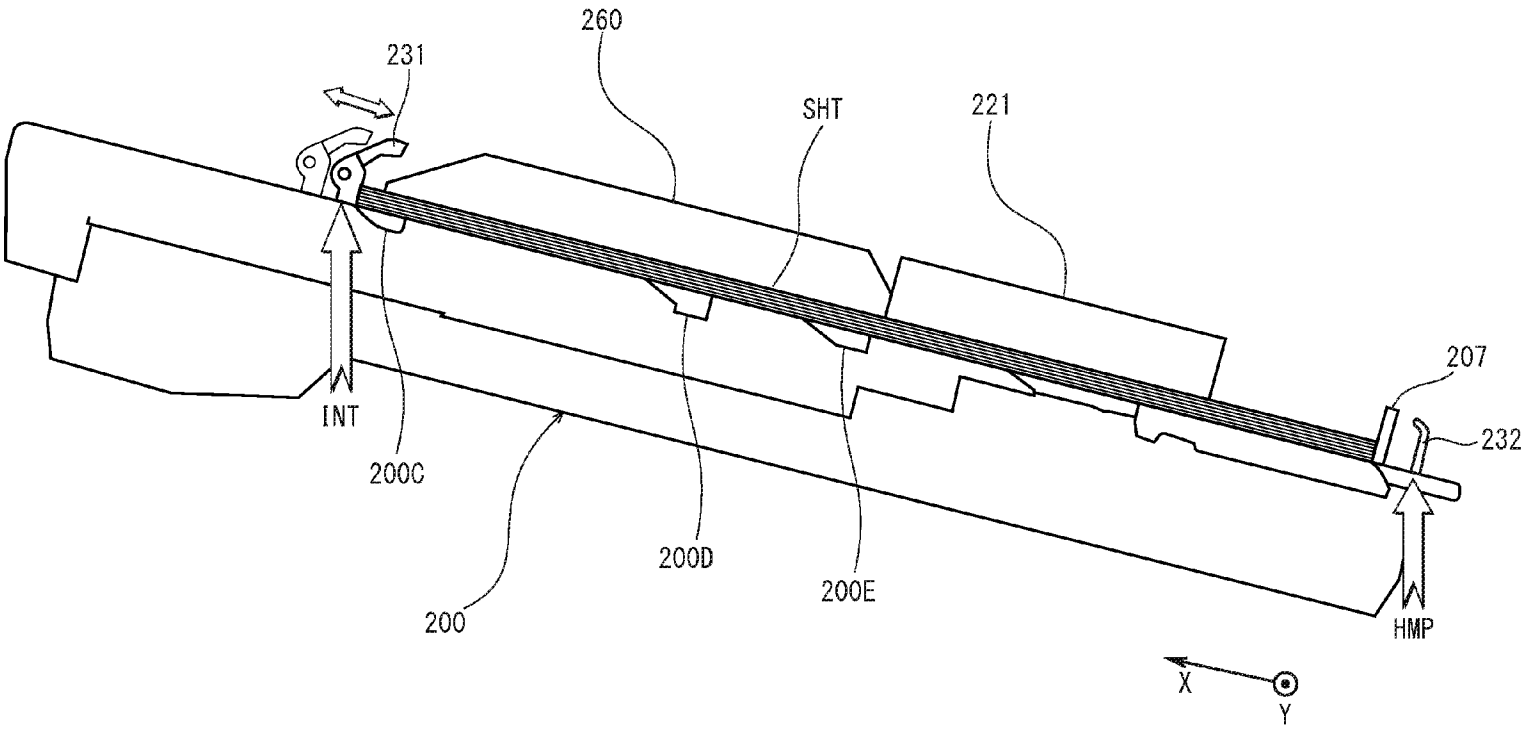
FIG. 9 is a cross-sectional view taken along a line IX-IX in FIG. 8.

FIG. 9 is a cross-sectional view taken along a line IX-IX in FIG. 8. First, the second control unit 300 controls the alignment unit 310 to move the leading member 231 toward the inside of the placement surface of the first tray 200 to arrive at a default position INT, in accordance with a timing at which the entire sheet SHT is completely ejected to the outside of the paper ejection outlet 42. As a result, the sheet SHT contacts the leading member 231, and moves downward in the inclination direction due to impact of the contact and the inclination of the placement surface. Then, the upper edge of the sheet SHT in the inclination direction is held down by the leading member 231, which is positioned at the default position INT, and the lower end of the sheet SHT in the inclination direction is brought into contact with the lateral surface 207 of the lower end part of the housing 202. While being in this state, the sheet SHT stands still. In this way, the sheet SHT is aligned in the FD direction.

Next, the second control unit 300 controls the alignment unit 310 to move the alignment members 221 and 222 and the push-out member 260 toward the inside of the placement surface to the respective default positions. As a result, as shown in FIG. 8, the sheet SHT is sandwiched between each of the alignment member 221 and the push-out member 260 and the alignment member 222, which are positioned at the respective default positions, from the both sides in the CD direction. In this way, the sheet SHT is aligned in the CD direction in addition to the FD direction.

Each time a new sheet is ejected, movement of the alignment members 221 and 222 and the push-out member 260 is repeated. As a result, the entire sheet stack stored in the first tray 200 is aligned in both the FD direction and the CD direction.

—Conveyance Operation in FD Direction—

The control information, which is acquired from the first control unit 60, defines the number of sheets per set on which post-processing should be performed. When detecting that the defined number of sheets are stored in the first tray 200, the second control unit 300 controls the conveyance unit 320 to start moving the leading member 231 and the forcing member 232.

Figure 10:
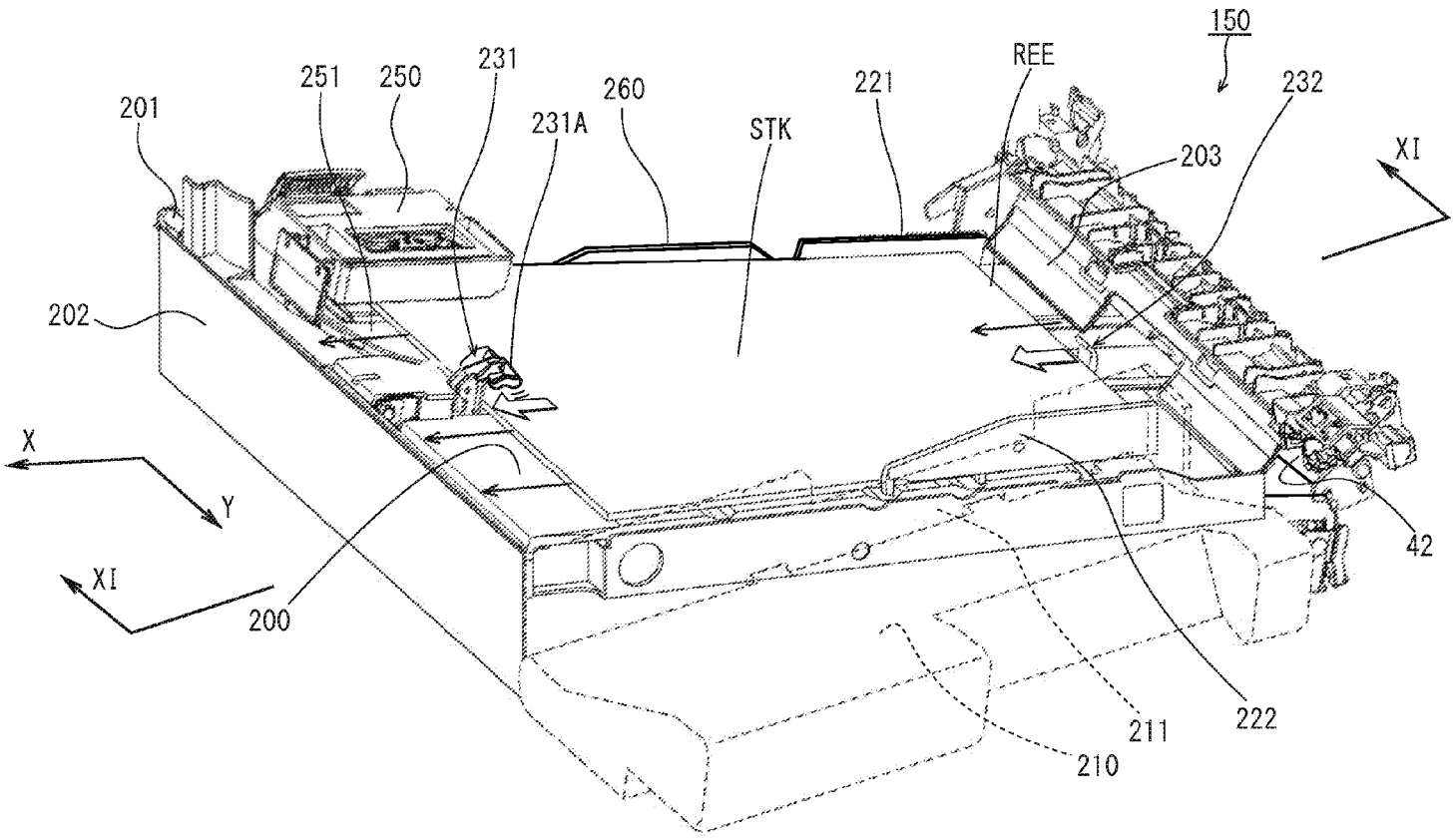
FIG. 10 is a perspective view of the external appearance of the post-processing device in the state where an aligned sheet stack is conveyed to a position of a stapler in the first tray shown in FIG. 4.
Figure 11A:
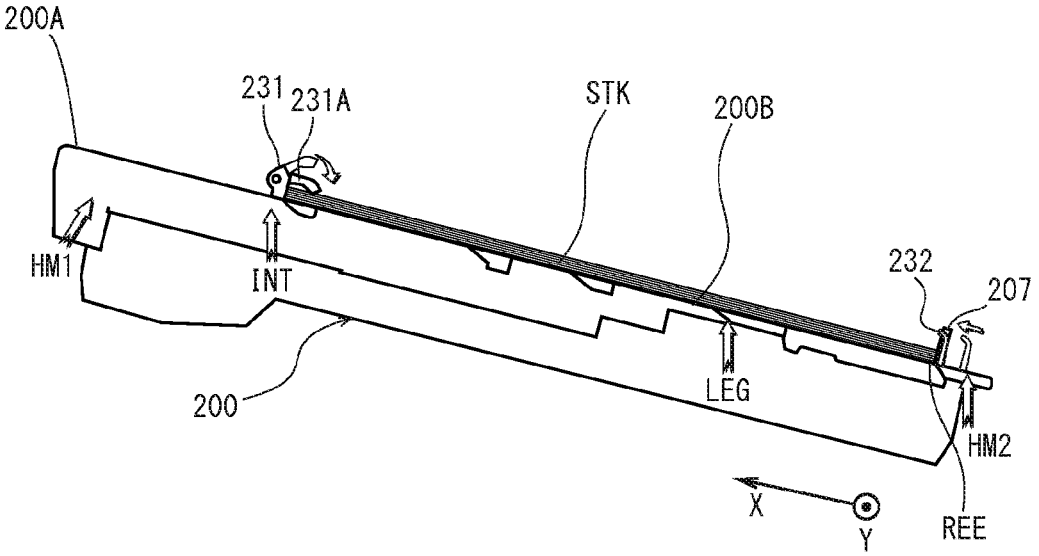
FIG. 11A is a cross-sectional view taken along a line XI-XI in FIG. 10 showing the state at a start time of conveyance.
Figure 11B:
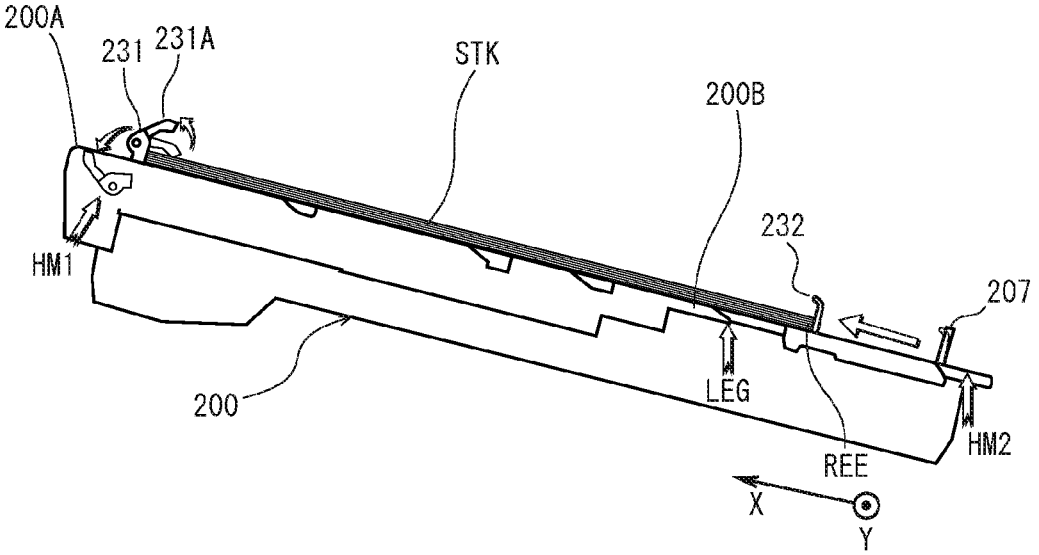
FIG. 11B is a cross-sectional view taken along the line XI-XI in FIG. 10 showing the state during the conveyance.

FIG. 10 is a perspective view of the external appearance of the post-processing device 150 in the state where an aligned sheet stack is conveyed in the FD direction. FIGS. 11A and 11B are cross-sectional views taken along a line XI-XI in FIG. 10. Specifically, FIG. 11A shows the state at a start time of conveyance, and FIG. 11B shows the state during the conveyance.

Referring to FIGS. 10 and 11A, the second control unit 300 controls the alignment unit 310 to keep a sheet stack STK to be held from the both sides in the CD direction by the alignment members 221 and 222 and the push-out member 260. On the other hand, the second control unit 300 controls the conveyance unit 320 to move forward the forcing member 232 from the retraction position HM2 in the FD direction (the positive direction on the X-axis) while controlling the conveyance unit 320 to keep the front edge of the sheet stack STK held down by the leading member 231. In conjunction with this, the gripping claw 231A of the leading member 231 is brought down to push down the front edge of the sheet stack STK onto the placement surface of the first tray 200 from above. When the forcing member 232 arrives at the lateral surface 207 of the lower end part of the housing 202, the second control unit 300 controls the conveyance unit 320 to move the leading member 231 in the FD direction (the positive direction on the X-axis) at the same speed of the forcing member 232.

Referring to FIGS. 10 and 11B, the sheet stack STK is pulled up by the leading member 231 from the upper side in the FD direction, and is pushed up by the forcing member 232 from the lower side. In this way, the sheet stack STK is conveyed on the placement surface of the first tray 200 upward in the inclination direction while being sandwiched between the leading member 231 and the forcing member 232.

In the case where the control information, which is acquired from the first control unit 60, requests to perform a staple process of stapling the sheet stack STK by a stapler, the second control unit 300 controls the conveyance unit 320 to continue to move the leading member 231 and the forcing member 232 until a corner of the sheet stack STK arrives at a region between the clincher 250 and the stapler 251. Specifically, the second control unit 300 reads the size of sheets included in the sheet stack STK and whether the sheets are landscape or portrait from the control information, calculates respective movement distances necessary for the leading member 231 and the forcing member 232 to cause the corner of the sheet stack STK to arrive at a target region, and transmits designation of the calculated movement distances to the conveyance unit 320. The conveyance unit 320 determines respective driving periods (specifically, the number of pulses of a driving signal, the number of rotations, or the like of each of the alignment motors) of the FD alignment motor and the FD conveyance motor based on the movement distances. As shown in FIG. 10, when the corner of the sheet stack STK arrives at the region between the clincher 250 and the stapler 251, the second control unit 300 controls the conveyance unit 320 to hold the sheet stack STK in the region by the leading member 231 and the forcing member 232. The second control unit 300 controls the process unit 340 to drive the clincher 250 and the stapler 251 to staple the sheet stack STK.

Then, the second control unit 300 controls the conveyance unit 320 to restart moving the leading member 231 and the forcing member 232. As shown in FIG. 11B, when arriving at the upper end part 200A of the first tray 200, the leading member 231 turns up the gripping claw 231A, and then moves the gripping claw 231A into the groove 208 of the first tray 200, that is, to the retraction position HM1. On the other hand, the forcing member 232 continues to push the sheet stack STK in the FD direction (the positive direction on the X-axis). In this way, the sheet stack STK is conveyed to a position where the front edge crosses over the retraction position HM1 of the leading member 231 and the rear edge is placed on the placement surface of the first tray 200.

Figure 12:
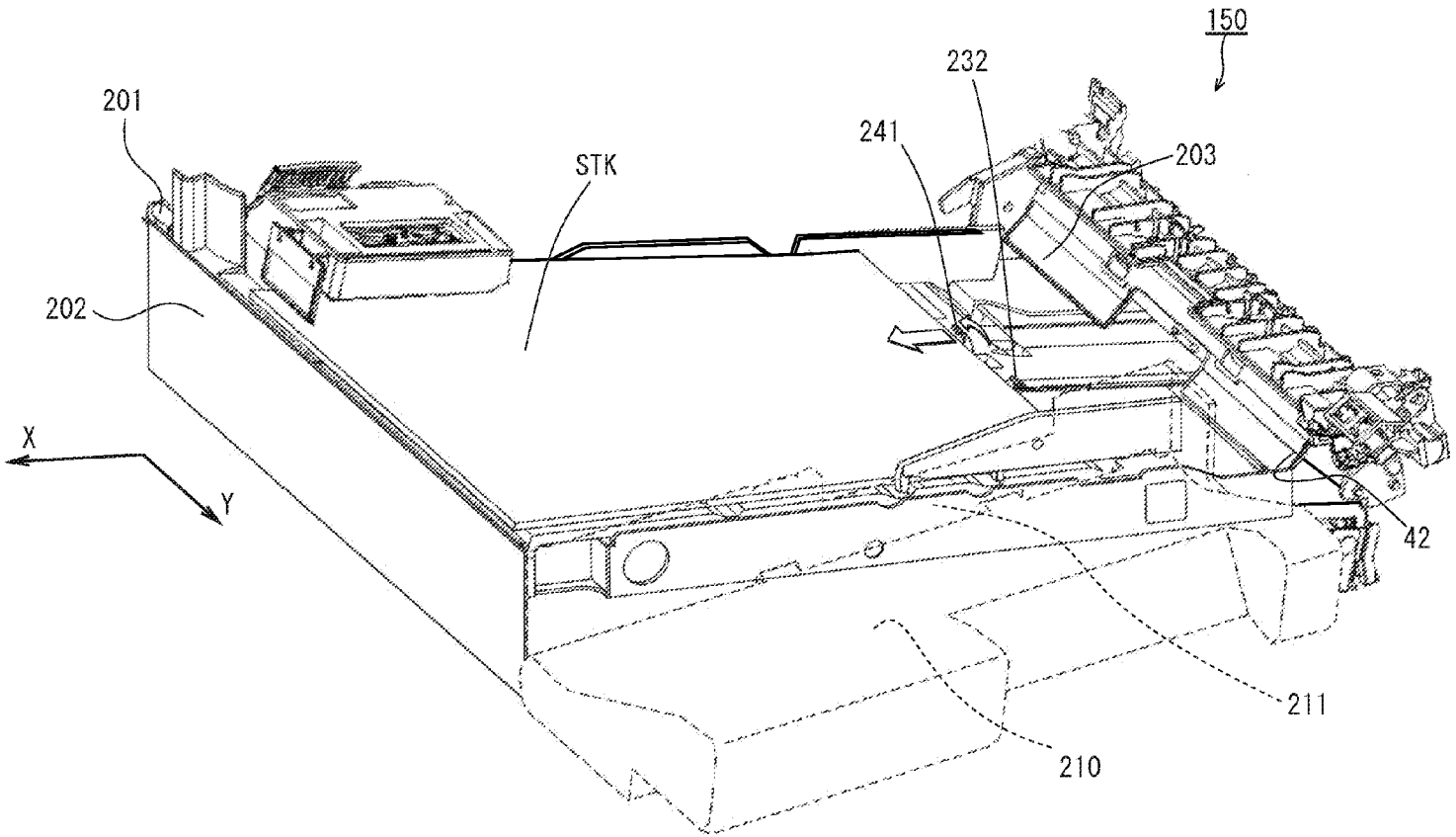
FIG. 12 is a perspective view of the external appearance of the post-processing device in the state where the entire sheet stack that is stapled by the stapler is placed on the placement surface of the first tray shown in FIG. 4.

FIG. 12 is a perspective view of the external appearance of the post-processing device 150 in the state where the entire sheet stack STK, which is stapled by the stapler 251, is placed on the placement surface of the first tray 200. Referring to FIG. 12, when the entire sheet stack STK is placed on the placement surface, the second control unit 300 controls the holding unit 330 to protrude the pair of first holding members 241 and 242 or the pair of second holding members 243 and 244 (see FIGS. 4-6B) from the placement surface. As a result, the sheet stack STK is stably held on the placement surface irrespective of inclination of the placement surface. In the case where the control information, which is acquired from the first control unit 60, requests to sort sheets, the second control unit 300 alternately switches a pair of holding members to be projected for each sheet stack STK. As a result, the position of the sheet stack STK in the inclination direction switches up and down for each sheet stack.

—Push-Out Operation from First Tray to Second Tray—

When the entire sheet stack STK is placed on the placement surface of the first tray 200 as shown in FIG. 12, the forcing member 232 enters the range PRV shown in FIG. 6B. Accordingly, the upper surface of the guide member 280 pivots and inclines with respect to the FD direction. Here, the second control unit 300 controls the storage unit 350 to pivot the first tray 200 about the support shaft 201 to cause the placement surface of the first tray 200 to be horizontal, while controlling the holding unit 330 to keep protruding the pair of first holding members 241 and 242 or the pair of second holding members 243 and 244.

Figure 13:
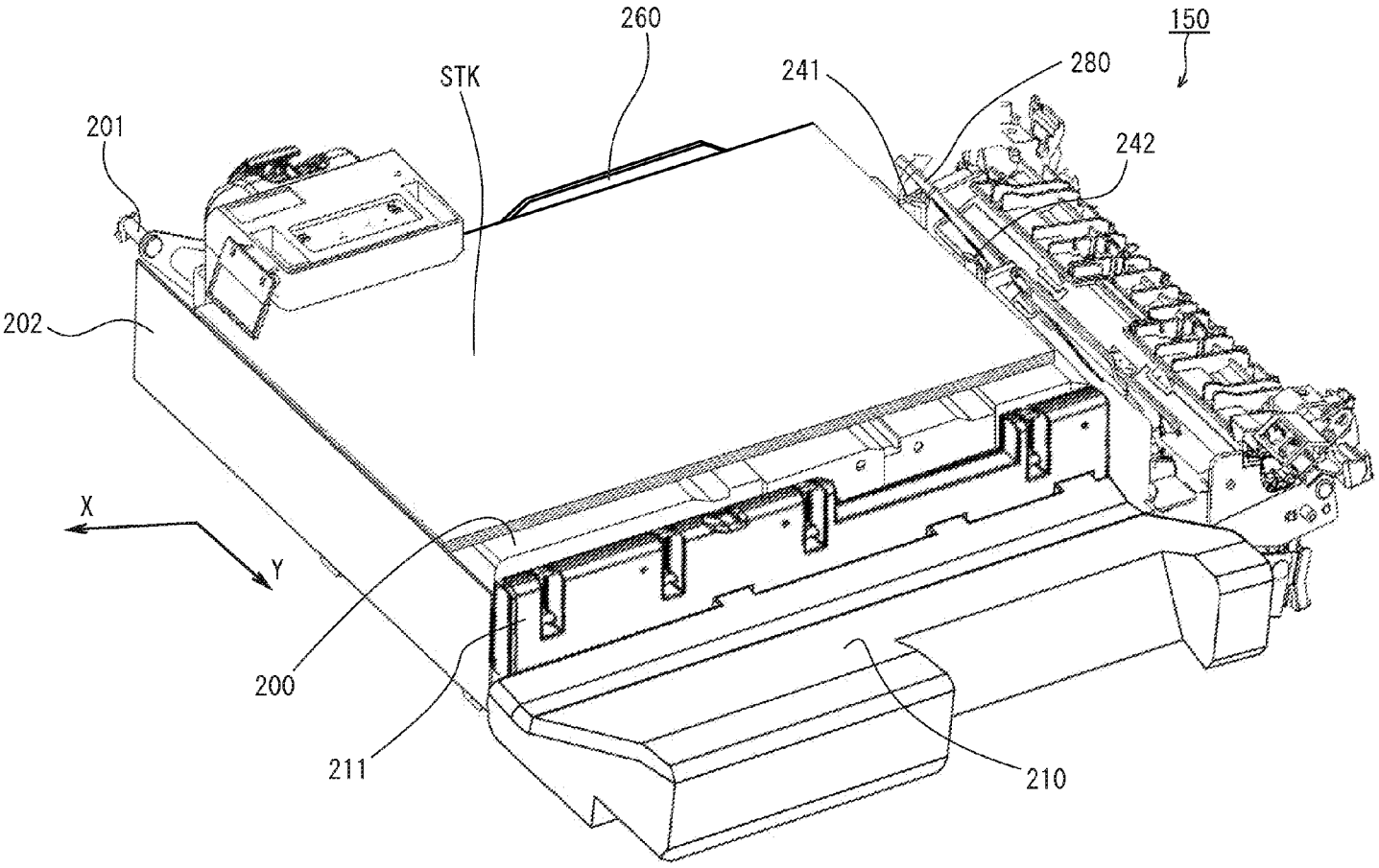
FIG. 13 is a perspective view of the external appearance of the post-processing device in the state where the first tray shown in FIG. 4 causes the placement surface to be horizontal while a sheet stack is placed on the placement surface.

FIG. 13 is a perspective view of the external appearance of the post-processing device 150 in the state where the first tray 200 causes the placement surface to be horizontal while the sheet stack STK is placed on the placement surface. Referring to FIG. 13, the upper surface of the guide member 280 is inclined with respect to the FD direction (the X-axis direction). The second control unit 300 controls the conveyance unit 320 to keep the forcing member 232 in the range PRV shown in FIG. 6B while controlling the storage unit 350 to keep the placement surface of the first tray 200 horizontal. As a result, the upper surface of the guide member 280 is kept inclined. Accordingly, when a new sheet is ejected through the paper ejection outlet 42, the upper surface of the guide member 280 prevents the new sheet from intruding into the lower part of the first tray 200.

Figure 14:
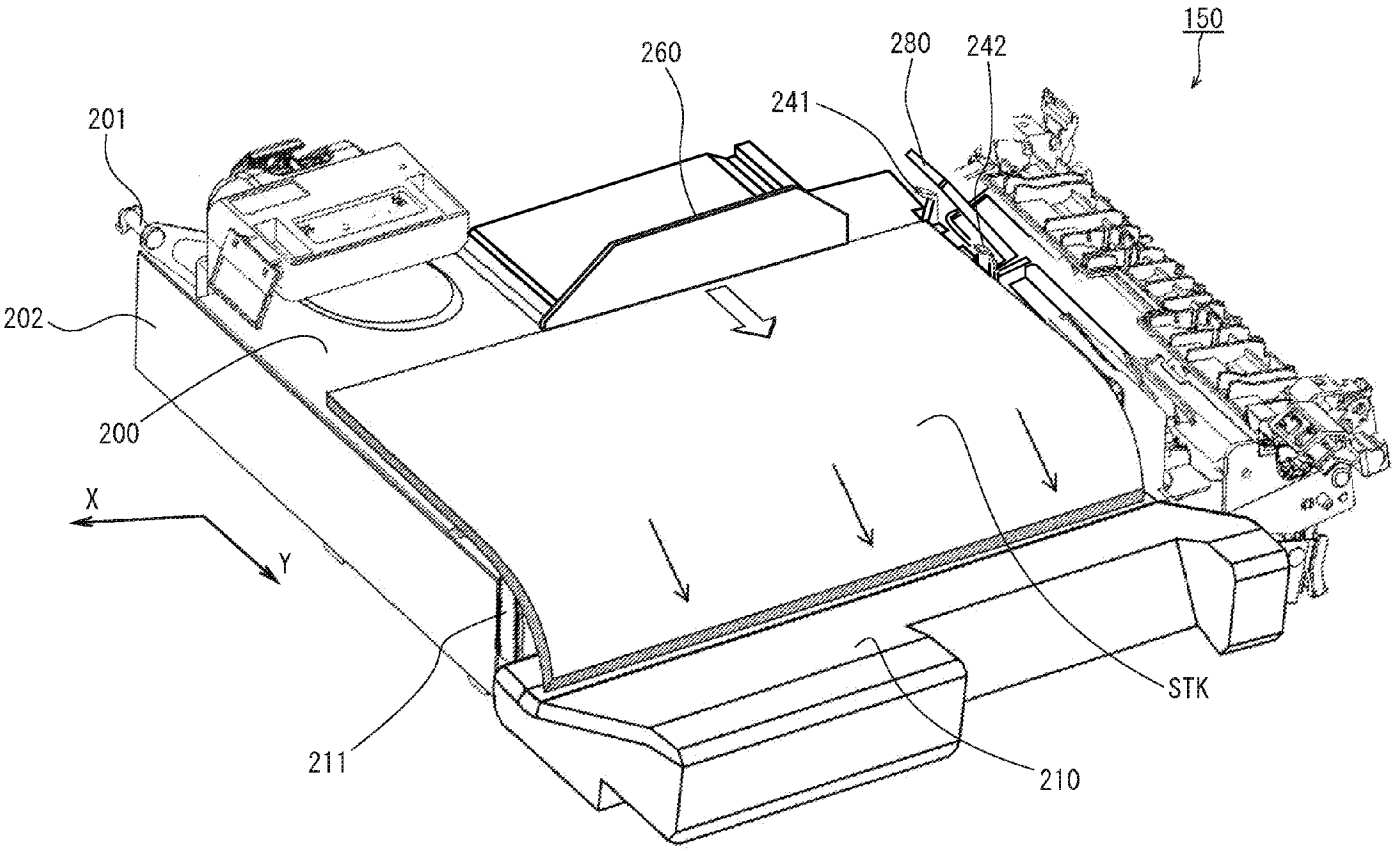
FIG. 14 is a perspective view of the external appearance of the post-processing device in the state where, in the first tray shown in FIG. 4, a push-out member pushes out a sheet stack to the second tray.

FIG. 14 is a perspective view of the external appearance of the post-processing device 150 in the state where the push-out member 260 pushes out and ejects the sheet stack STK from the first tray 200 to the second tray 210. Referring to FIG. 14, the second control unit 300 controls the push-out unit 360 to advance the push-out member 260 toward the second tray 210 together with the sheet stack STK, while controlling the holding unit 330 to keep protruding the pair of first holding members 241 and 242 or the pair of second holding members 243 and 244 and controlling the storage unit 350 to keep the placement surface of the first tray 200 horizontal. Here, since the placement surface is higher than the upper end of the vertical wall 211, the sheet stack STK, which is pushed by the push-out member 260, moves to the second tray 210 across the vertical wall 211.

Figure 15:
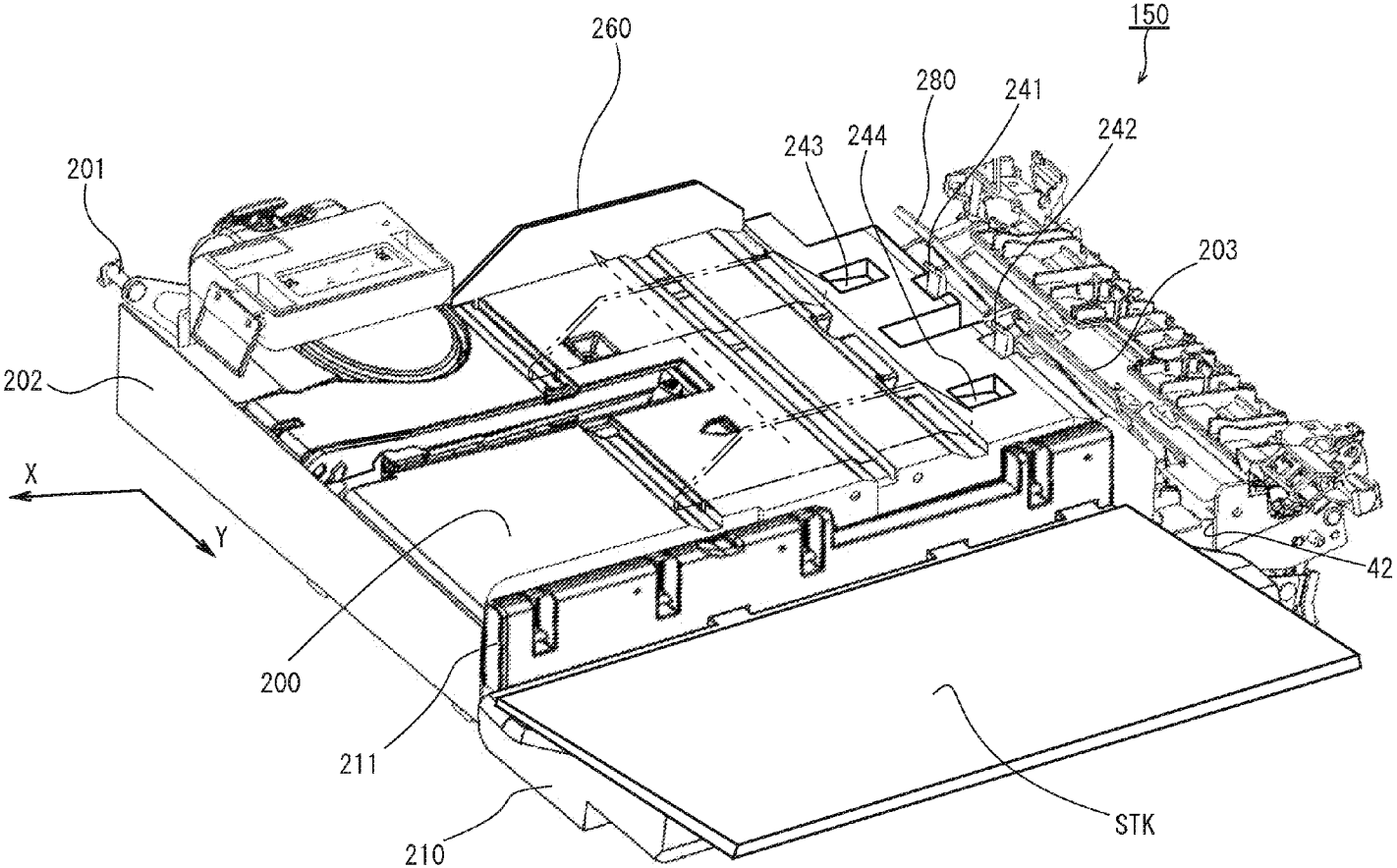
FIG. 15 is a perspective view of the external appearance of the post-processing device in the state where the push-out member retracts in the first tray shown in FIG. 4.

FIG. 15 is a perspective view of the external appearance of the post-processing device 150 in the state where the push-out member 260 retracts from the placement surface of the first tray 200. Referring to FIG. 15, the second control unit 300 controls the push-out unit 360 to advance the push-out member 260 to the margin of the placement surface of the first tray 200 facing the vertical wall 211, and then cause the push-out member 260 to recede to the margin on the opposite side.

Further referring to FIG. 15, since the placement surface of the second tray 210 is inclined, the sheet stack STK, which is pushed out and ejected to the second tray 210, is aligned at a position where the lower edge thereof in the inclination direction contacts the vertical wall 211. Here, the sheet stack, which is held by the pair of first holding members 241 and 242, differs from the sheet stack, which is held by or the pair of second holding members 243 and 244, in terms of position in the FD direction on the first tray 200. Accordingly, these sheet stacks differ from each other in terms of load position on the second tray 210 in a direction parallel to the vertical wall 211. In this way, sheets are sorted into stacks.

—Restoration Operation of First Tray to Default Position—

Figure 16:
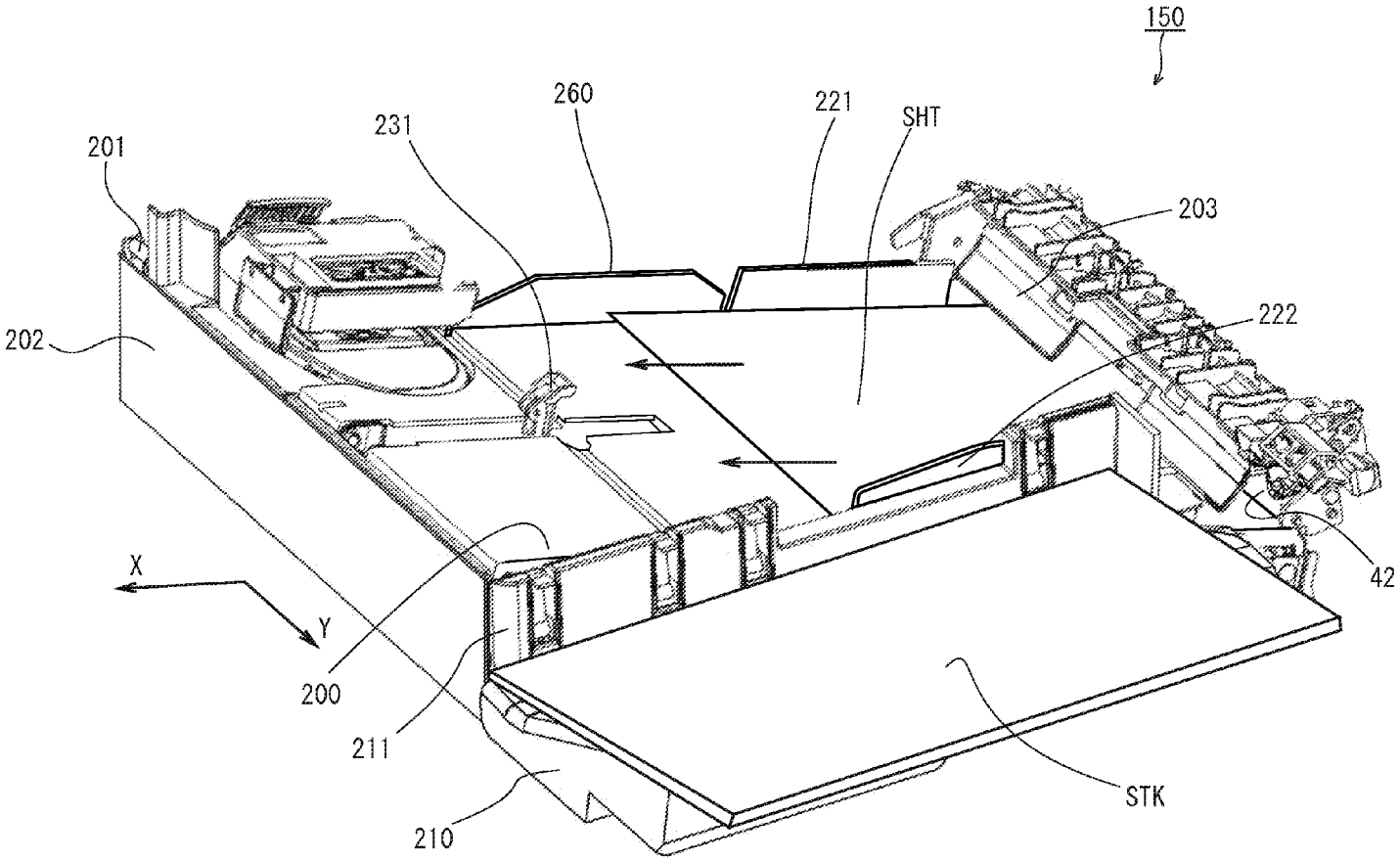
FIG. 16 is a perspective view of the external appearance of the post-processing device in the state where the placement surface of the first tray shown in FIG. 4 restores to a default inclined orientation.

FIG. 16 is a perspective view of the external appearance of the post-processing device 150 in the state where the placement surface of the first tray 200 restores to the default inclined orientation. Referring to FIG. 16, after the push-out member 260 recedes to the margin of the placement surface of the first tray 200, the second control unit 300 controls the storage unit 350 to pivot the first tray 200 about the support shaft 201 to restore the placement surface from the horizontal direction to the default position shown in FIG. 8. In parallel to the restoration operation, the second control unit 300 controls the conveyance unit 320 to move the forcing member 232 to the retraction position HM2 as shown in FIG. 6B. As a result, since the forcing member 232 departs from the range PRV shown in FIG. 6B, the upper surface of the guide member 280 pivots to be parallel to the FD direction, and coincides with the extension part of the placement surface of the first tray 200. Then, the second control unit 300 receives a pre-notification of ejection of a new sheet SHT from the first control unit 60 included in the MFP 100, and controls the alignment unit 310 to repeatedly perform the operations shown in FIG. 8 in accordance with the received pre-notification.

The second control unit 300 controls the driving units 310-360 to perform the operations shown in FIGS. 8-16 the same number of times as the number of target copies of a print job designated by the first control unit 60. In this way, the post-processing device 150 performs post-processing on sheets, which are ejected from the MFP 100 and stored in the first tray 200, for each sheet stack, and pushes the sheet stacks out from the first tray 200 to be loaded on the second tray 210.

[Operations in Detection of Paper Jam]

While the sheet stack STK is conveyed on the first tray 200 in the FD direction (the X-axis direction) as shown in FIGS. 10-11B, the detection unit 304 included in the second control unit 300 monitors output from the sheet rear edge sensor 370A (see FIG. 7, and not shown in FIGS. 10-11B). The sheet rear edge sensor 370A reacts when a rear edge REE of the sheet stack STK passes through a lower end LEG of the placement surface of the first tray 200. In the case where the sheet rear edge sensor 370 does not react even after a period elapsed since the forcing member 232 has left the retraction position HM2 reaches the threshold value, that is, in the case where the rear edge REE has not yet arrived at the lower end LEG of the placement surface, the detection unit 304 judges that a paper jam has occurred, and starts up the retrial control unit 306.

Further, while the sheet stack STK is conveyed on the first tray 200 in the CD direction (the Y-axis direction) as shown in FIG. 14, the detection unit 304 included in the second control unit 300 monitors output from the sheet rear edge sensor 370B (see FIG. 7, and not shown in FIG. 14). The sheet rear edge sensor 370B reacts when the rear edge REE of the sheet stack STK passes through the marginal part 200F of the first tray 200. In the case where the sheet rear edge sensor 370B does not react even after a period elapsed since the forcing member 260 has left the retraction position reaches the threshold value, that is, in the case where the rear edge REE has not yet arrived at the marginal part 200F of the placement surface, the detection unit 304 judges that a paper jam has occurred, and starts up the retrial control unit 306.

—Flow Chart of Operations Performed by Post-Processing Device—

Figure 17:
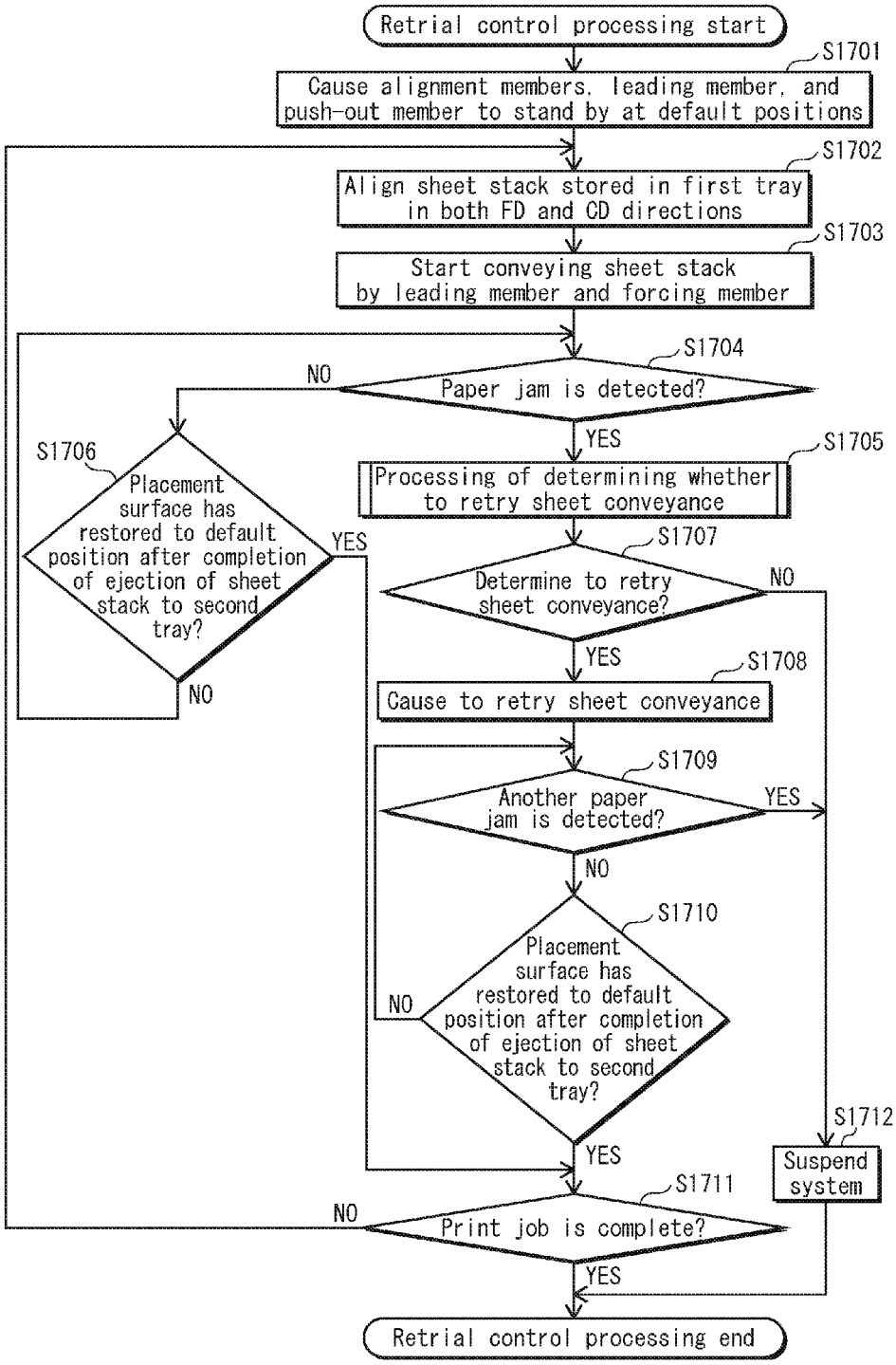
FIG. 17 is a flow chart of operations of retrial control processing performed in the case where operations of post-processing are performed.

FIG. 17 is a flow chart of operations of retrial control processing performed in the case where the post-processing shown in FIGS. 8-16 is performed. The retrial control processing is started when the second control unit 300 included in the post-processing device 150 is notified of start of a print job by the first control unit 60 included in the MFP 100.

In Step S1701, the second control unit 300 first acquires control information relevant to post-processing from the first control unit 60, and reads size and orientation of sheets of one set of a sheet stack from the control information. Next, the second control unit 300 calculates respective default positions of the alignment members 221 and 222, the leading member 231, and the push-out member 260, and controls the alignment unit 310 to cause the members 221, 222, 231, and 260 to stand by at the respective default positions before a beginning sheet is ejected. Then, the processing proceeds to Step S1702.

In Step S1702, processing relevant to a sheet alignment operation shown in FIGS. 8 and 9 is performed. Specifically, in accordance with pre-notification of paper ejection transmitted from the first control unit 60, before start of ejection of the sheet through the paper ejection outlet 42 of the MFP 100, the second control unit 300 controls the alignment unit 310 to bring the alignment members 221 and 222, the leading member 231, and the push-out member 260 from the respective default positions toward the margin in the CD direction (the Y-axis direction) and the margin in the FD direction (the X-axis direction) of the placement surface of the first tray 200. When the entire sheet is completely ejected to the outside of the paper ejection outlet 42, the second control unit 300 first controls the alignment unit 310 to move the leading member 231 toward the inside of the placement surface, and then move the alignment members 221 and 222 and the push-out member 260 toward the inside of the placement surface. As a result, the sheet is aligned by being sandwiched between these members. Then, the alignment unit 310 restores the members 221, 222, 231, and 260 to the respective original positions (the default positions). Each time a new sheet is ejected, the above operations are repeatedly performed by these members. In this way, the one set of a sheet stack stored in the first tray 200 is aligned in both the FD direction and the CD direction. Then, the processing proceeds to Step S1703.

In Step S1703, the second control unit 300 controls the conveyance unit 320 to move the leading member 231 and the forcing member 232 and start conveying the sheet stack, while controlling the alignment unit 310 to hold the aligned sheet stack by the alignment members 221 and 222 and the push-out member 260. Then, the processing proceeds to Step S1704.

In Step S1704, the second control unit 300 detects whether a paper jam has occurred in the sheet stack which is started being conveyed in Step S1703, by monitoring output from the sheet rear edge sensors 370A and 370B, while the following processing is subsequently performed on the sheet stack, which is started being conveyed in Step S1703: processing relevant to conveyance of the sheet stack shown in FIGS. 10-12 in the FD direction; and processing relevant to a push-out operation of the sheet stack from the first tray 200 to the second tray 210 shown in FIGS. 13-15 (processing relevant to conveyance of the sheet stack in the CD direction). When detecting the paper jam (Step S1704: YES), the second control unit 300 performs retrial preparation processing and then proceeds to Step S1705. When not detecting the paper jam (Step S1704: NO), the second control unit 300 proceeds to Step S1706.

In Step S1705, the second control unit 300 performs processing of determining whether to retry to convey the sheet stack in which the paper jam is detected. The processing of determining whether to retry sheet conveyance is described later.

In Step S1706, the second control unit 300 judges whether the placement surface has restored to the default position (the default position shown in FIG. 8) as a result of pivot of the first tray 200 about the support shaft 201 after completion of ejection of the sheet stack, which is started being conveyed in Step S1703, is complete.

When judging affirmatively in Step S1706 (Step S1706: YES), the second control unit 300 judges whether the print job is complete. When judging that the print job is complete (Step S1711: YES), the second control unit 300 ends the processing. When determining that the print job is not complete (Step S1711: NO), the second control unit 300 proceeds to Step S1702. When determining negatively in Step S1706 (Step S1706: NO), the second control unit 300 proceeds to Step S1704.

When determining to retry sheet conveyance in the processing of determining whether to retry sheet conveyance in Step S1705 (Step S1707: YES), the second control unit 300 proceeds to Step S1708. When determining not to retry sheet conveyance (Step S1707: NO), the second control unit 300 controls the first control unit 60 to suspend the operations of the MFP 100 by communicating with the first control unit 60 through the second communication unit 380, thereby to suspend the entire image forming system (Step S1712).

In Step S1708, the second control unit 300 controls the conveyance unit 320 or the push-out unit 360 to retry to convey the sheet stack in which the paper jam is detected, from a position at the paper jam detection time to the second tray 210. When detecting another paper jam during the conveyance retrial (Step S1709: YES), the second control unit 300 proceeds to Step S1712.

When not detecting another paper jam during the conveyance retrial (Step S1709: NO) and the placement surface has restored to the default position as a result of pivot of the first tray 200 about the support shaft 201 after completion of ejection of the sheet stack (Step S1710: YES), the second control unit 300 proceeds to Step S1711.

Figure 18:
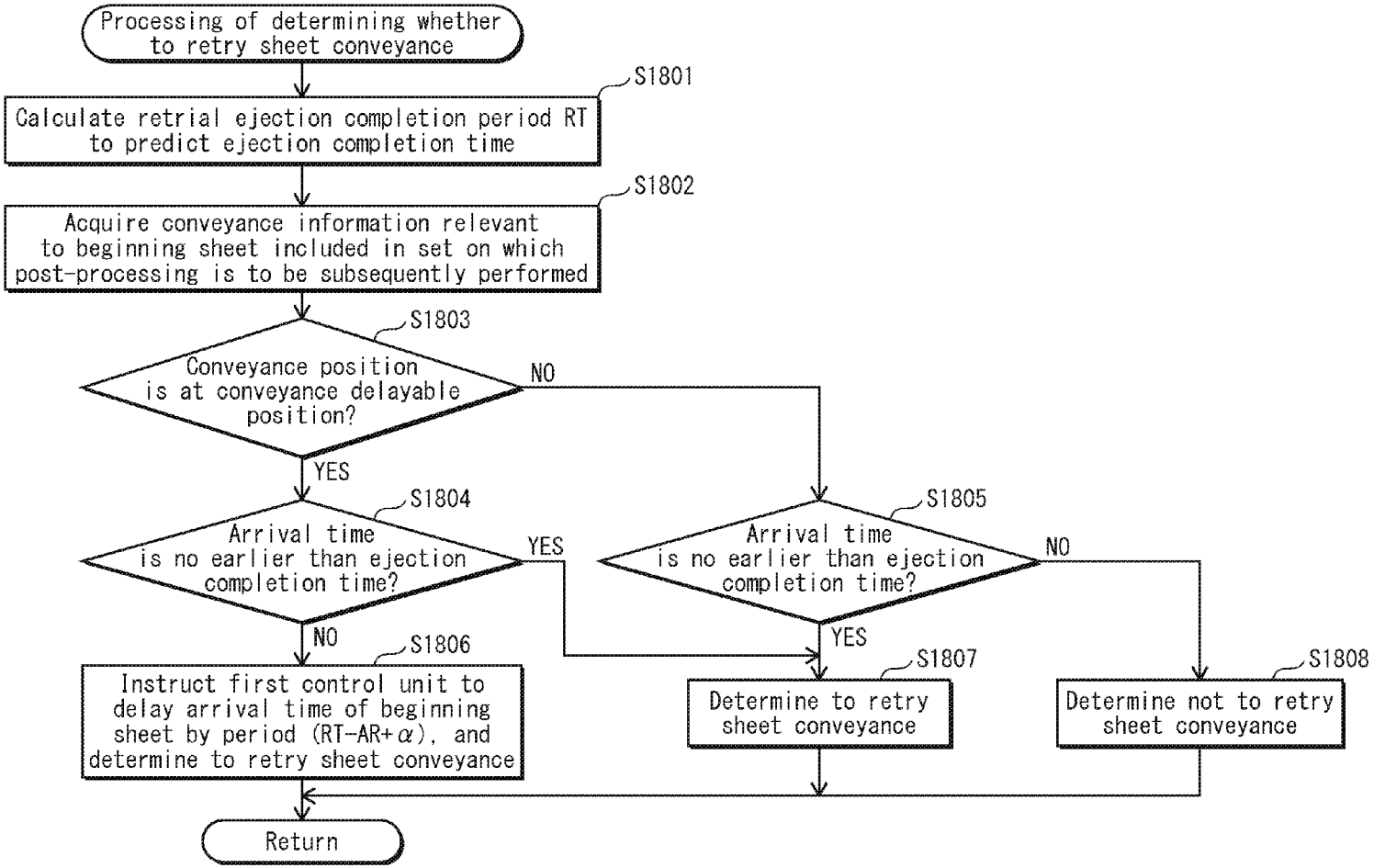
FIG. 18 is a flow chart of operations of processing of determining whether to retry sheet conveyance.

FIG. 18 is a flow chart of operations of the processing of determining whether to retry sheet conveyance. In Step S1801, the second control unit 300 calculates a retrial ejection completion period (RT). The retrial ejection completion period RT is a necessary period from when conveyance retrial is started from a position at a paper jam detection time to when the placement surface restores to the default position as a result of pivot of the first tray 200 about the support shaft 201 after completion of ejection of the sheet stack. Then, the second control unit 300 predicts a time when the placement surface restores to the default position after completion of the ejection (hereinafter, referred to as an ejection completion time). Then, the processing proceeds to Step S1802.

Here, the second control unit 300 stores the following information beforehand in the ROM 303 for each size and type of sheet: a conveyance distance of the sheet stack in each of the FD direction and the CD direction during execution of the post-processing (the conveyance distance in the FD direction is expressed as F0, and the conveyance distance in the CD direction is expressed as C0); an average conveyance speed in each of the FD direction and the CD direction (the average conveyance speed in the FD direction is expressed as FS0, and the average conveyance speed in the CD direction is expressed as CS0); and a distance (X0) from the uppermost end on the first tray 200 at which the front edge of the sheet stack arrives after being conveyed in the FD direction to the retraction position HM1. The second control unit 300 further stores, in the ROM 303, a period (R0) that is a period elapsed until the placement surface restores to the default position as a result of pivot of the first tray 200 about the support shaft 201 after completion of ejection of the sheet stack to the second tray 210.

Note that the respective average conveyance speeds in the FD direction and CD direction are each determined by performing a predetermined plurality of number of measurements of a period necessary for conveying the sheet stack by the conveyance distance in the direction (a conveyance period including a period in which conveyance is temporarily suspended due to a process operation performed by the process unit 340). Specifically, the average conveyance speed in each of the directions is determined by dividing the conveyance distance in the direction by an average value of the measured conveyance periods.

The retrial ejection completion period RT is calculated as shown below based on the above information.

In the case where a paper jam occurs during conveyance in the FD direction, the retrial ejection completion period RT is calculated from the following calculation formula, where a movement distance of the leading member 231 from the retraction position HM1, which is calculated at the paper jam detection time, to the position at the paper jam detection time is expressed as M1.

$$RT=(M1+X0)/FS0+C0/CS0+R0$$

In the above calculation formula, the retrial ejection completion period RT is calculated with use of the movement distance M1 of the leading member 231. Instead of using the movement distance M1, the retrial ejection completion period RT may be calculated as shown below with use of a movement distance M2 of the forcing member 232 from the retraction position HM2, which is calculated at the paper jam detection time, to the position at the paper jam detection time.

The retrial ejection completion period RT is calculated from the following calculation formula by storing in the ROM 303 a distance (LH) between the lateral surface 207 of the lower end part of the housing 202 and the retraction position HM2.

$$RT=(F0-(M2-LH))/FS0+C0/CS0+R0$$

Similarly, in the case where a paper jam occurs during conveyance in the CD direction, the retrial ejection completion period RT is calculated as shown below.

The retrial ejection completion period RT is calculated from the following calculation formula by storing, for each size and orientation of sheets, in the ROM 303 a distance (DH) between the retraction position and the default position of the push-out member 260, where a movement distance of the push-out member 260 from the retraction position, which is calculated at the paper jam detection time to the position at the paper jam detection time is expressed as C1.

$$RT=(C0-(C1-DH))/CS0+R0$$

In Step S1802, the second control unit 300 requests, through the second communication unit 380, the first control unit 60 for conveyance information relevant to a beginning sheet included in a set on which post-processing is to be performed subsequently to the sheet stack in which the paper jam is detected, and acquires the conveyance information from the MFP 100. Then, the processing proceeds to Step S1803.

In Step S1803, the second control unit 300 judges whether the current conveyance position of the front edge of the beginning sheet is positioned at the conveyance delayable position, based on the acquired conveyance information.

When judging that the conveyance position is positioned at the conveyance delayable position (Step S1803: YES), the second control unit 300 predicts a time when the front edge of the beginning sheet arrives at the paper ejection outlet 42 based on the period AR included in the acquired conveyance information. The time is regarded as a time at which the beginning sheet arrives at the first tray 200, and is hereinafter referred to as an arrival time. Then, the second control unit 300 judges whether the arrival time is no earlier than the ejection completion time (Step S1804). The second control unit 300 judges whether to retry sheet conveyance is possible by performing the judgment on the arrival time. When judging that the arrival time is no earlier than the ejection completion time, the second control unit 300 judges that the retrial is possible.

In the case where the period AR is shorter than the retrial ejection completion period RT and the arrival time is earlier than the ejection completion time (Step S1804: NO), the second control unit 300 instructs, through the second communication unit 380, the first control unit 60 to delay the arrival time when the beginning sheet arrives at the paper ejection outlet 42 by a period (RT−AR+α), and determines to retry sheet conveyance (Step S1806). In accordance with the instruction, the following operations are performed in the MFP 100. Specifically, the first control unit 60 temporarily suspends the beginning sheet by the nip part 14A of the pair of resist rollers 14, and then stands by for a period that is longer than a default standby period by the period designated by the second control unit 300. Then, the first control unit 60 outputs image data to the image creation unit 20 and controls the image creation unit 20 to write an image, and controls the pair of resist rollers 14, which are temporarily suspended, to start redriving to transfer the beginning sheet to the transfer position 27 in accordance with a timing when a toner image, which is to be transferred onto the beginning sheet, is conveyed to the transfer position 27.

As a result, even in the case where the second control unit 300 judges that the retrial is impossible because the arrival time is earlier than the ejection completion time, when the current conveyance position of the front edge of the beginning sheet included in a set on which post-processing is to be subsequently performed is positioned at the conveyance delayable position (Step S1803: YES), the arrival time is delayed by the period which is designated by the second control unit 300, such that the delayed arrival time is no earlier than the ejection completion time, and the second control unit 300 determines to retry sheet conveyance.

As a result, even in the case where retrial is impossible due to that the arrival time is not delayed, it is possible to preferentially perform the retrial operations by performing control as described above.

Here, the above value α expresses a period that is determined beforehand with consideration for errors of the period AR and the retrial ejection completion period RT, and is stored in the ROM 303. For example, the period α may be set to 0.1 sec.

In Step S1804, in the case where the period AR is equal to or longer than the retrial ejection completion period RT and the arrival time is no earlier than the ejection completion time (Step S1804: YES), the second control unit 300 judges that the retrial is possible, and determines to retry sheet conveyance (Step S1807).

Further, when judging negatively in Step S1803 (Step S1803: NO), the second control unit 300 judges whether the arrival time is no earlier than the ejection completion time (Step S1805), in the same manner as in the processing in Step S1804. When judging that the arrival time is no earlier than ejection completion time (Step S1805: YES), the second control unit 300 judges that the retrial is possible, and determines to retry sheet conveyance (Step S1807). When judging that the arrival time is earlier than the ejection completion time (Step S1805: NO), the second control unit 300 judges that the retrial is impossible, and determines not to retry sheet conveyance (Step S1808).

In the retrial control processing in the present embodiment, in this way, the period AR and the retrial ejection completion period RT are calculated, and the arrival time and the ejection completion time are predicted. Here, the period AR is a period necessary for the front edge of a beginning sheet, which is included in a subsequent set on which post-processing is to be performed subsequently to a sheet stack in which a paper jam is detected, to arrive at the paper ejection outlet 42 from the current position of the beginning sheet. As a result, the arrival time and the ejection completion time are predicted. Control is performed, such that conveyance of the sheet stack in which the paper jam is detected is retried in the case where the arrival time is no earlier than the ejection completion time and there is no possibility that while a retrial operation is performed, the beginning sheet included in the set on which the post-processing is to be subsequently performed is ejected from the image forming apparatus to the post-processing device, the sheet stack under the retrial contacts the beginning sheet, and as a result another paper jam occurs.

This prevents from making processing for removing paper jams more complicated and increasing processing burden imposed on the user due to complication of processing for removing another jammed papers caused by the retrial. Therefore, in a post-processing device capable of retrying sheet conveyance and an image forming system including the post-processing device, it is possible to prevent increase in processing burden imposed on the user for removing jammed papers.

Also, assume a case where the arrival time is earlier than the ejection completion time and there is a possibility that while a retrial operation is performed, the beginning sheet included in the set on which the post-processing is to be subsequently performed is ejected from the image forming apparatus to the post-processing device, the sheet stack under the retrial contacts the beginning sheet, and as a result another paper jam occurs. Even in such a case, in the case where an arrival time of the beginning sheet at the paper ejection outlet 42 can be delayed so as to be no earlier than the ejection completion time, conveyance is retried. This increases the number of retrials during a print job, thereby reducing processing burden imposed on the user for removing jammed papers.

(Modifications)

Although the present invention has been explained based on the above embodiment, the present invention is not of course limited to the above embodiment. The present invention may include the following modifications.

(1) In the above embodiment, in the case where a paper jam is detected, an arrival time when the beginning sheet included in a set on which post-processing is to be subsequently performed arrives at the paper ejection outlet 42 is delayed, by delaying a timing of instructing the image forming subunit 20 to write an image and a timing of redriving the pair of resist rollers 14, which are temporarily suspended, to convey the beginning sheet to the transfer position. Alternatively, the arrival time may be delayed by providing a pre-stack mechanism in the post-processing device 150. The pre-stack mechanism is for temporarily storing sheets on which the post-processing is to be performed.

Figure 19:
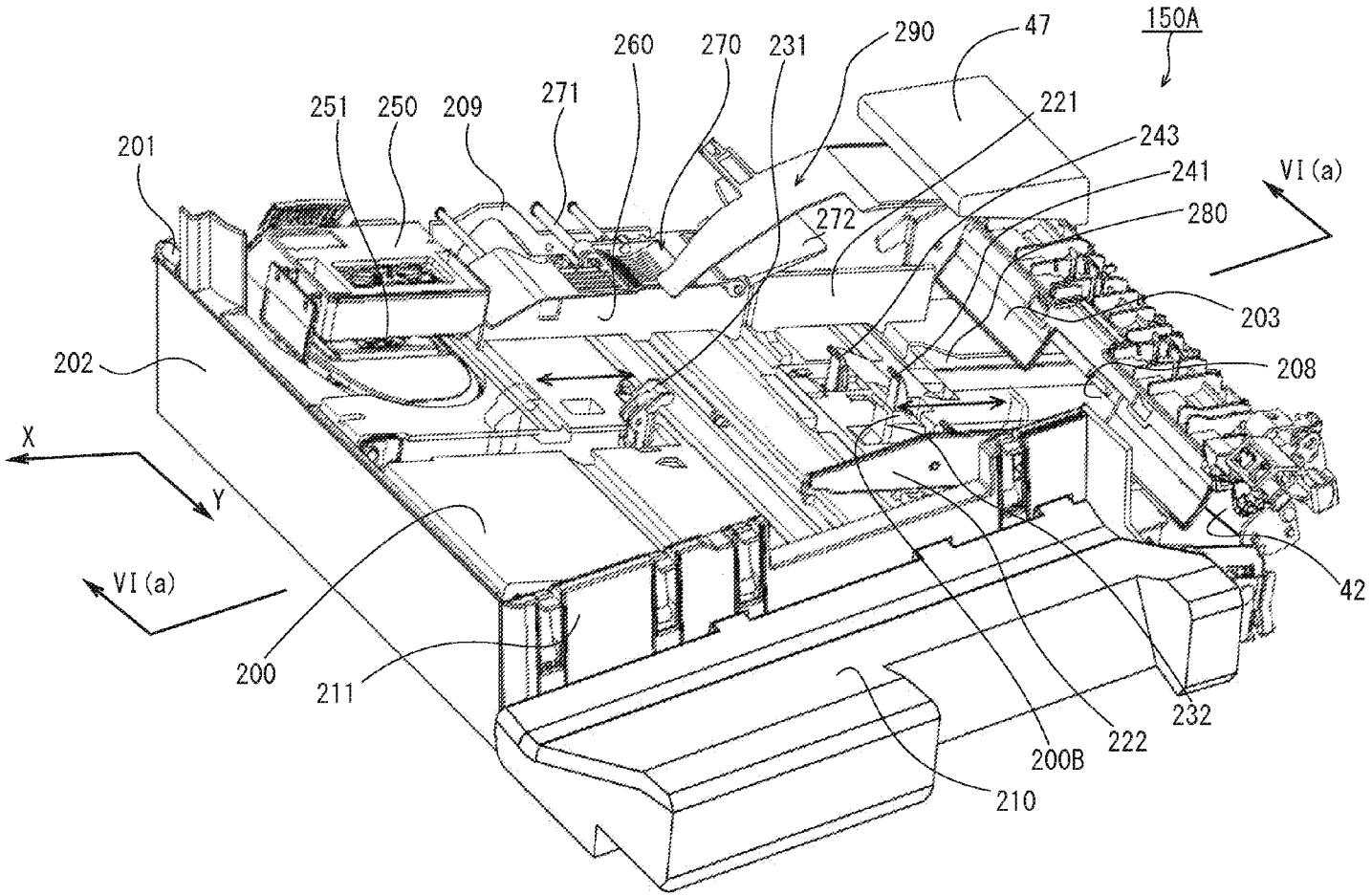
FIG. 19 is a perspective view of an external appearance of a modification of the post-processing device shown in FIG. 4.
Figure 20:
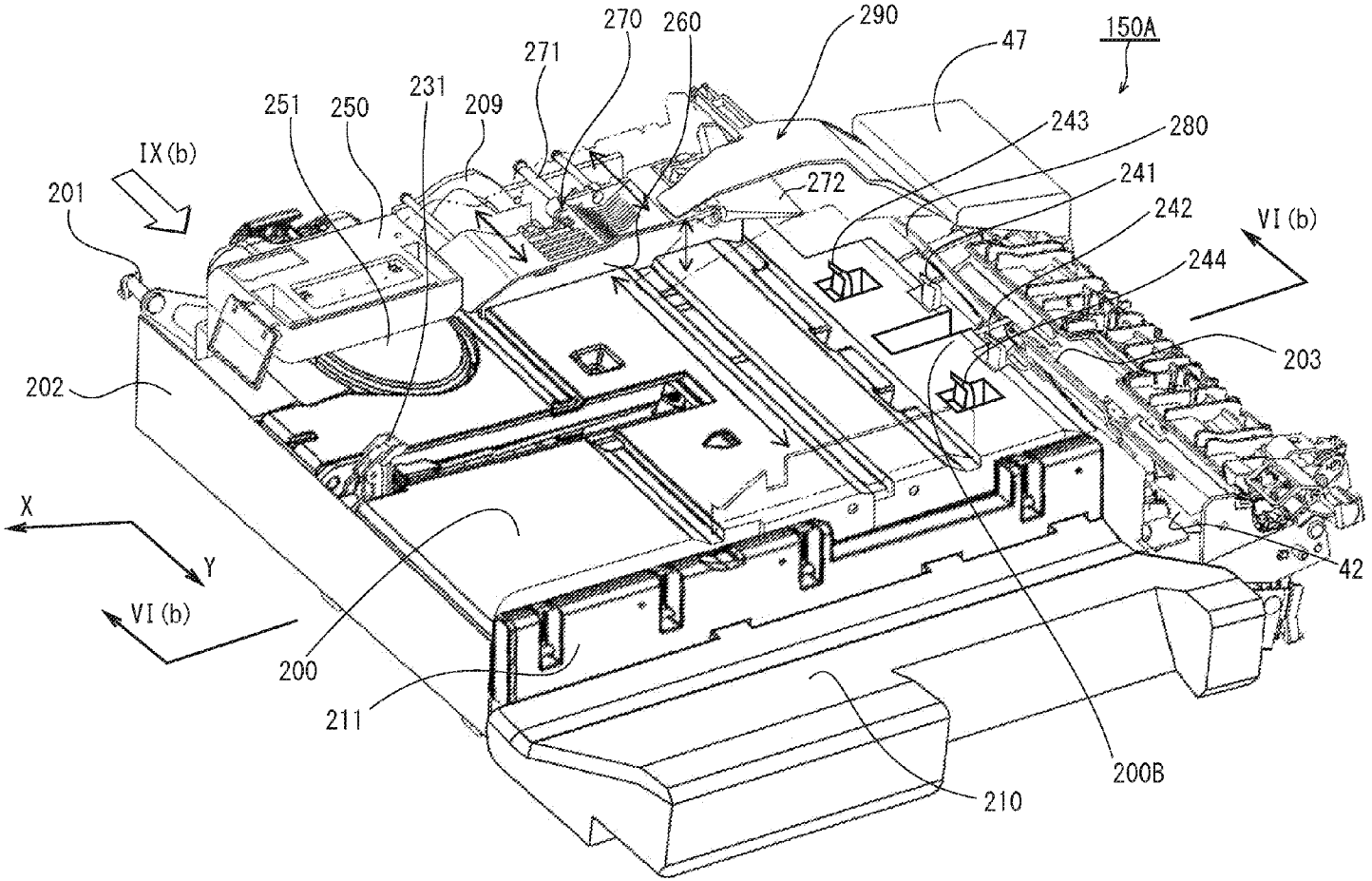
FIG. 20 is a perspective view of the external appearance of the post-processing device shown in FIG. 19 in the state where a placement surface of a first tray is horizontal.

Specifically, a post-processing device 150A relating to the present modification may include a supporting member 270 and a dropping member 290 in addition to the configuration of the post-processing device 150 relating to the above embodiment, as shown in FIGS. 19 and 20.

FIG. 19 shows the state where the first tray 200 included in the post-processing device 150A keeps the placement surface parallel to the FD direction (the X-axis direction) by inclining the placement surface with respect to the horizontal direction. FIG. 20 shows the state where the first tray 200 included in the post-processing device 150A keeps the placement surface horizontal.

The following explanation is given focusing on the supporting member 270 and the dropping member 290. The explanation has been already given on the other elements included in the post-processing device 150A (the elements to which the same reference numbers as the elements included in the post-processing device 150 are appended), and therefore is omitted.

In the post-processing device 150A shown in FIG. 19, the guide member 280, the supporting member 270, and the dropping member 290 function as the pre-stack mechanism in cooperation with each other. The dropping member 290 forcibly drops a sheet stack, which is temporarily stored in the pre-stack mechanism, on the first tray 200 before subsequent post-processing is started.

While the push-out member 260 moves on the first tray 200, the supporting member 270 supports a sheet, which is newly ejected through the paper ejection outlet 42, so as to be positioned above the push-out member 260. Further, when the push-out member 260 completes ejecting a sheet stack, that is, when the push-out member 260 retracts from the first tray 200, the supporting member 270 releases support of the sheet.

While the placement surface of the first tray 200 is inclined with respect to the horizontal direction, the guide member 280 moves a sheet, which is ejected through the paper ejection outlet 42, to the placement surface by varying inclination of the upper surface in the FD direction. While the placement surface is horizontal (while the position of the forcing member 232 in FIG. 6B is kept in the range PRV, which is distant from the retraction position HM2 by the predetermined distance (the distance to the lower end LEG of the placement surface of the first tray 200) or greater), the guide member 280 moves the sheet to the upper surface of the supporting member 270 by varying inclination of the upper surface in the FD direction.

In accordance with a timing when the supporting member 270 releases support of the sheet, the dropping member 290 applies a downward force to the sheet to forcibly drop on the first tray 200.

Referring to FIGS. 19 and 20, the supporting member 270 is supported by three cantilevers 271 that are parallel to the CD direction (the Y-axis direction) so as to be slidable in the longitudinal direction of the cantilevers 271. The cantilevers 271 have respective base parts that are fixed to a frame 209 of the first tray 200, and have respective front end parts that extend toward the upper side of the placement surface of the first tray 200 in the CD direction. With this configuration, the supporting member 270 is movable back and forth in the CD direction in an upper region on the placement surface of the first tray 200. Further, the supporting member 270 is movable, together with the push-out member 260 from the position thereof, which is a position at a time when the placement surface of the first tray 200 is inclined with respect to the horizontal direction, in the CD direction (the negative direction on the Y-axis) to retract from an upper position on the placement surface.

Figures 21A, 21B, 21C:
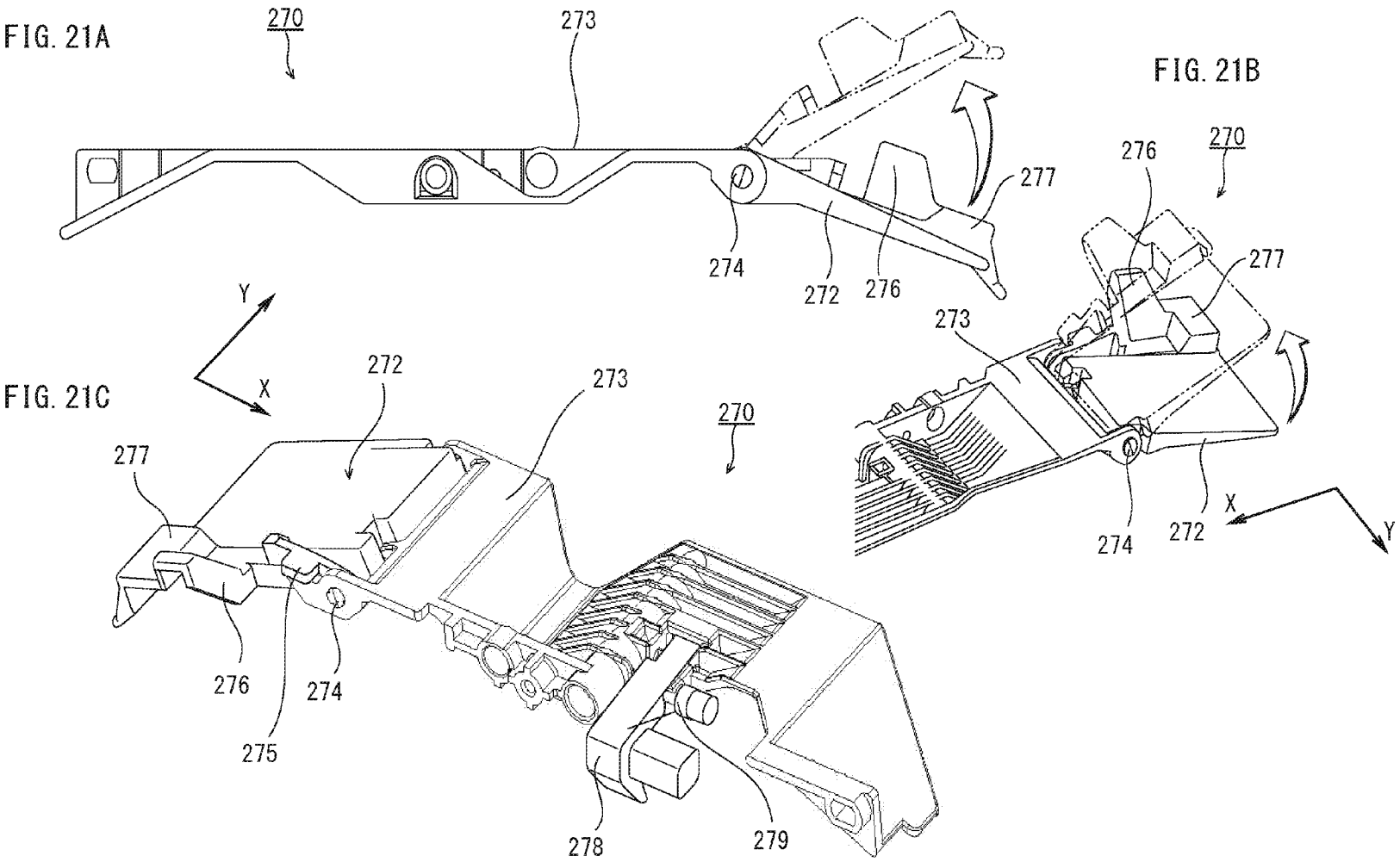
FIG. 21A is a lateral view of a supporting member shown in FIG. 19.
FIG. 21B is a perspective view of the vicinity of a front end part of the supporting member shown in FIG. 19.
FIG. 21C is a perspective view of the entire upper surface of the supporting member shown in FIG. 19.

FIG. 21A is a lateral view of the supporting member 270, FIG. 21B is a perspective view of the vicinity of a front end part of the supporting member 270, and FIG. 21C is a perspective view of the entire upper surface of the supporting member 270. Referring to FIGS. 21A-21C, the supporting member 270 is substantially elongated and planar, and has the entire upper surface that is substantially flat.

Referring to FIGS. 19 and 20, the supporting member 270 is disposed such that the longitudinal direction thereof is along the margin of the first tray 200 in the CD direction, and has a front end part 272 that is inclined toward the paper ejection outlet 42. Further, the supporting member 270 is kept parallel to the placement surface of the first tray 200 irrespective of inclination of the placement surface. Referring again to FIGS. 21A-21C, the front end part 272 of the supporting member 270 is connected to a base part 273 via a support shaft 274, and is pivotable about the support shaft 274.

As shown in FIGS. 21B and 21C, a small projection 275, a tapered part 276, and a base part 277 protrude from the side which is more distant from the placement surface of the first tray 200 than the other side (the negative side on the Y-axis) on a lateral surface of the front end part 272 in the CD direction (the Y-axis direction).

As indicated by solid lines in FIGS. 21A-21C, when the front end part 272 rotates by an angle so as to be inclined obliquely downward with respect to the base part 273, the small projection 275 contacts the base part 273 and keeps the inclination of the front end part 272 at the angle.

When the placement surface of the first tray 200 in the horizontal orientation shown in FIG. 20 starts inclining, the tapered part 276 and the base part 277 contact the housing 202 of the post-processing device 150 from above, and as a result receive an upward force from the housing 202. Owing to this force, the front end part 272 rotates by an angle so as to be inclined obliquely upward with respect to the base part 273, as indicated by two-dot chain lines shown in FIGS. 21A and 21B.

The base part 277 protrudes in the normal direction of the upper surface of the front part 272 as well as the tapered part 276, and is lower in height than the tapered part 276. While the supporting member 270 keeps in the horizontal orientation shown in FIG. 20, the base part 277 supports the dropping member 290 placed thereon until the supporting member 270 retracts from the upper position of the placement surface of the first tray 200.

Referring again to FIG. 21C, a hook 278 is attached to a lateral surface of the base part 273 so as to be pivotable about a base thereof. Further, a torsion coil spring 279 is connected to the base of the hook 278. As shown in FIG. 19, when the push-out member 260 moves in the CD direction (the negative direction on the Y-axis) to retract to the outside of the placement surface of the first tray 200, the hook 278 is coupled to the push-out member 260 and is pushed. As a result, the supporting member 270 and the push-out member 260 retract together to the outside of the placement surface.

Figure 22A:
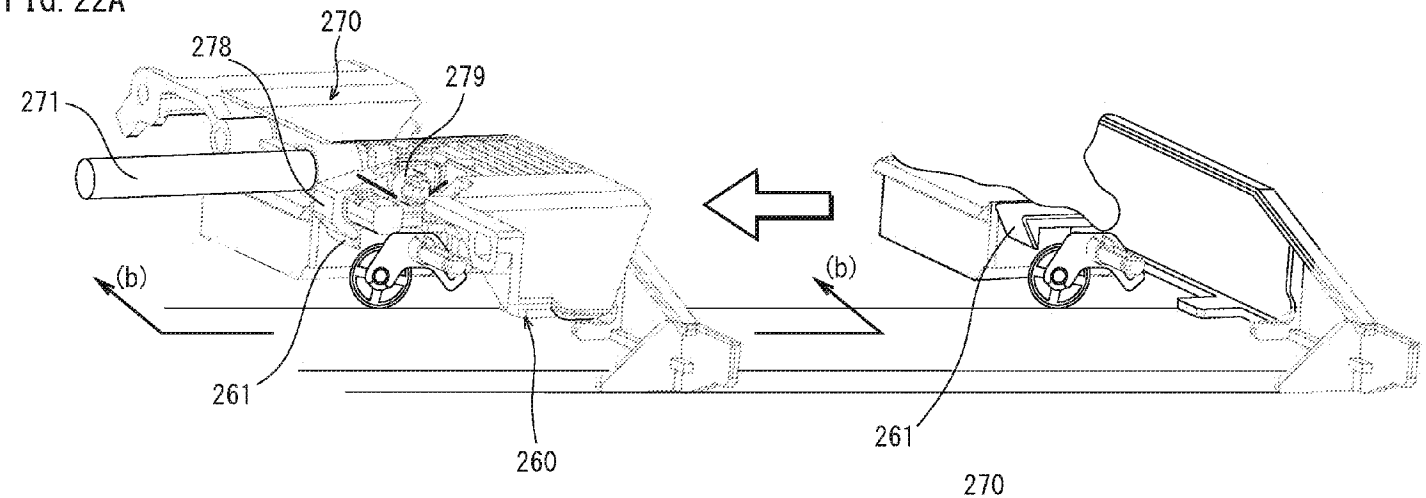
FIG. 22A is a perspective view schematically showing a part of the push-out member shown in FIG. 19 that is coupled to the supporting member when the push-out member retracts.
Figure 22B:
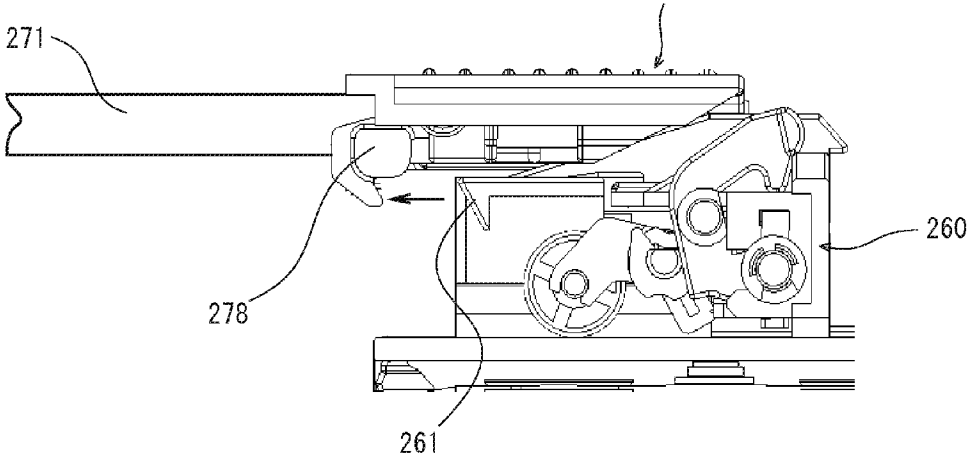
FIG. 22B is a cross-sectional view taken along a line (b)-(b) in FIG. 22A.

FIG. 22A is a perspective view schematically showing a part of the push-out member 260 that is coupled to the supporting member 270 when the push-out member 260 retracts. FIG. 22B is a cross-sectional view taken along a line (b)-(b) in FIG. 22A. Referring to FIGS. 22A and 22B, the push-out member 260 includes a catching member 261 on a surface thereof facing the supporting member 270. When the push-out member 260 recedes to the margin of the placement surface of the first tray 200 while the placement surface is kept horizontal as shown in FIG. 20, the catching member 261 is coupled to the inside of the hook 278 of the supporting member 270 and pushes the hook 278. A pushing force applied here moves the supporting member 270 and the push-out member 260 together. This pushing force further compresses a compressed spring that is attached between the supporting member 270 and the frame 209 of the first tray 200.

When the placement surface of the first tray 200 is inclined with respect to the horizontal direction, the hook 278 of the supporting member 270 departs from the catching member 261 of the push-out member 260 as described below. Here, a restoration force of the compressed spring, which is compressed between the supporting member 270 and the frame 209 of the first tray 200, restores the supporting member 270 to the default position shown in FIG. 19.

Figure 23A:
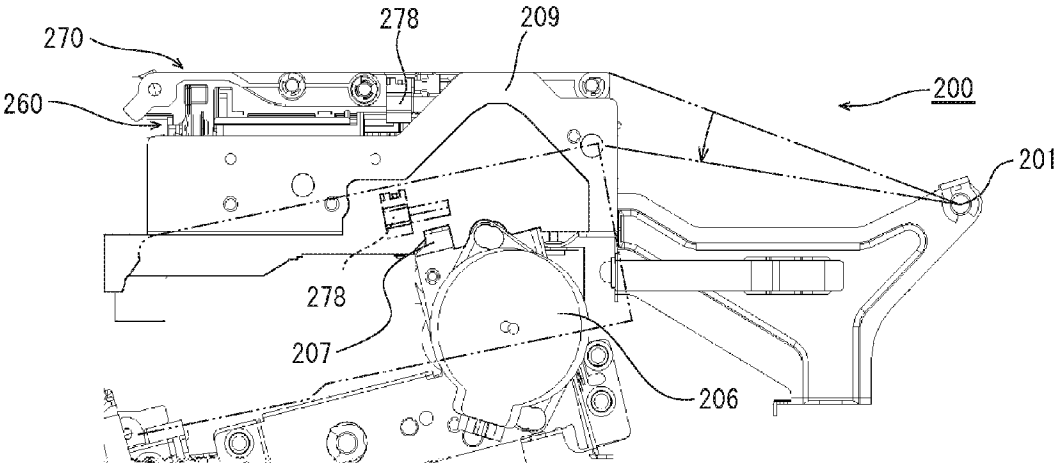
FIG. 23A is an enlarged lateral view of the vicinity of a support shaft of the first tray shown in FIG. 19.

FIG. 23A is an enlarged lateral view of the vicinity of the support shaft 201 of the first tray 200 when seen in a direction indicated by an arrow IX(b) shown in FIG. 20. Referring to FIG. 23A, the first tray 200 is supported by a chassis 206 that is fixed to the housing 202 of the post-processing device 150 at the outer side of the first tray 200. When the supporting member 270 retracts to the outside of the placement surface of the first tray 200 together with the push-out member 260 while the placement surface is kept horizontal, the front end part of the hook 278 protrudes outward beyond the chassis 206 from the first tray 200.

When the first tray 200 starts pivoting about the support shaft 201 to incline the placement surface with respect to the horizontal direction, the front end part of the hook 278 moves downward in accordance with increase of the inclination, and collides with a protrusion 207 that is provided in the chassis 206 from above, as indicated by a two-dot chain line shown in FIG. 23A. Owing to an upward force applied by the collision, the hook 278 rotates about the base thereof in the upper direction, and as a result departs from the catching member 261 of the push-out member 260.

Figure 23B:
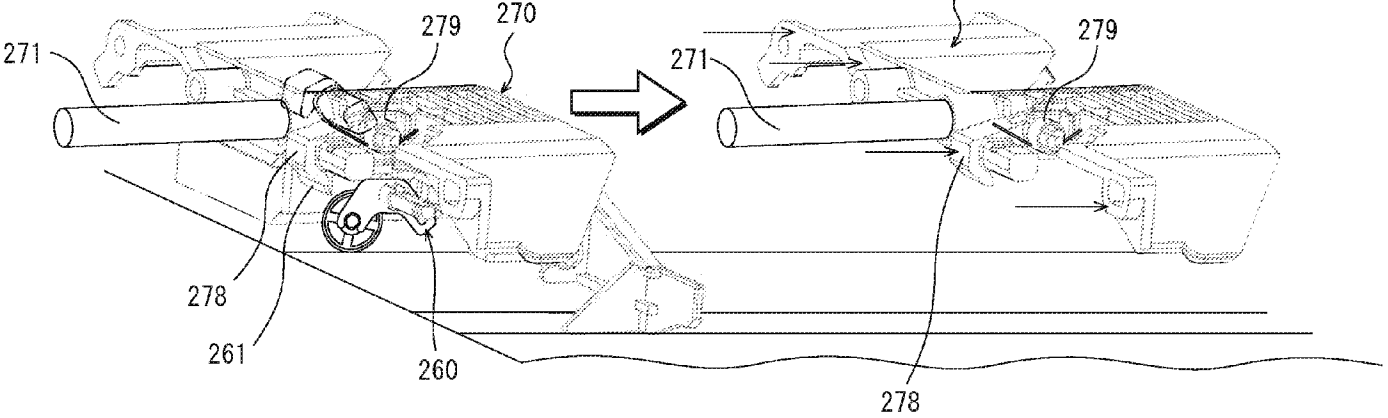
FIG. 23B is a perspective view schematically showing a part of the supporting member shown in FIG. 19 that departs from the push-out member when the supporting member restores to a default position.

FIG. 23B is a perspective view schematically showing a part of the supporting member 270 that departs from the push-out member 260 when the supporting member 270 restores to the default position. As described above, when the hook 278 moves downward as inclination of the first tray 200 increases, the hook 278 collides with the protrusion 207 of the chassis 206, which is fixed to the housing 202 of the post-processing device 150, from above. Here, the hook 278 receives an upward impact force from the protrusion 207, and rotates about the base thereof in the upper direction as indicated by a two-dot chain line shown in FIG. 23B. This releases engagement between the hook 278 and the catching member 261 of the push-out member 260, and accordingly the hook 278 departs from the catching member 261. As a result, since the supporting member 270 is released from the push-out member 260 and becomes freely slidable, the supporting member 270 is pushed out above the placement surface of the first tray 200 owing to the restoration force of the compressed spring, which is compressed between the supporting member 270 and the frame 209 of the first tray 200. In this way, the supporting member 270 restores to the default position shown in FIG. 19.

Referring to FIGS. 19 and 20, the dropping member 290 is an arm-like part that is disposed above the margin of the first tray 200 in the CD direction (the Y-axis direction), and extends in the FD direction (the X-axis direction) between a region above the guide member 270 and a region above the paper ejection outlet 42.

Figure 24A:
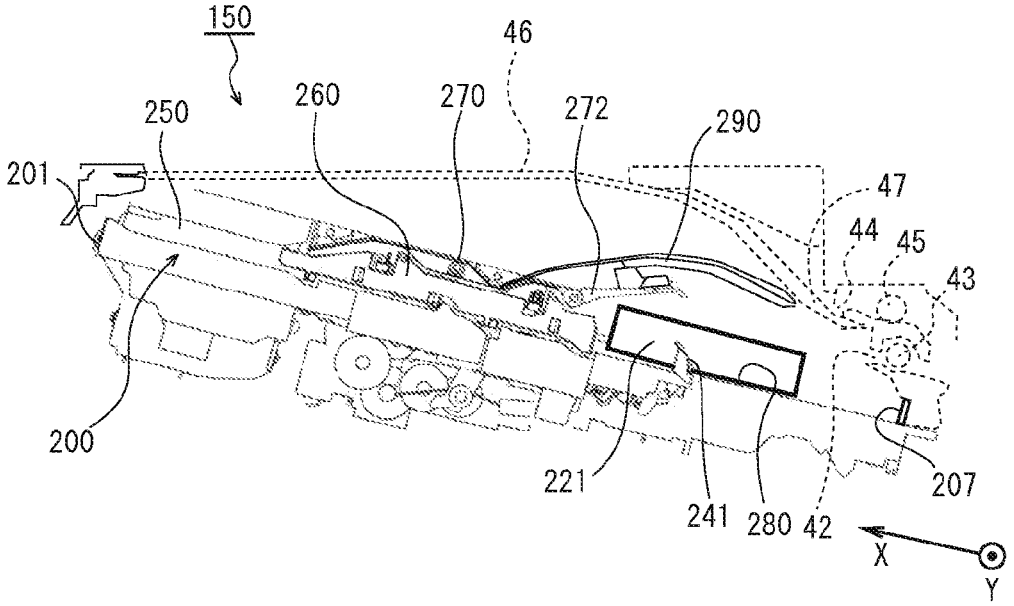
FIG. 24A is a cross-sectional view taken along a line VI(a)-VI(a) in FIG. 19.
Figure 24B:
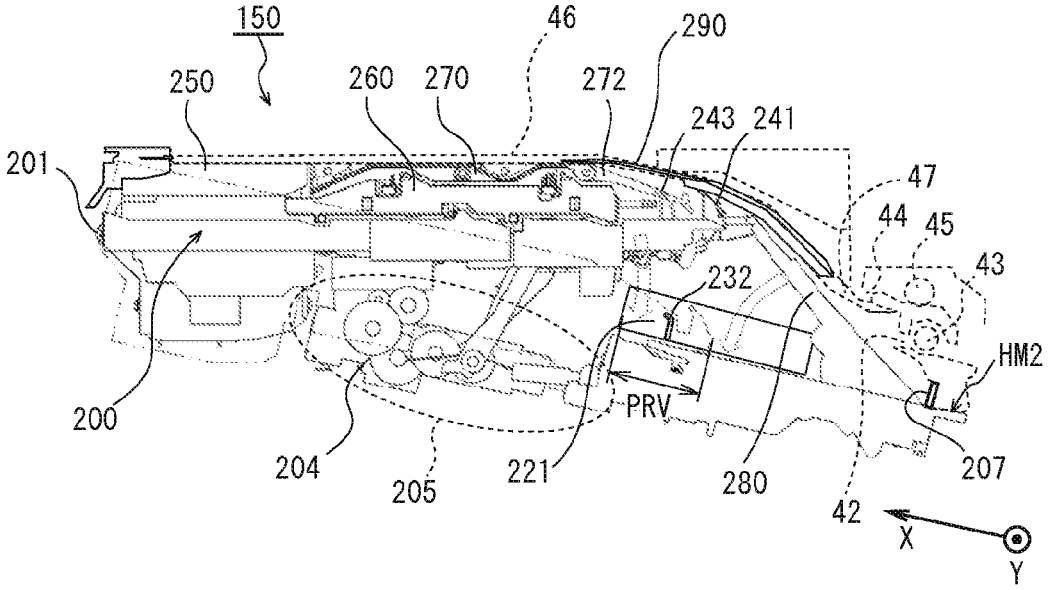
FIG. 24B is a cross-sectional view taken along a line VI(b)-VI(b) in FIG. 20.

FIG. 24A is a cross-sectional view taken along a line VI(a)-VI(a) in FIG. 19, and FIG. 24B is a cross-sectional view taken along a line VI(b)-VI(b) in FIG. 20. As shown in FIGS. 24A and 24B, a base of the dropping member 290 is supported by a base part 47 of the inversion guide plate 46 so as to be pivotable.

The dropping member 290 moves a front end thereof up and down by pivoting about the base thereof, and thereby varies a distance between the front end of the dropping member 290 and the placement surface of the first tray 200.

Figure 25A:
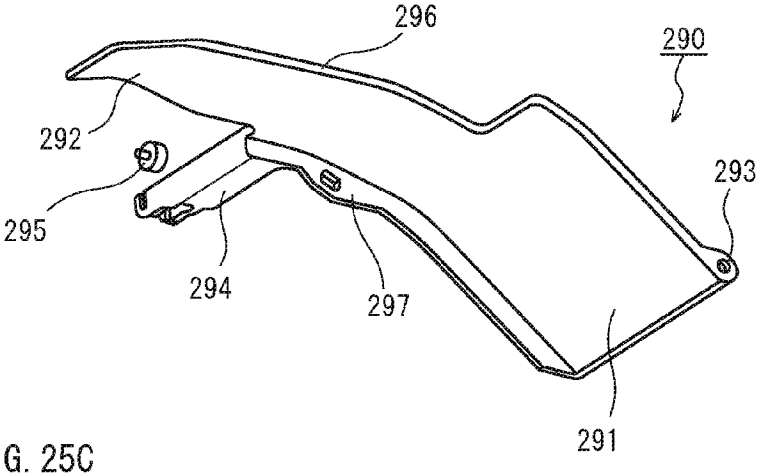
FIG. 25A is a perspective view of a lower surface of a dropping member shown in FIG. 19.
Figure 25C:
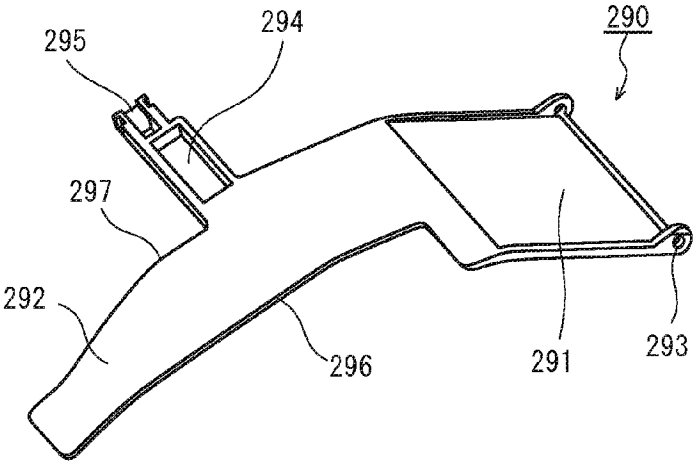
FIG. 25C is a perspective view of an upper surface of the dropping member shown in FIG. 19.
Figure 25B:
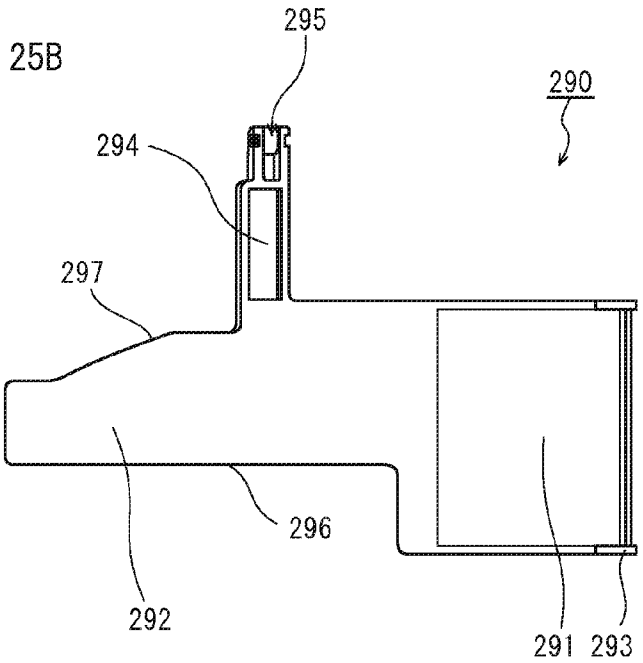
FIG. 25B is a top view of the dropping member shown in FIG. 19.

FIG. 25A is a perspective view of a lower surface of the dropping member 290, FIG. 25B is a top view of the dropping member 290, and FIG. 25C is a perspective view of an upper surface of the dropping member 290. Referring to FIGS. 25A-25C, the dropping member 290 is elongated and plate-like, and is curved upward so as to be convex between a base part 291 and a front end part 292 thereof.

The base part 291 has through-holes 293 in a lateral surface thereof. A shaft that is included in the base part 47 of the inversion guide plate 46 penetrates these through-holes 293. The dropping member 290 is supported by the base part 47 of the inversion guide plate 46 via the shaft, and pivots about the shaft.

Referring to FIG. 25B, one of the margins in the width direction of the front end part 292 of the dropping member 290, that is, the CD direction (the Y-axis direction in FIGS. 19 and 20), namely, the margin that is positioned inside the placement surface of the first tray 200 (the positive side on the Y-axis) (hereinafter, referred to as an inner margin 296) straightly extends in the longitudinal direction, that is, the FD direction (the X-axis direction in FIGS. 19 and 20). On the other hand, the opposite margin 297 (the negative side on the Y-axis) (hereinafter, referred to as an outer margin 297) gradually becomes narrower from the base part 291 toward the front end part 292. Further, an arm part 294 protrudes from the outer margin 297 so as to be parallel to an upper surface of the front end part 292. A cylindrical roller 295 is attached to a front end of the arm part 294 so as to be rotatable about a central shaft thereof.

Figures 26A, 26B, 26C:
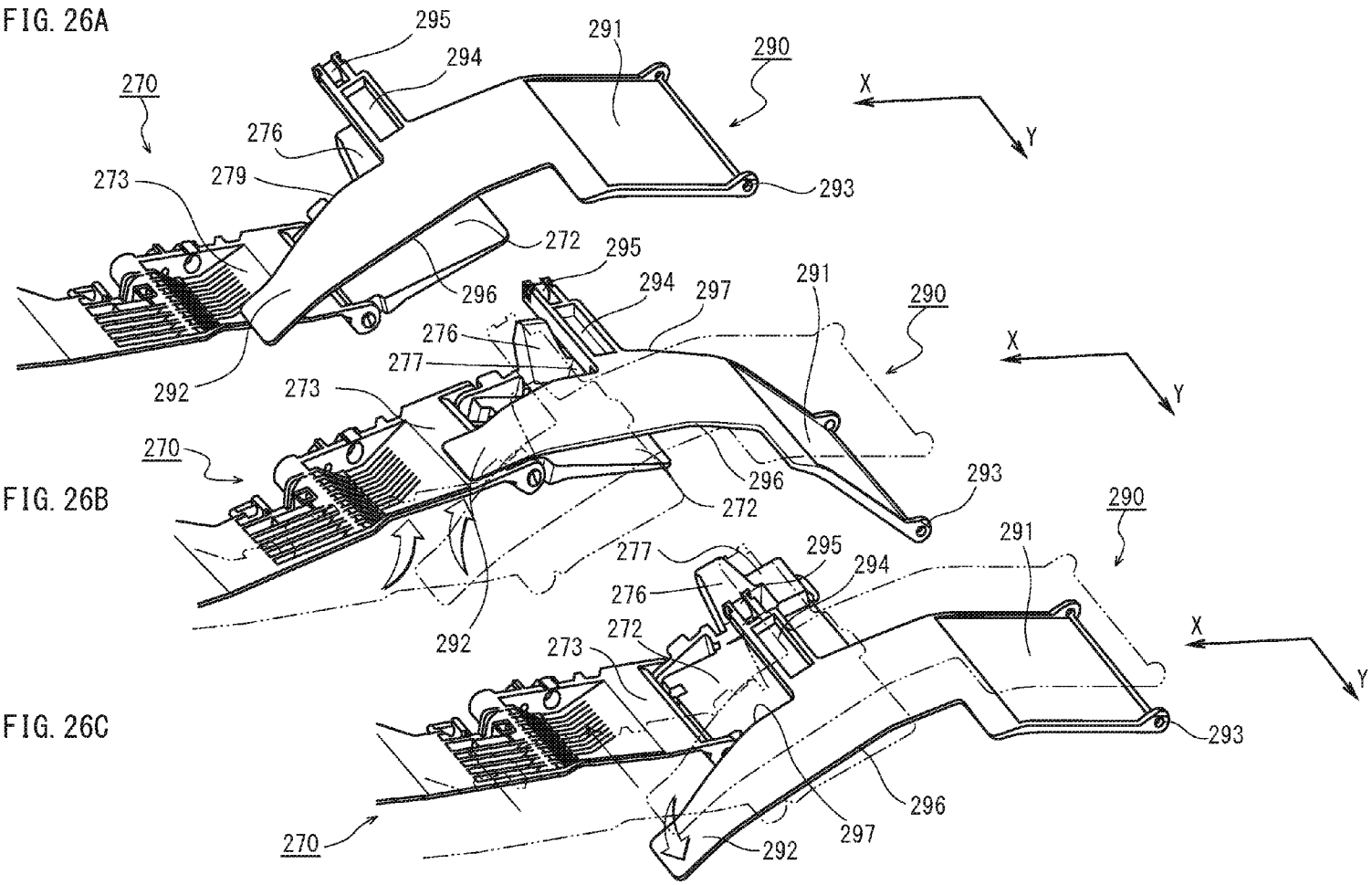
FIG. 26A is an enlarged perspective view of a relative positional relation between the supporting member and the dropping member included in the post-processing device shown in FIGS. 19 and 20, showing a positional relation in a period while a sheet that is ejected from the image forming apparatus is stored in the first tray.
FIG. 26B is an enlarged perspective view of a relative positional relation between the supporting member and the dropping member included in the post-processing device shown in FIGS. 19 and 20, showing a positional relation in a period while the first tray causes the placement surface to be horizontal.
FIG. 26C is an enlarged perspective view of a relative positional relation between the supporting member and the dropping member included in the post-processing device shown in FIGS. 19 and 20, showing a positional relation in a period while the supporting member retracts from an upper position on the first tray and then returns to the upper position.
Figures 27A, 27B, 27C:
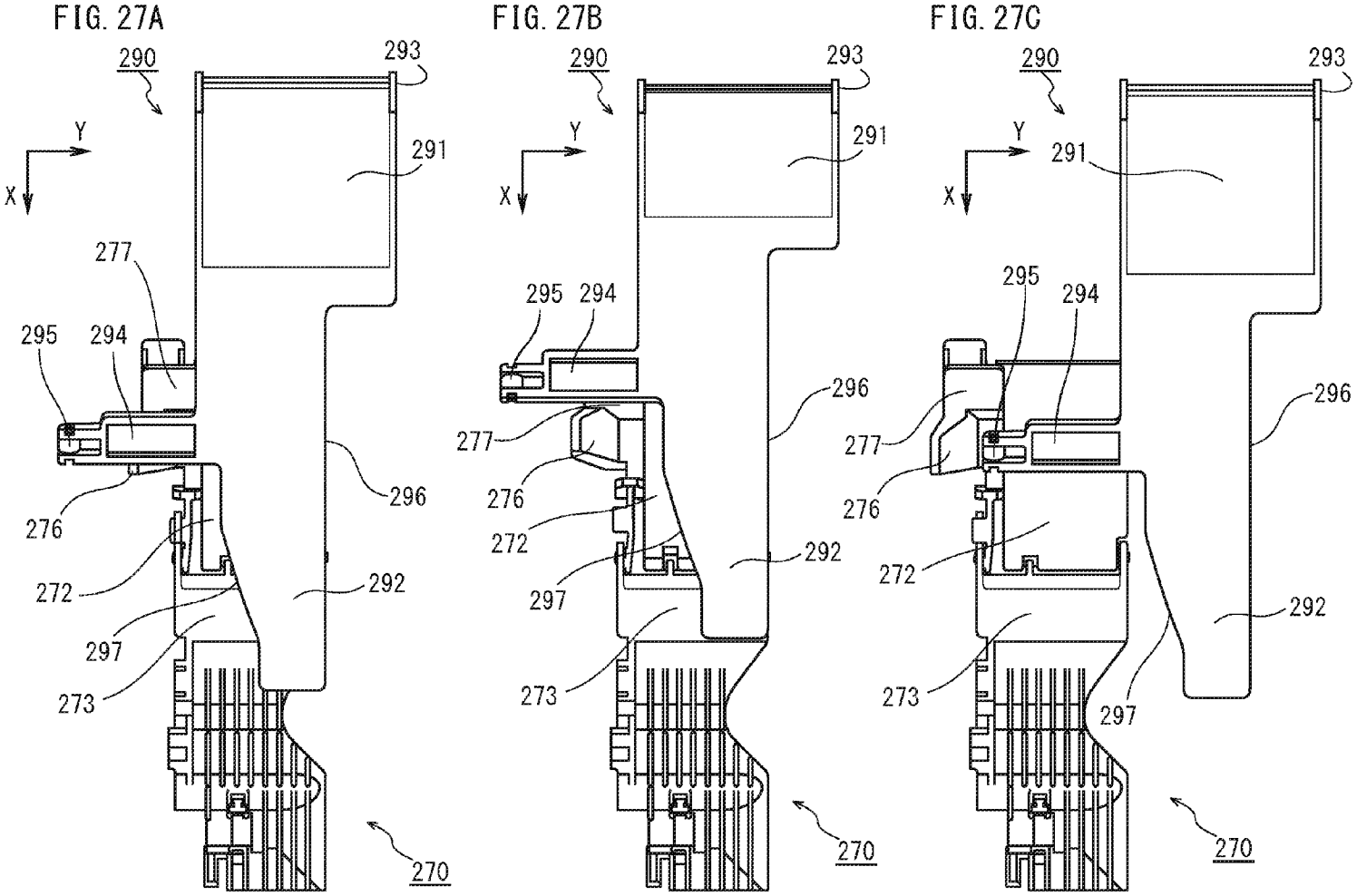
FIG. 27A is an enlarged top view of the supporting member and the dropping member which are in the positional relation shown in FIG. 26A, showing the supporting member and the dropping member shown in FIG. 26A.
FIG. 27B is an enlarged top view of the supporting member and the dropping member which are in the positional relation shown in FIG. 26B, showing the supporting member and the dropping member shown in FIG. 26B.
FIG. 27C is an enlarged top view of the supporting member and the dropping member which are in the positional relation shown in FIG. 26C, showing the supporting member and the dropping member shown in FIG. 26C.

FIGS. 26A-26C are enlarged perspective views of a relative positional relation between the supporting member 270 and the dropping member 290, which are attached to the post-processing device 150A. FIGS. 27A-27C are enlarged top views of the supporting member 270 and the dropping member 290, which are in the positional relation shown in FIGS. 26A-26C, respectively. FIGS. 26A and 27A show the supporting member 270 and the dropping member 290 in a period while a sheet that is ejected through the paper ejection outlet 42 is stored in the first tray 200. FIGS. 26B and 27B show the supporting member 270 and the dropping member 290 in a period while the first tray 200 causes the placement surface to be horizontal. FIGS. 26C and 27C show the supporting member 270 and the dropping member 290 in a period while the supporting member 270 retracts from the upper position on the first tray 200 and then returns to the upper position.

While the sheet, which is ejected through the paper ejection outlet 42, is stored in the first tray 200, the first tray 200 inclines the placement surface with respect to the horizontal direction and keeps the placement surface parallel to the FD direction (the X-axis direction), as shown in FIGS. 19 and 24A. In accordance with this, the base part 273 of the supporting member 270 inclines with respect to the horizontal direction as well, and keeps the upper surface thereof substantially parallel to the FD direction. On the other hand, when the base part 273 of the supporting member 270 starts inclining with respect to the horizontal direction, the tapered part 276 contacts the housing 202 of the post-processing device 150 from above. As a result, the front end part 272 is inclined obliquely upward with respect to the upper surface of the base part 273, in other words, the FD direction, as indicated by the two-dot chain lines shown in FIGS. 21A and 21B. Here, as shown in FIGS. 19, 24A, 26A, and 27A, a lower surface of the arm part 294 of the dropping member 290 is supported by the tapered part 276 of the supporting member 270. With this configuration, the dropping member 290 keeps its orientation such that the front end part 292 is floated from the upper surface of the base part 273 of the supporting member 270 by a predetermined distance. This orientation of the dropping member 290 is hereinafter referred to as a guide orientation.

Referring to FIGS. 19, 24A, 26A, and 27A, while keeping in the guide orientation, the dropping member 290 covers a religion above the first tray 200 along the margin of the first tray 200 in the CD direction, together with the supporting member 270. With this configuration, even in the case where a sheet stack, which is to be stored in the first tray 200, warps or distorts in a direction away from the placement surface of the first tray 200 due to movement from the paper ejection outlet 42, alignment performed by the alignment members 221 and 222, or conveyance performed by the conveyance members 231 and 232, the sheet stack contacts the supporting member 270 or the lower surface of the dropping member 290, and returns to the placement surface. In this way, the dropping member 290 in the guide orientation functions as a guide for sheets to the placement surface in the normal direction, together with the supporting member 270.

When the first tray 200 causes the placement surface to be horizontal, the base part 273 of the supporting member 270 causes the upper surface thereof to be horizontal, as shown in FIGS. 20 and 24B. On the other hand, the tapered part 276 is released from contact with the housing 202 of the post-processing device 150A, and as a result, the front end part 272 inclines obliquely downward with respect to the upper surface of the base part 273, in other words, the horizontal direction, as indicated by solid lines shown in FIGS. 21A and 21B. In accordance with this, as shown in FIGS. 26B and 27B, the arm part 294 of the dropping member 290 slips from the tapered part 276 of the supporting member 270 down to the base part 277 of the supporting member 270, and the lower surface of the arm part 294 is supported by the base part 277. Here, since the supporting member 270 moves upward in accordance with pivot of the first tray 200, the front end part 292 of the dropping member 290 is pushed up by an upward force applied from the base part 277. As a result, the dropping member 290 forms a guide mechanism for guiding sheets to the upper surface of the base part 273 of the supporting member 270, by the lower surface, which is curved upward so as to be convex resulting from moving upward to the position of the inversion guide plate 46 as shown in FIG. 24B, the front end part 272 of the supporting member 270, and the guide member 280 (the guide member 280 in the state where the forcing member 232 arrives at the lower end LEG of the placement surface of the first tray 200 and inclines the upper surface thereof with respect to the FD direction). This mechanism is hereinafter referred to as a pre-stack mechanism, and orientation of the dropping member 290 while forming the pre-stack mechanism is hereinafter referred to as a pre-stack orientation. While keeping in the pre-stack orientation, the dropping member 290 keeps its orientation according to which the front end part 292 is floated from the upper surface of the base part 273 of the supporting member 270 by the predetermined distance.

While the first tray 200 keeps the placement surface horizontal, a sheet, which is newly ejected through the paper ejection outlet 42, is led by the pre-stack mechanism to move to the upper surface of the base part 273 of the supporting member 270. Here, the width of the supporting member 270 in the CD direction (the Y-axis direction in FIGS. 26A-26C and 27A-27C) is designed so as to have a sufficient size to support the sheet, and therefore the sheet stands by while being supported by the upper surface of the supporting member 270.

When the supporting member 270 retracts from the upper position on the first tray 200, the base part 277 retracts from under the arm part 294 of the dropping member 290, as shown in FIGS. 26C and 27C. As a result, the front end part 292 of the dropping member 290 becomes unsupported, and accordingly the dropping member 290 pivots about the shaft penetrating the base part 291 owing to its own weight, and moves the front end part 292 downward so as to be close to the placement surface of the first tray 200. In this way, the dropping member 290 switches from the pre-stack orientation to an orientation according to which the front end part 292 is floated close to the placement surface of the first tray 200. This orientation of the dropping member 290 after switching is hereinafter referred to as a post-stack orientation.

A sheet stack, which is supported by the pre-stack mechanism and thereby stands by, becomes unsupported due to retraction of the supporting member 270, and as a result falls into the placement surface of the first tray 200. Here, since the dropping member 290 switches from the pre-stack orientation to the post-stack orientation, the sheet stack receives load from the front end part 292 of the dropping member 290, and as a result is pushed down onto the placement surface of the first tray 200. In this way, the formation of the pre-stack mechanism is forcibly released by the dropping member 290, and the sheet stack falls into the placement surface. Accordingly, the sheet stack promptly moves to the placement surface of the first tray 200. Further, the load received by the sheet stack from the dropping member 290 is sufficiently larger than air resistance while the sheet stack is falling. Therefore, the sheet stack is certainly stored, without deviation, in an appropriate position on the first tray 200, specifically, inside a region on the placement surface of the first tray 200, which is surrounded by the alignment members 221 and 222, the push-out member 260, and the first conveyance member 231.

When the supporting member 270 retracts from the upper position on the first tray 200 and then returns to the upper position, the front end part 272 rotates upward due to contact between the tapered part 276 and the housing 202 of the post-processing device 150, and inclines obliquely upward with respect to the upper surface of the base part 273, as shown in FIGS. 26C and 27C. On the other hand, the dropping member 290 keeps in the post-stack orientation. Especially, the arm part 294 of the dropping member 290 is positioned at the same height as an oblique surface of the tapered part 276 of the supporting member 270 in the normal direction of the placement surface of the first tray 200. Therefore, when the supporting member 270 becomes close to the dropping member 290, the oblique surface of the tapered part 276 contacts the front end of the arm part 294. The oblique surface of the tapered part 276 becomes higher in position toward a direction (the negative direction on the Y-axis) inverse to the direction in which the supporting member 270 moves. Accordingly, as the supporting member 270 moves, the roller 295, which is attached to the front end of the arm part 294, rolls over the oblique surface from bottom to up. Here, the dropping member 290 pivots upward due to an upward force applied to the arm part 294 from the oblique surface. In this way, the supporting member 270 moves while pushing up the dropping member 290, and places the arm part 294 on the top of the tapered part 276, as shown in FIGS. 26A and 27A. As a result, the dropping member 290 restores from the post-stack orientation to the guide orientation by a time when the supporting member 270 returns to the upper position on the first tray 200.

Figure 28:
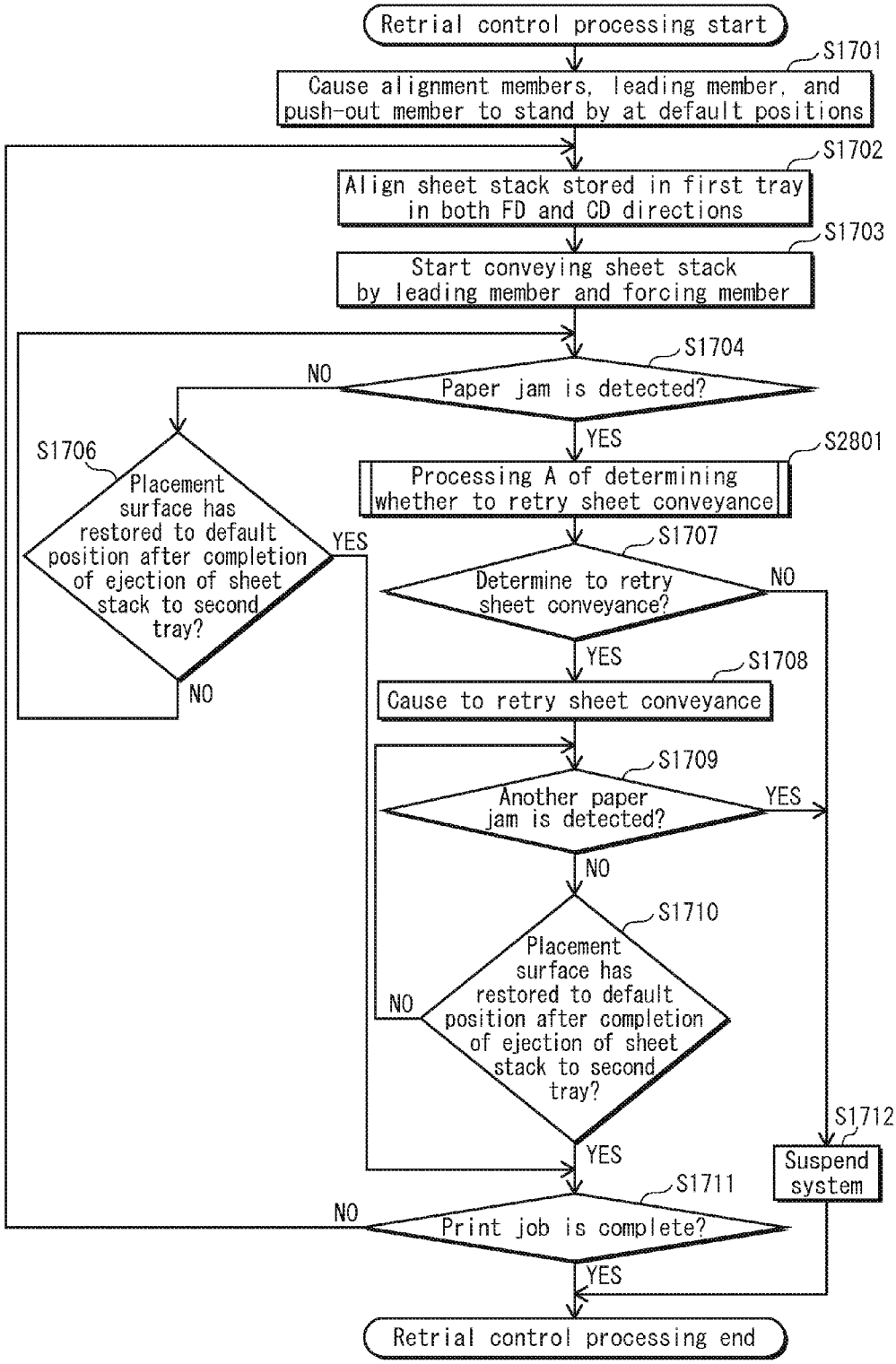
FIG. 28 is a flow chart of a modification of operations of retrial control processing performed by a second control unit included in a post-processing device 150A.

Next, FIG. 28 is a flow chart of operations of retrial control processing performed by the second control unit 300 included in the post-processing device 150A. The operations are the same as the operations of the retrial control processing in the above embodiment shown in FIG. 17, excepting the operations of the processing A of determining whether to retry sheet conveyance (Step S2801). Accordingly, the same step numbers of the processing in FIG. 17 are appended to processing in FIG. 28 excepting the processing A of determining whether to retry sheet conveyance, and explanation thereof is omitted. The following explains the operations of the processing A of determining whether to retry sheet conveyance.

Figure 29:
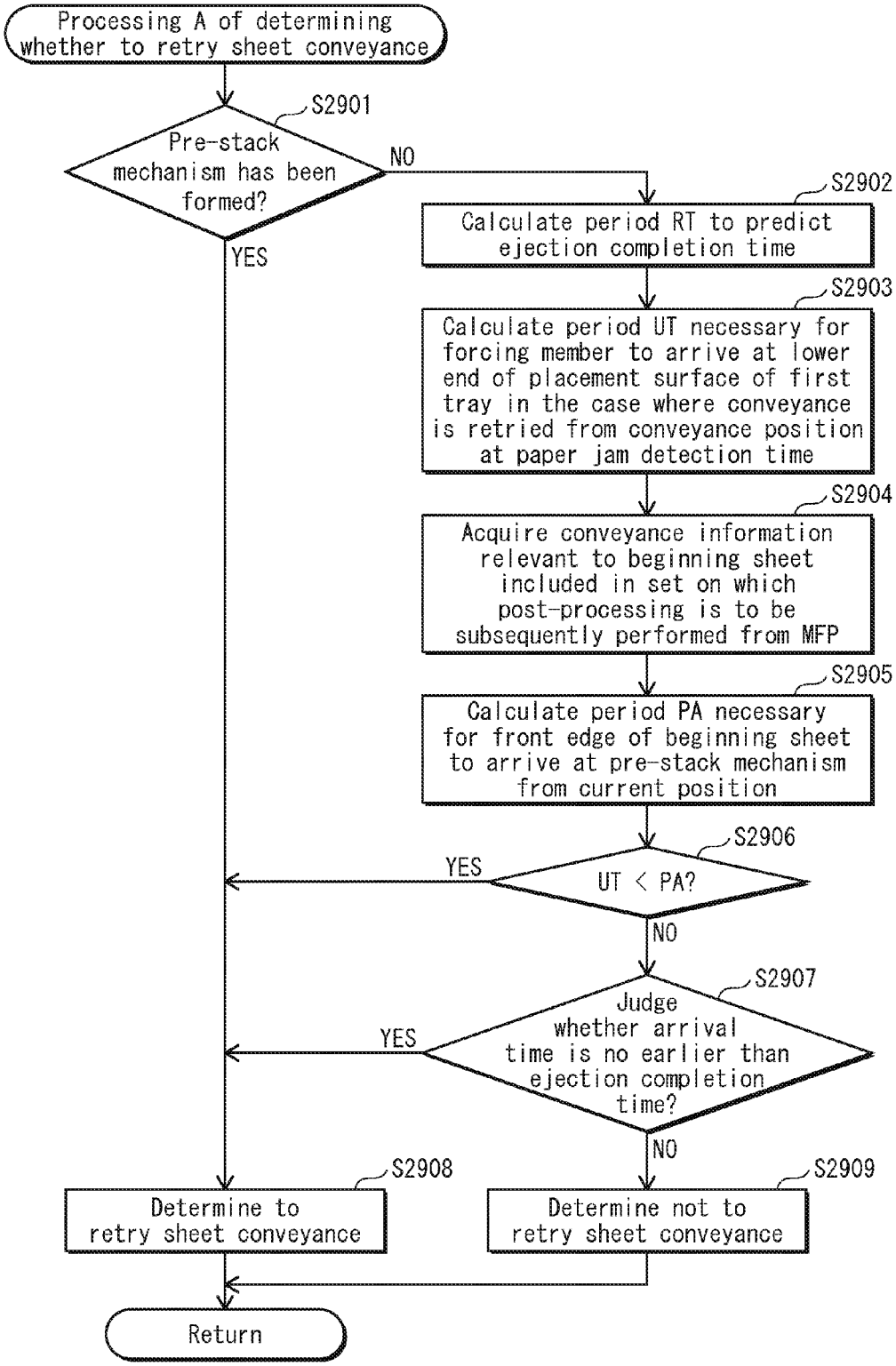
FIG. 29 is a flow chart of operations of processing A of determining whether to retry sheet conveyance.

FIG. 29 is a flow chart of the operations mentioned above. In Step S2901, the second control unit 300 judges whether the forcing member 232 has arrived at the lower end LEG of the placement surface of the first tray and the pre-stack mechanism has been formed, based on a monitoring result of output from the sheet rear edge sensor 370A.

Then, when judging that the pre-stack mechanism has been formed (Step S2901: YES), the second control unit 300 judges that conveyance standby of the beginning sheet included in a set on which post-processing is to be subsequently performed is possible, and determines to retry to convey a sheet stack in which a paper jam is detected (Step S2908). When judging that the pre-stack mechanism has not been formed (Step S2901: NO), the second control unit 300 proceeds to Step S2902.

In Step S2902, the second control unit 300 calculates a retrial ejection completion period RT to predict an ejection completion time. Further, the second control unit 300 subsequently proceeds to Steps S2903, 2904, and 2905.

In Step S2903, the second control unit 300 calculates a period (UT). The period UT is, in the case where conveyance of the sheet stack is retried from a conveyance position of the sheet stack at the paper jam detection time, a period that is necessary for that the sheet stack is conveyed in the FD direction and the forcing member 232 moves to arrive at the lower end LEG of the placement surface of the first tray 200.

The period UT is calculated from the following calculation formula, where a movement distance of the forcing member 232 from the retraction position HM2 calculated in the retrial preparation processing to the position at the paper jam detection time is expressed as M1, and a distance from the retraction position HM2 to the lower end LEG is expressed as HL0. Here, the distance HL0 is stored beforehand in the ROM 303.

$$UT=(HL0-M1)/FS0$$

In the above calculation formula, the definition of FS0 is the same as the definition of FS0 used in the processing of determining whether to retry sheet conveyance in FIG. 17. In other words, the value FS0 indicates the average conveyance speed in the FD direction.

In Step S2904, the second control unit 300 requests, through the second the communication unit 380, the first control unit 60 for conveyance information relevant to a beginning sheet included in a set which post-processing is to be performed subsequently to the sheet stack in which the paper jam is detected, and acquires the conveyance information from the MFP 100.

Here, only a period AR is acquired as the conveyance information.

In Step S2905, the second control unit 300 calculates a period (PA) necessary for the front edge of the beginning sheet to arrive at the pre-stack mechanism from the current position of the front edge, with use of the acquired period AR.

Specifically, the second control unit 300 determines beforehand a period (β) elapsed until the front edge of the sheet, which is ejected from the MFP 100 to the paper ejection outlet 42, arrives at the pre-stack mechanism, by a test and so on. The second control unit 300 stores the period β in the ROM 303 beforehand, and sets a period (AR+β) as the period AR.

Note that the period β is determined with consideration for a necessary period until the pre-stack mechanism is formed after the forcing member 232 arrives at the lower end LEG of the placement surface of the first tray 200.

After performing the processing in Step S2905, the second control unit 300 judges whether the period UT is shorter than the period PA (Step S2906). When judging that the period UT is shorter than the period PA (Step S2906: YES), the second control unit 300 judges that conveyance standby of the beginning sheet included in a set on which post-processing is to be subsequently performed is possible, and proceeds to Step S2908. When judging that the period UT is not shorter than the period PA (Step S2906: NO), the second control unit 300 judges that conveyance standby of the beginning sheet included in the set on which the post-processing is to be performed subsequently is impossible, and proceeds to Step S2907.

In Step S2907, the second control unit 300 predicts an arrival time based on the period AR acquired as the conveyance information, and judges whether the arrival time is no earlier than the ejection completion time. In the case where the period AR is equal to or longer than the retrial ejection completion period RT and the arrival time is no earlier than the ejection completion time (Step S2907: YES), the second control unit 300 proceeds to Step S2908. In the case where the period AR is shorter than the retrial ejection completion period RT and the arrival time is earlier than the ejection completion time (Step S2907: NO), the second control unit 300 proceeds to Step S2909.

In Step S2909, the second control unit 300 determines not to retry to convey the sheet stack in which the paper jam is detected.

As a result, in the case where the guide member 280 at the paper jam detection time is either in the state where the beginning sheet included in a set on which the post-processing is to be subsequently performed is able to be guided to the supporting member 270 by the guide member 280 (the state where the pre-stack mechanism has been formed at the detection time), or in the state where the beginning sheet will be able to be guided to the supporting member 270 by the guide member 280 (the state where in the case where retrial is started from the detection time, the pre-stack mechanism should be formed by a time when the front edge of the beginning sheet arrives at the pre-stack mechanism to be formed), it is possible to guide the beginning sheet to the pre-stack mechanism to be temporarily stored (stood by). Therefore, even in the case where the arrival time is earlier than the ejection completion time, sheet conveyance is retried without delay of an image forming processing. This increases the number of retrial times during a print job without deterioration of the productivity of print processing, thereby further reducing burden imposed on the user for removing the jammed papers.

Figure 30:
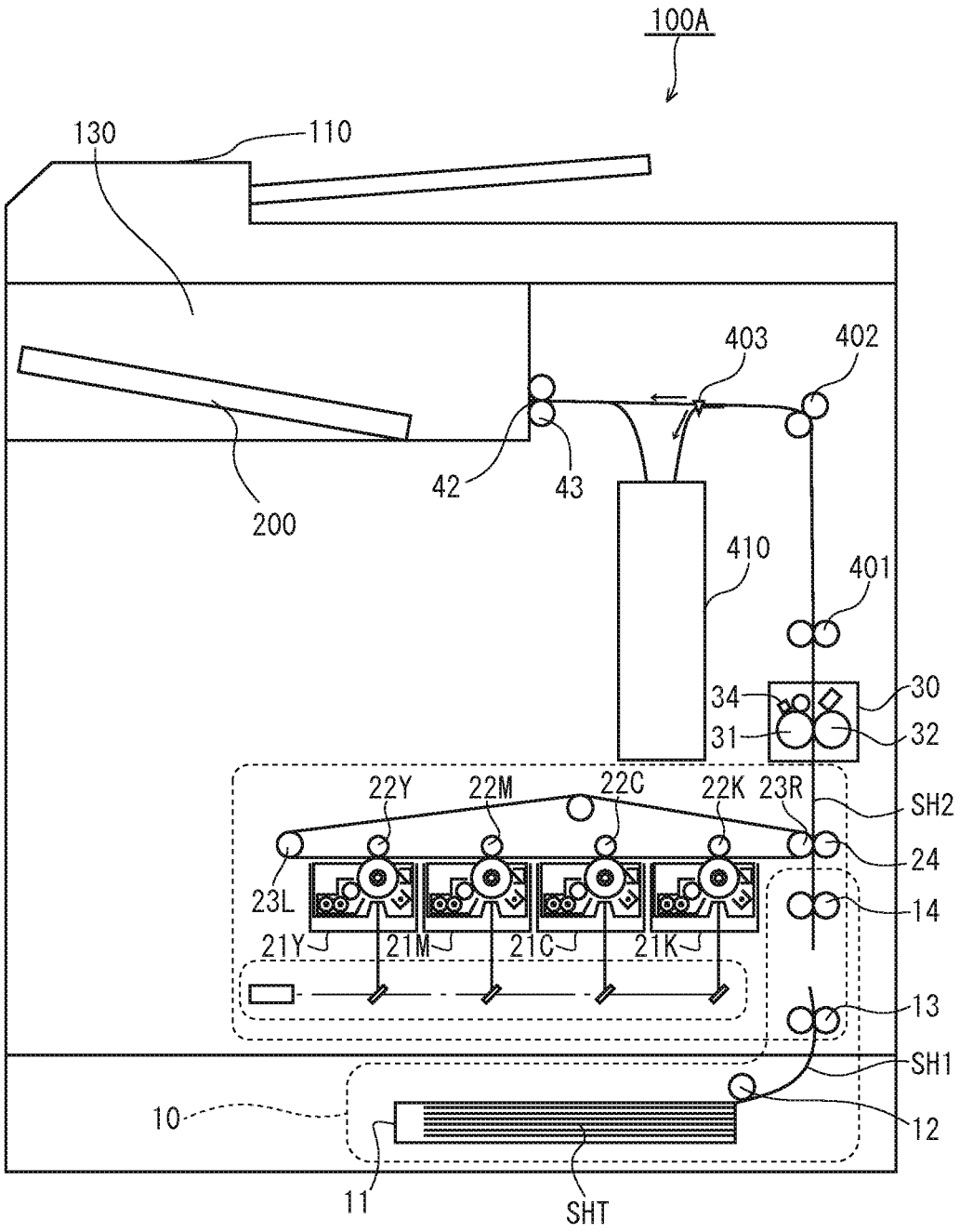
FIG. 30 is a front view schematically showing internal configuration of a modification of an MFP 100 (an MFP 100A)

(2) In the modification (1), the pre-stack mechanism is disposed in the post-processing device. Alternatively, the pre-stack mechanism may be disposed in the MFP. As shown in FIG. 30, a pre-stack mechanism 410 may be for example disposed on a conveyance path from the fixing unit 30 to the pair of ejection rollers 43.

FIG. 30 is a front view schematically showing internal configuration of a modification (an MFP 100A) of the MFP 100 relating to the above embodiment. In the figure, the same elements as those included in the MFP 100 in FIG. 2 have the same reference numbers appended thereto, and explanation thereof is omitted. The following explains mainly different points from the MFP 100.

As shown in FIG. 30, the MFP 100A includes the pre-stack mechanism 410, a switching member 403, and a pair of conveyance rollers 401 and 402. The switching member 403 switches a conveyance path of sheets ejected from the fixing unit 30 between a conveyance path to the pair of ejection rollers 43 and a conveyance path to the pre-stack mechanism 410. The pair of conveyance rollers 401 and 402 convey the sheets, which are ejected from the fixing unit 30, to the switching member 403.

The first control unit 60 included in the MFP 100A controls the switching member 403 to guide the sheets, which are ejected from the fixing unit 30, to one of the conveyance paths. Also, a paper pass sensor, which is not shown in the figure, is disposed in the vicinity of the upstream side with respect to the switching member 403 in the conveyance direction. The paper pass sensor detects that the front edge of a sheet has been conveyed to the switching member 403. The paper pass sensor is an optical sensor that detects the front edge of the sheet conveyed from the pair of conveyance rollers 402 has arrived at the switching member 403.

Here, the first control unit 60 included in the MFP 100A acquires information indicating whether the front edge of the sheet is positioned upstream with respect to the switching member 403 in the conveyance direction. The first control unit 60 notifies, through the first communication unit 80, the second control unit 300 included in the post-processing device 150 of the acquired information and a period AR as conveyance information.

The pre-stack mechanism 404 may be a known sheet storage mechanism. For example, the pre-stack mechanism may be employed, which is described in Patent Literature (Japanese Patent Application Publication No. 2005-324933), paragraphs 0040-0067 and FIGS. 3-12.

Figure 31:
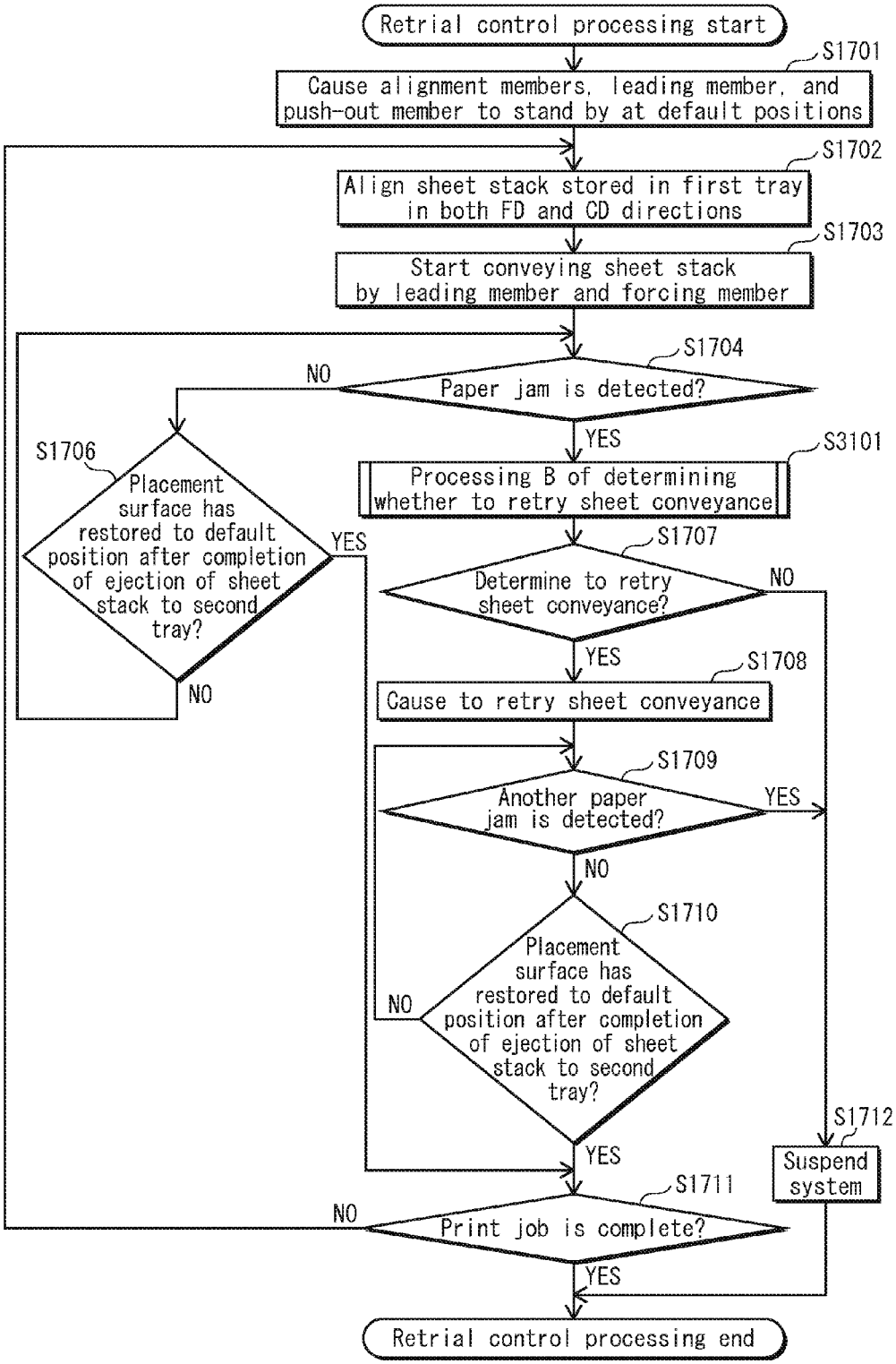
FIG. 31 is a flow chart of another modification of the operations of the retrial control processing.

FIG. 31 is a flow chart of operations of retrial control processing in the present modification. The operations are the same as the operations of the retrial control processing in the above embodiment shown in FIG. 17, excepting the operations of the processing B of determining whether to retry sheet conveyance. Accordingly, the same step numbers of the processing in FIG. 17 are appended to processing in FIG. 31 excepting the processing B of determining whether to retry sheet conveyance, and explanation thereof is omitted. The following explains the operations of the processing B of determining whether to retry sheet conveyance.

Figure 32:
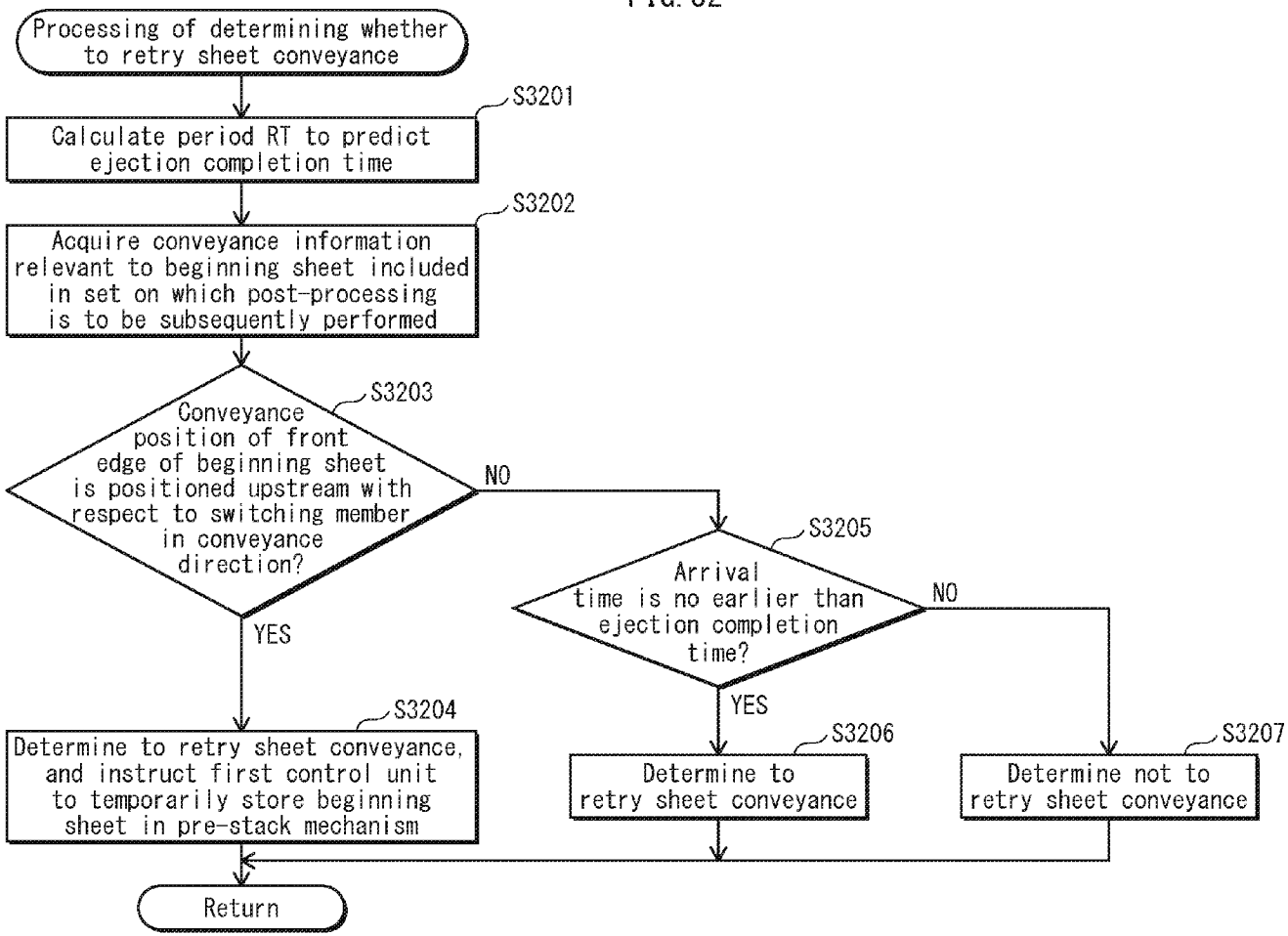
FIG. 32 is a flow chart of operations of processing B of determining whether to retry sheet conveyance.

FIG. 32 is a flow chart of the operations. In Step S3201, the second control unit 300 calculates a retrial ejection completion period RT to predict an ejection completion time. Then, the second control unit 300 proceeds to Step S3202.

In Step S3202, the second control unit 300 requests, through the second communication unit 380, the first control unit 60 included in the MFP 100A for conveyance information relevant to a beginning sheet included in a set on which post-processing is to be performed subsequently to a sheet stack in which a paper jam is detected, and acquires the conveyance information from the MFP 100A. Then, the processing proceeds to Step S3203.

In Step S3203, the second control unit 300 judges, based on the acquired conveyance information, whether a conveyance position of the front edge of the beginning sheet is positioned upstream with respect to the switching member 403 in the conveyance direction. In the case where the conveyance position is positioned upstream with respect to the switching member 403 in the conveyance direction (Step S3203: YES), the second control unit 300 judges that conveyance standby of the beginning sheet is possible, and determines to retry to convey the sheet stack in which the paper jam is detected. Then, the second control unit 300 instructs, through the second communication unit 380, the first control unit 60 included in the MFP 100A to temporarily store the beginning sheet in the pre-stack mechanism 404 (Step S3204). Here, on the side of the MFP 100A, the first control unit 60 controls, in accordance with the instruction, the switching member 403 to switch the conveyance path of the beginning sheet to the conveyance path to the pre-stack mechanism, and guides the beginning sheet to the pre-stack mechanism 404.

Also, in the case where the conveyance position is not positioned upstream with respect to the switching member 403 in the conveyance direction (Step S3203: NO), the second control unit 300 proceeds to Step S3205.

In Step S3205, the second control unit 300 predicts an arrival time from a period AR acquired as the conveyance information, and judges whether the arrival time is no earlier than the ejection completion time. In the case where the period AR is equal to or longer than the retrial ejection completion period RT and the arrival time is no earlier than the ejection completion time (Step S3205: YES), the second control unit 300 determines to retry to convey the sheet stack in which the paper jam is detected (Step S3206). In the case where the period AR is shorter than the retrial ejection completion period RT and the arrival time is earlier than the ejection completion time (Step S3205: NO), the second control unit 300 determines not to retry to convey the sheet stack in which the paper jam is detected (Step S3207).

As a result, similarly to in the modification (1), as long as a time when a paper jam is detected is no later than a time when the front edge of the beginning sheet included in a set on which post-processing is to be subsequently performed and guide of the beginning sheet to the pre-stack mechanism is possible, even in the case where the arrival time is earlier than the ejection completion time, sheet conveyance can be retried without delay of image forming processing. This increases the number of retrial times during a print job without deterioration of the productivity of print processing, thereby further reducing burden imposed on the user for removing jammed papers.

(3) In the above embodiment, conveyance is retried with use of both the leading member 231 and the forcing member 232. Alternatively, conveyance may be retried with use of only either one of the leading member 231 and the forcing member 232, depending on the number of sheets on which post-processing is to be performed or the thickness (basis weight) of each of the sheets.

Specifically, the following configuration may be employed. The second control unit 300 acquires, as control information, the number of sheets on which post-processing is to be performed from the MFP 100 (the first control unit 60) or a basis weight of each of the sheets. In the case where the number of sheets or the basis weight of each sheet is equal to or less than a corresponding threshold value, the second control unit 300 controls the conveyance unit 320 to retract only one of the members (for example, the leading member 231) to the retraction position HM1 without retracting the other member (for example, the forcing member 232) to the retraction position HM2, and use the one member to retry to convey a sheet stack in which a paper jam is detected in the FD direction from a position at a paper jam detection time.

As a result, it is possible to start the retrial without retracting the conveyance member (here, the forcing member 232) to the retraction position, thereby promptly performing retrial operations.

(4) In the above embodiment and the modifications (1)-(3), the retrial ejection completion period RT is calculated with consideration for the period R0 until the placement surface restores to the default position as a result of pivot of the first tray 200 about the support shaft 201. Alternatively, the following period may be calculated as the retrial ejection completion period RT, without consideration for the period R0: a period necessary for a sheet stack in which a paper jam is detected to be completely ejected to the second tray 210 after conveyance retrial is started. Even in this case, it is possible to retry to convey the sheet stack while preventing occurrence of another paper jam due to contact between the sheet stack under the retrial and the beginning sheet of a subsequent set.

However, in the case where the beginning sheet included in a set on which post-processing is to be subsequently performed is ejected through the paper ejection outlet 42 during operations of restoration to the default position, the sheet might not be appropriately stored in the post-processing device. Accordingly, in the case where a post-processing device has configuration in which a placement surface pivots during post-processing operations like the post-processing device in the above embodiment and the modifications (1)-(3), it is desirable to calculate the retrial ejection completion period RT with consideration for the period R0 and determine whether to retry sheet conveyance using the retrial ejection completion period RT.

On the other hand, according to a post-processing device that has configuration in which the restoration operation as above do not need to be performed after completion of ejection of the sheet stack on which the post-processing has been performed, it is possible to calculate, as the retrial ejection completion period RT, a period necessary for a sheet stack in which a paper jam is detected to be completely ejected after conveyance retrial is started.

(5) In the above embodiment, processing of determining whether to retry sheet conveyance is performed after retrial preparation processing. Alternatively, the processing of determining whether to retry sheet conveyance may be performed during the retrial preparation processing.

For example, when the conveyance members for conveying sheet stacks (the leading member 231, the forcing member 232, and the push-out member 260) move to the respective the retraction positions after detection of a paper jam, the processing of determining whether to retry sheet conveyance may be performed.

In this case, instead of using the retrial ejection completion period RT used in the above embodiment, the processing of determining whether to retry sheet conveyance may be performed with use of a retrial ejection completion period RT that is calculated by adding, to the retrial ejection completion period RT used in the above embodiment, a movement period necessary for the conveyance members to move between the retraction position and the position at the paper jam detection time.

For example, in the case where a paper jam occurs during conveyance of a sheet stack in the FD direction, when the leading member 231 moves to the retraction position, the processing of determining whether to retry sheet conveyance may be started. In this case, instead of using the retrial ejection completion period RT used in the above embodiment, the processing of determining whether to retry sheet conveyance may be performed with use of a retrial ejection completion period RT that is calculated by adding, to the retrial ejection completion period RT used in the above embodiment, a movement period necessary for the leading member 231 move to the position at the paper jam detection time and a movement period necessary for the forcing member 232 to move between the retraction position and the position at the paper jam detection time.

(6) In the above embodiment and the modifications (1)-(5), the retrial control processing is applied to the image forming system including the MFP which is of the desktop type and the in-body paper ejection type. However, the image forming system to which the retrial control processing is applicable is of course not limited to the image forming system including the above MFP. The above retrial control processing is applicable to any type of image forming system as long as the image forming system has configuration in which a sheet included in a set, which is ejected from the image forming apparatus and on which post-processing is to be performed, is stored in the storage tray of the post-processing device, and then is conveyed to a post-processing position on the storage tray, post-processing is performed on the sheet, and a sheet stack on which the post-processing has been performed is ejected from the storage tray to the ejection unit.

(7) In the above embodiment, in the case where it is determined to retry sheet conveyance in the processing of determining whether to retry sheet conveyance, the same retrial operations are performed irrespective of the cause for a paper jam. However, since there are variety of causes for the paper jam, it may be possible to employ configuration in which the cause for the paper jam is guessed and conveyance is retried in a mode in accordance with the cause.

For example, the paper jam is estimated to be caused by buckling (folding or deflection) of a sheet or load excess of a sheet stack, in addition to shift of the position or orientation of a sheet.

Accordingly, it is unlikely to solve any paper jam by retrying to convey the sheet in a constant mode (driving force, speed, direction, and so on). In fact, in the case where a paper jam is caused by buckling of a sheet, simple repetition of conveyance of the sheet might promote the buckling. Also, in the case where a paper jam is caused by load excess of a sheet stack, the sheet stack sometimes cannot move by simply continuing to apply a constant force to the sheet stack.

Figure 42:
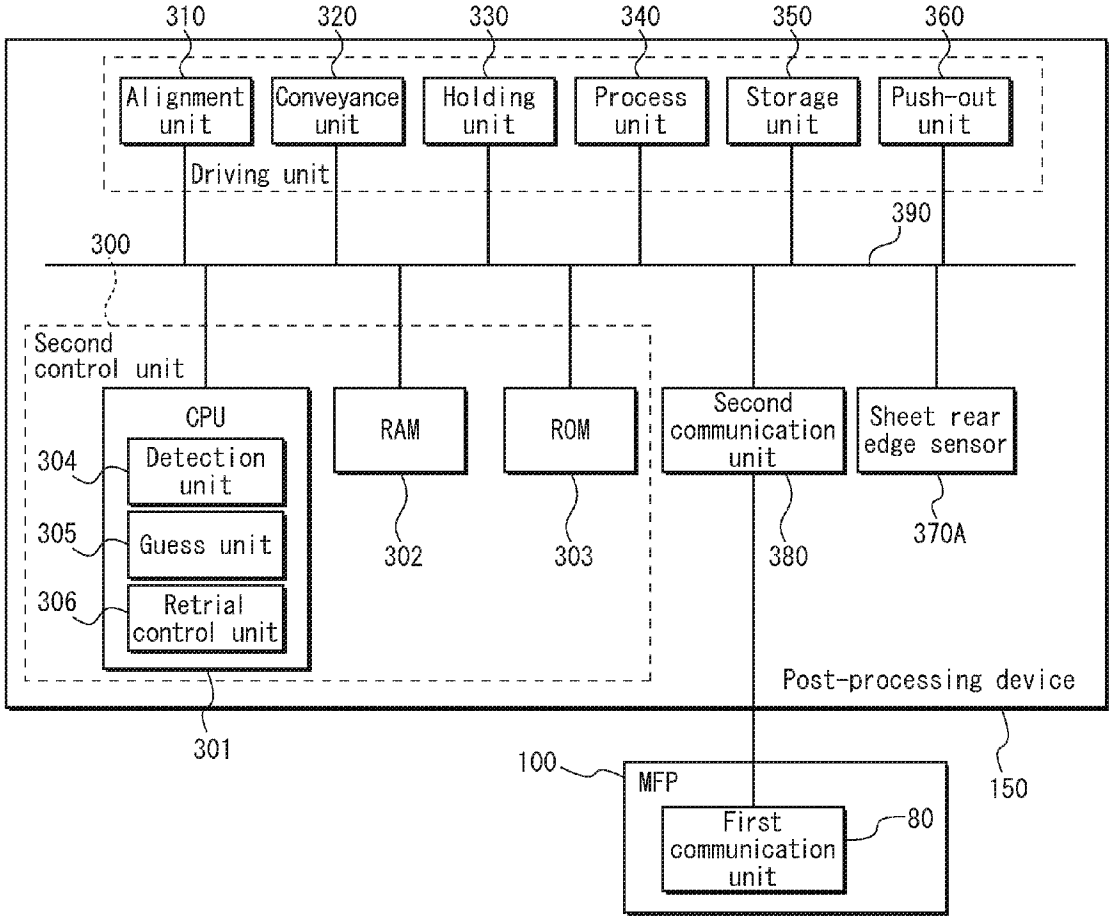
FIG. 42 is a block diagram of a modification of the configuration of the electronic control system of the post-processing device shown in FIG. 4.

The following explains the difference in <Retrial control on sheet conveyance> between an image forming system relating to the present modification and the image forming system relating to the above embodiment. In the present modification, the CPU 301 includes a guess unit 305 (see FIG. 42) in addition to the detection unit 304 and the retrial control unit 306 shown in FIG. 7.

When detecting a paper jam of a sheet, the detection unit 304 starts up the guess unit 305. The guess unit 305 measures a period necessary for the forcing member 232 to move from a position at a paper jam detection time to the retraction position HM2, and guesses the cause for the paper jam from the measured period. The retrial control unit 306 controls the conveyance unit 320 to retry to convey the sheet in a mode in accordance with the cause guessed by the guess unit 305.

—Guess Unit—

When being started up, the guess unit 305 first controls the conveyance unit 320 to move the leading member 231 and the forcing member 232 from the respective positions at a paper jam detection time to the respective retraction positions HM1 and HM2. Here, the guess unit 305 measures a period elapsed until the forcing member 232 has arrived at the retraction position HM2 after starting moving, based on notification transmitted from the conveyance unit 320.

The guess unit 305 guesses whether the paper jam is caused by either one of the following two types of causes, based on the measured elapsed period: (1) sheet buckling and (2) an insufficient conveyance force. Specifically, the guess unit 305 compares the elapsed period with a reference value. In the case where the elapsed period is equal to or greater than the reference value, the guess unit 305 guesses that the paper jam is caused by sheet buckling. In the case where the elapsed period is less than the reference value, the guess unit 305 guesses that the paper jam is caused by an insufficient conveyance force. The principle of the guess is described later.

—Retrial Control Unit—

The retrial control unit 306 controls the conveyance unit 320 to retry sheet conveyance. Here, the retrial control unit 306 especially selects a mode for the retrial in accordance with the cause for a paper jam guessed by the guess unit 305.

In the case where the cause for the paper jam is guessed as sheet buckling, the retrial control unit 306 first controls the conveyance unit 320 to push back the sheet by the leading member 231, and then convey the sheet only by the forcing member 232 while controlling the conveyance unit 320 to keep the leading member 231 standing by on the retraction position HM1.

In the case where the cause for the paper jam is guessed as the insufficient conveyance force, the retrial control unit 306 controls the conveyance unit 320 to increase the respective torques of the FD alignment motor and the FD conveyance motor, and convey the sheet by both the leading member 231 and the forcing member 232 under the same conditions as those in the normal state excepting these torques.

Especially in the case where the FD alignment motor and the FD conveyance motor are each a stepping motor, the retrial control unit 306 increases the respective torques of the FD alignment motor and the FD conveyance motor by increasing the pulse width of a driving signal to be applied to each of the FD alignment motor and the FD conveyance motor. With the increase of the torques, the respective rotation speeds of the motors decrease due to increase between the pulse intervals, and as a result a target speed of the sheet decreases. However, the target speed decreases only in the case where conveyance is retried due to the paper jam that is guessed to have been caused by the insufficient conveyance force. The target speed in the normal state may be set sufficiently high, and accordingly the post-processing period is maintained sufficiently short.

Next, explanation is given on the cause for a paper jam that can occur in the image forming system relating to the present modification and the principle of guessing the cause for the paper jam.

[Cause for Paper Jam that Occurs in Sheet Conveyed in FD Direction]

The cause for a paper jam, which can occur in a sheet which is conveyed on the first tray 200 in the FD direction by the leading member 231 and the forcing member 232, is broadly divided into the following two types of causes: (1) sheet buckling and (2) an insufficient conveyance force.

Sheet buckling indicates the state where folding or deflection occurs in the sheet due to the sheet continuing to move with the front edge thereof in the FD direction being caught in any structural object. In addition, the sheet buckling indicates the state where shift of the position of the sheet in the CD direction, shift of the orientation of the sheet in the FD direction, and distortion of a sheet stack including the sheet, which are caused by the front edge which is caught. The structural object, in which the front edge of the sheet can be caught, includes the grooves and concavo-convex portions generated in the placement surface of the first tray 200 such as the grooves 200C, 200D, 200E, and so on shown in FIG. 5 for guiding the push-out member 260, the space between the first tray 200 and the stapler 251, and the space between the first tray 200 and the housing 202. In the case where sheet buckling occurs, part of a force, which is applied to a sheet stack by the leading member 231 and the forcing member 232, distorts the sheet or the whole sheet stack, or increases a friction force generated by contact with a structural object other than the placement surface of the first tray 200 due to the distortion. This impairs a force of the leading member 231 and the forcing member 232 for moving the whole sheet stack in the FD direction, that is, a force for conveying the sheet stack, and as a result movement of the sheet stack delays and a paper jam occurs.

An insufficient conveyance force indicates the state where a conveyance force in the normal state is insufficient as a conveyance force for conveying the sheet stack due to load excess of a sheet stack on the first tray 200. Load excess of a sheet stack indicates the state where actual weight of the sheet stack exceeds a standard value estimated from the type of sheets, the size of sheets, and the number of pieces of sheets per set. Load excess occurs for example in the case where a lot of number of pieces of sheets per set is set and the actual weight of excessively most of the sheets each exceed the standard value. In this case, the friction force between the sheet stack and the first tray 200 considerably weakens a conveyance force for conveying the sheet stack. Accordingly, a conveyance force in the normal state, in other words, a driving force of the leading member 231 and the forcing member 232 in the normal state cannot increase speed of the sheet stack to the target speed, and as a result movement of the sheet stack delays and a paper jam occurs.

[Principle of Guessing Cause for Paper Jam]

In the case where the cause for a paper jam that occurs in a sheet, which is conveyed in the FD direction by the leading member 231 and the forcing member 232, is broadly divided into the two types of causes, namely sheet buckling and an insufficient conveyance force, a difference between the two types appears as a difference in position of the forcing member 232 at a paper jam detection time. Specifically, in the case where the cause is guessed as sheet buckling, a distance between the position of the forcing member 232 and the retraction position HM2 generally reaches or exceeds a distance necessary for accelerating the speed of the sheet to the target speed (hereinafter, referred to as an acceleration distance). In the case where the cause is guessed as an insufficient conveyance force, compared with this, the distance between the position of the forcing member 232 and the retraction position HM2 generally does not reach the acceleration distance. This is because of the following reason.

Generally, in the case where a sheet buckles, the rear edge of the sheet continues to advance while the front edge of the sheet is caught in any structural object until the sheet deforms to a certain degree. Accordingly, in most cases, even if the front edge of the sheet gets caught in any structural object just when the sheet starts being conveyed in the FD direction, the forcing member 232 continues to advance for a while after that. Especially, there is often the case where when a paper jam is detected, speed of the sheet (particularly the rear edge thereof) has already been accelerated to the target speed.

In the case where a conveyance force is insufficient, on the other hand, the leading member 231 and the forcing member 232 cannot accelerate the speed of the sheet stack to the target speed. Especially, in most cases, the movement distance from the retraction position HM2 of the forcing member 232 does not reach the acceleration distance even after a period elapsed since the forcing member 232 has started advancing reaches the threshold value for paper jam detection.

For this reason, in the case where the forcing member 232 has advanced from the retraction position HM2 by the acceleration distance or longer at a paper jam detection time, the cause for the paper jam is guessed as sheet budding. In the case where the forcing member 232 has not advanced from the retraction position HM2 by the acceleration distance or longer at the paper jam detection time, the cause for the paper jam is guessed as an insufficient conveyance force.

When the forcing member 232 retracts from an arbitrary position to the retraction position HM2 at a constant speed, the position of the forcing member 232 is proportional to a period necessary for the forcing member 232 move from the arbitrary position to the retraction position HM2. The guess unit 305 measures a period elapsed until the forcing member 232 moves to the retraction position HM2 from the position at the paper jam detection time. On the other hand, a period necessary for the forcing member 232 to move by a distance equal to the acceleration distance is set as the reference value. Therefore, in the case where the elapsed period is equal to or greater than the reference value, the guess unit 305 guesses that the cause for the paper jam is sheet buckling. In the case where the elapsed period is less than the reference value, the guess unit 305 guesses that the cause for the paper jam is an insufficient conveyance force.

Next, explanation is given on operations in detection of a paper jam in the present modification.

[Operations in Detection of Paper Jam]

Operations in detection of paper jam in the present modification are the same as those during conveyance in the FD direction in the above embodiment. In the case where the rear edge REE of the sheet stack STK does not arrive at the lower end LEG of the placement surface, the detection unit 304 judges that a paper jam has occurred, and starts up the guess unit 305.

—Case where Cause for Paper Jam is Guessed as Sheet Buckling—

FIGS. 33A-33E are schematic partial cross-sectional views of the first tray 200 showing retrial operations in stages in the case where a paper jam is caused by sheet buckling.

Figure 33A:
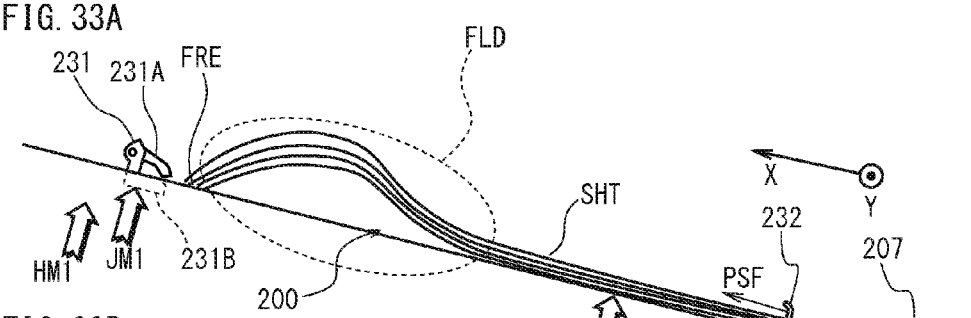
FIG. 33A is a schematic partial cross-sectional view of the first tray showing retrial operations in stages in the case where a paper jam is caused by sheet buckling, specifically showing the state at a time when a paper jam has been detected.

FIG. 33A shows the state at a paper jam detection time. Referring to FIG. 33A, a folding FLD occurs in the front edge part of the sheet SHT due to that the front edge FRE of the sheet SHT is caught in the groove or the like of the placement surface of the first tray 200. Generally in this case, the leading member 231 cannot sufficiently sandwich the front edge FRE of the sheet SHT between the gripping claw 231A and the upper surface of the base part 231B, the leading member 231 cannot pull the front edge FRE of the sheet SHT by a sufficient force. On the other hand, a force PSF pushing the rear edge REE of the sheet SHT in the FD direction (the X-axis direction) is buffered by the folding FLD of the sheet SHT. In other words, the force PSF is prevented by a stress of the sheet SHT for restoring the folding FLD to the original shape. Accordingly, the forcing member 232 cannot push the rear edge REE of the sheet SHT by a sufficient force. This impairs a conveyance force for conveying the sheet SHT, and therefore the speed of the sheet SHT does not reach the target value. Accordingly, the rear edge REE of the sheet SHT does not arrive at the lower edge LEG of the placement surface even after a period elapsed since the forcing member 232 has left the retraction position HM2 reaches the threshold value. Therefore, the detection unit 304 starts up the guess unit 305. First, the guess unit 305 controls the conveyance unit 320 to move the leading member 231 and the forcing member 232 from the respective positions JM1 and JM2 at a paper jam detection time to the respective retraction positions HM1 and HM2.

Figure 33B:
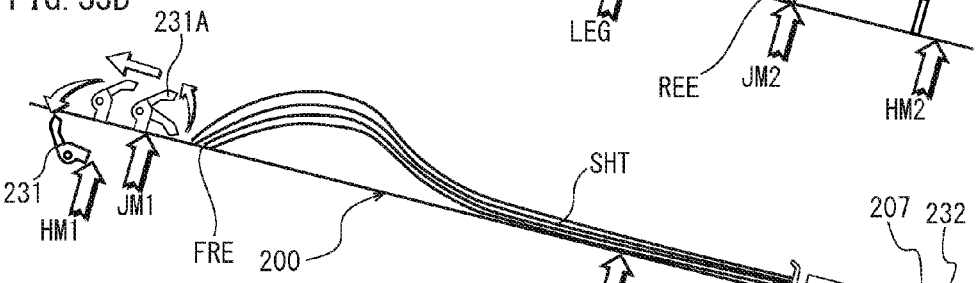
FIG. 33B is a schematic partial cross-sectional view of the first tray showing retrial operations in stages in the case where the paper jam is caused by sheet buckling, specifically showing the state at a time when a front edge conveyance member has retracted to a retraction position.

FIG. 33B shows the state at a time when the leading member 231 and the forcing member 232 have retracted to the respective retraction positions HM1 and HM2. The conveyance unit 320 notifies the guess unit 305 of a time when the leading member 231 and the forcing member 232 have started moving from the respective positions JM1 and JM2 at the paper jam detection time, respectively, and a time when the leading member 231 and the forcing member 232 have arrived at the respective retraction positions HM1 and HM2. The conveyance unit 320 regards the former time as for example a time when the FD alignment motor and the FD conveyance motor have been restarted up after detection of the paper jam, and regards the latter time as for example a time when the respective position sensors disposed on the retraction positions HM1 and HM2 have detected the leading member 231 and the forcing member 232, respectively. Based on the notification transmitted from the conveyance unit 320, the guess unit 305 calculates a period necessary for the leading member 231 and the forcing member 232 to move from the positions JM1 and JM2 at the paper jam detection time to the respective retraction positions HM1 and HM2, for example from the number of pulses or rotations of the driving signal of the FD alignment motor and the FD conveyance motor.

Further, the guess unit 305 compares the reference value with the period necessary for the forcing member 232 to move from the position JM2 at the paper jam detection time to the retraction position HM2. In the example shown in FIG. 33A, since a distance between the position JM2 of the forcing member 232 at the paper jam detection time and the retraction position HM2 is equal to or longer than the acceleration distance, the period measured by the guess unit 305 is equal to or greater than the reference value. Therefore, the guess unit 305 guesses the cause for the paper jam as sheet buckling.

In accordance with this guess, the retrial control unit 306 instructs the conveyance unit 320 to retry sheet conveyance in a mode for a sheet in which buckling occurs. In the retrial in this mode, the retrial control unit 306 controls the conveyance unit 320 to cause the leading member 231 to push back the sheet SHT to release catching of the front edge FRE of the sheet SHT.

Figure 33C:
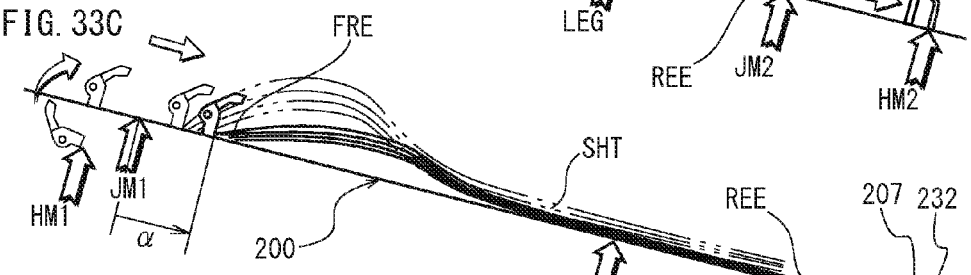
FIG. 33C is a schematic partial cross-sectional view of the first tray showing retrial operations in stages in the case where the paper jam is caused by sheet buckling, specifically showing the state at a time when the front edge conveyance member has pushed back the front edge of the sheet.

FIG. 33C shows the state at a time when the leading member 231 has pushed back the front edge FRE of the sheet SHT. Referring to FIG. 33C, the conveyance unit 320 moves the leading member 231 from the retraction position HM1 to a position that is forward from the position JM1 at the paper jam detection time by a predetermined distance α (hereinafter, referred to as a push-back distance α). Here, the driving period of the FD alignment motor (specifically, the number of pulses or rotations of the driving signal) is set by the retrial control unit 306 based on the period necessary for the leading member 231 to retract from the position JM1 at the paper jam detection time to the retraction position HM1 and the period necessary for the leading member 231 to move by the push-back distance α. Then, designation of the driving period is transmitted to the conveyance unit 320. The push-back distance α is set based on an average distance between the front edge FRE and the rear edge REE of the sheet SHT at a time when buckling such as a folding FLD occurs in the sheet SHT, such that the leading member 231, which has advanced from the retraction position HM1, contacts the front edge FRE of the sheet SHT and pushes back the front edge FRE by a certain level of force. Note that the average distance is obtained for example by experiments in advance. Catching of the front edge FRE of the sheet SHT is generally caused by movement of the sheet SHT in the FD direction. Accordingly, the catching is most likely to be released as a result of push-back of the front edge FRE in the inverse direction by the leading member 231.

Next, the retrial control unit 306 controls the conveyance unit 320 to retract the leading member 231 from the position, which is forward from the position JM1 at the paper jam detection time by the push-back distance α, to the retraction position HM1 again. Specifically, the conveyance unit 320 causes the leading member 231 to continue to recede until the position sensor, which is for example disposed on the retraction position HM1, detects the leading member 231.

Figure 33D:
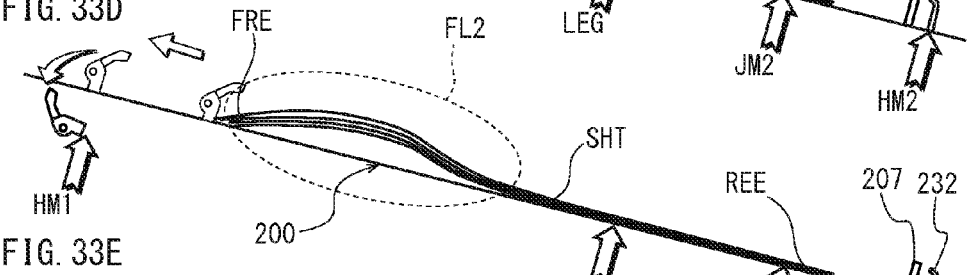
FIG. 33D is a schematic partial cross-sectional view of the first tray showing retrial operations in stages in the case where the paper jam is caused by sheet buckling, specifically showing the state at a time when the front edge conveyance member has retracted to the retraction position again.

FIG. 33D shows the state at a time when the leading member 231 has retracted to the retraction position HM1 again. Referring to FIG. 33D, the sheet SHT moves from the position at the paper jam detection time in a direction (the negative direction on the X-axis) inverse to the FD direction. Here, catching of the front edge FRE of the sheet SHT is generally released. A folding FL2 of the sheet SHT is loose compared with the folding FLD at the paper jam detection time shown in FIG. 33A. However, there is a high possibility that the leading member 231 can no longer sufficiently sandwich the front edge FRE of the sheet SHT between the gripping claw 231A and the upper surface of the base part 231B due to the folding FL2. Also, there is a high possibility that the position of the front edge FRE of the sheet SHT deviates from a position that is guessed from the size of the sheet SHT. For this reason, the retrial control unit 306 subsequently controls the conveyance unit 320 to convey the sheet SHT only by the forcing member 232 while controlling the conveyance unit to keep the leading member 231 standing by on the retraction position HM1.

Figure 33E:
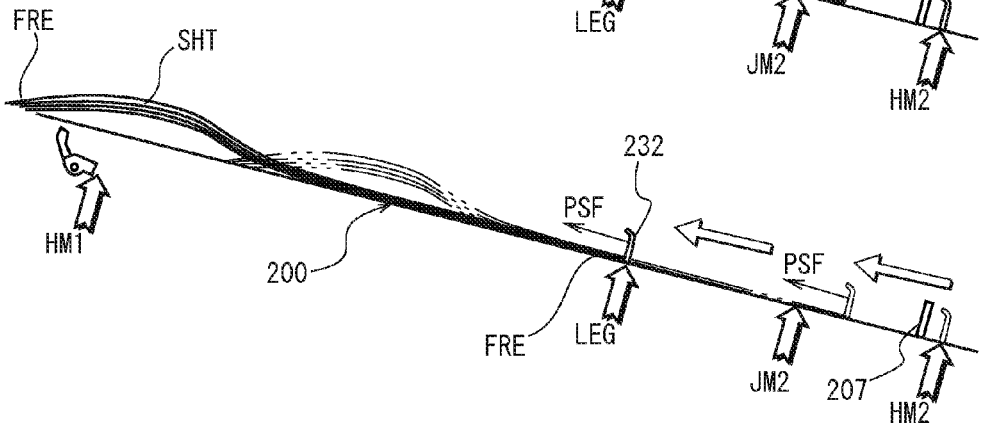
FIG. 33E is a schematic partial cross-sectional view of the first tray showing retrial operations in stages in the case where the paper jam is caused by sheet buckling, specifically showing the state at a time when only the rear edge conveyance member conveys the sheet while the front edge conveyance member stands by on the retraction position.

FIG. 33E shows the state at a time when only the forcing member 232 conveys the sheet SHT while the leading member 231 stands by on the retraction position HM1. Referring to FIG. 33E, the forcing member 232 advances from the retraction position HM2 at the speed as that in the normal state, contacts the rear edge REE of the sheet SHT, and then pushes the rear edge REE by the same force PSF as that in the normal state. When catching of the front edge FRE of the sheet SHT is released, the sheet SHT moves in the FD direction by the force PSF applied from the forcing member 232. During this movement, the detection unit 304 monitors whether the rear edge REE of the sheet SHT has arrived at the lower end LEG of the placement surface of the first tray 200. In the case where the rear edge REE of the sheet SHT arrives at the lower end LEG of the placement surface until the period elapsed since the forcing member 232 has left the retraction position HM2 reaches the threshold value, the detection unit 304 judges that conveyance retrial of the sheet SHT has succeeded. Since he leading member 231 is not used for conveying the sheet SHT, the threshold value in this case is set to be a value greater than that in the normal state. In the case where the retrial has succeeded, control of the post-processing device 150 returns to processing in the normal state. The processing is restarted with the operation of causing the first tray 200 to be horizontal as shown in FIG. 13.

—Case where Cause for Paper Jam is Guessed as Insufficient Conveyance Force—

FIGS. 34A-34D are schematic partial cross-sectional views of the first tray 200 showing retrial operations in stages in the case where a paper jam is caused by an insufficient conveyance force.

Figure 34A:
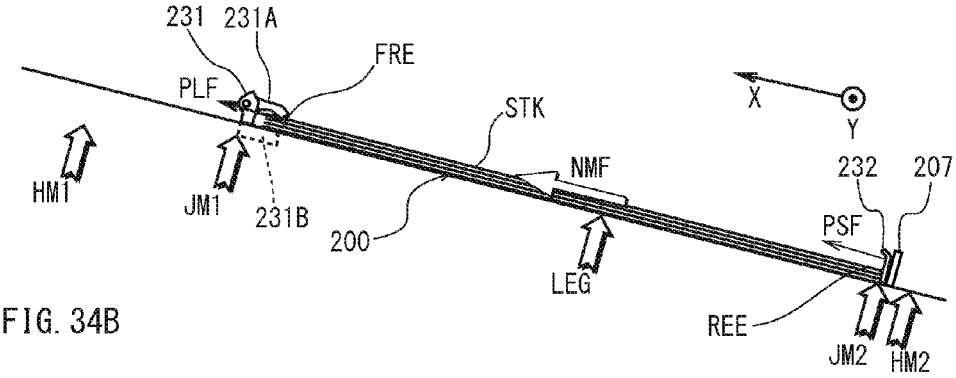
FIG. 34A is a schematic partial cross-sectional view of the first tray showing retrial operations in stages in the case where a paper jam is caused by an insufficient conveyance force, specifically showing the state at a time when a paper jam has been detected.

FIG. 34A shows the state at a time when the paper jam has been detected. Referring to FIG. 34A, the rear edge REE of the sheet stack STK is little separated from the lateral surface 207 of the lower end part of the housing 202 of the post-processing device 150. This is because of insufficiency of a conveyance force NMF for conveying the sheet stack STK due to load excess of the sheet stack STK. The conveyance force NMF is a resultant force of a force PLF of the leading member 231 for pulling the sheet stack STK and a force PSF of the forcing member 232 for pushing the sheet stack STK (NMF=PLF+PSF). In this case, the leading member 231 and the forcing member 232 cannot move the sheet stack STK even by taking a long time. Accordingly, the rear edge REE of the sheet STK does not arrive at the lower edge LEG of the placement surface even after a period elapsed since the forcing member 232 has left the retraction position HM2 reaches the threshold value. Therefore, the detection unit 304 starts up the guess unit 305. First, the guess unit 305 controls the conveyance unit 320 to move the leading member 231 and the forcing member 232 from the respective positions JM1 and JM2 at the paper jam detection time to the respective retraction positions HM1 and HM2.

Figure 34B:
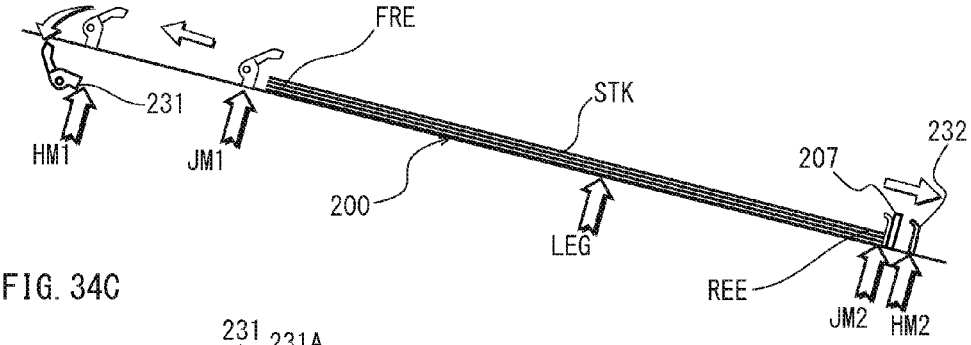
FIG. 34B is a schematic partial cross-sectional view of the first tray showing retrial operations in stages in the case where the paper jam is caused by the insufficient conveyance force, specifically showing the state at a time when the front edge conveyance member has retracted to the retraction position.

FIG. 34B shows the state at a time when the leading member 231 and the forcing member 232 have retracted to the respective retraction positions HM1 and HM2. The conveyance unit 320 notifies the guess unit 305 of a time when the leading member 231 and the forcing member 232 have started moving from the respective positions JM1 and JM2, and a time when the leading member 231 and the forcing member 232 have arrived at the respective retraction positions HM1 and HM2. Further, the guess unit 305 measures a period necessary for the forcing member 232 to move from the position JM2 at the paper jam detection time to the retraction position HM2, based on the notification. Further, the guess unit 305 compares the measured period with the reference value. In the example shown in FIG. 34A, since a distance between the position JM2 of the forcing member 232 at the paper jam detection time and the retraction position HM2 is shorter than the acceleration distance, the period measured by the guess unit 305 is less than the reference value. Therefore, the guess unit 305 guesses the cause for the paper jam as an insufficient conveyance force.

In accordance with this guess, the retrial control unit 306 instructs the conveyance unit 320 to retry sheet conveyance in a mode for a sheet that cannot be conveyed by the driving force NMF of the leading member 231 and the forcing member 232 in the normal state. In the retrial in this mode, the retrial control unit 306 controls the conveyance unit 320 to increase the respective torques of the FD alignment motor and the FD conveyance motor, and then convey the sheet stack STK by both the leading member 231 and the forcing member 232 under the same conditions as those in the normal state excepting these torques.

Figure 34C:
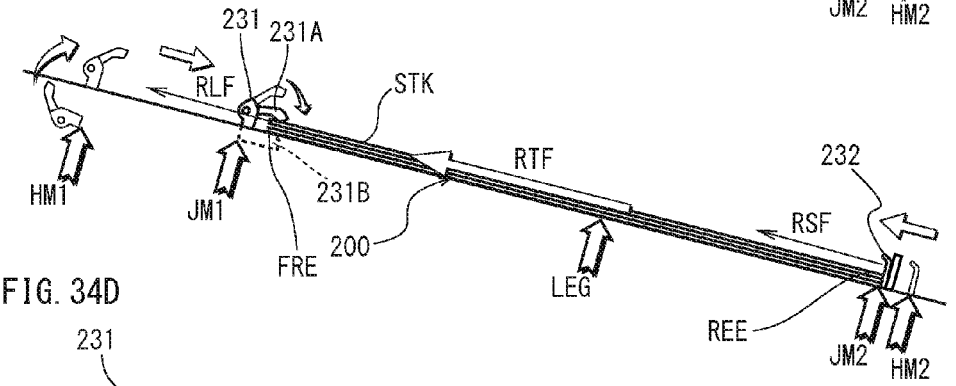
FIG. 34C is a schematic partial cross-sectional view of the first tray showing retrial operations in stages in the case where the paper jam is caused by the insufficient conveyance force, specifically showing the state at a time when the rear edge conveyance member has restored to the rear edge of a sheet stack after the front edge conveyance member has restored to the front edge of the sheet stack.

FIG. 34C shows the state at a time when the forcing member 232 has restored to the rear edge REE of the sheet stack STK after the leading member 231 has restored to the front edge FRE of the sheet stack STK. Referring to FIG. 34C, the conveyance unit 320 advances the leading member 231 from the retraction position HM1 to the position JM1 at the paper jam detection time to contact the front edge FRE of the sheet stack STK. Next, the conveyance unit 320 advances the forcing member 232 forward from the retraction position HM2 to the position JM2 at the paper jam detection time to contact the rear edge REE of the sheet stack STK. In conjunction with this, the gripping claw 231A of the leading member 231 is brought down to sandwich the front edge FRE of the sheet stack STK between the gripping claw 231A and the upper surface of the base part 231B of the leading member 231. When the forcing member 232 arrives at the lateral surface 207 of the lower end part of the housing 202, the retrial control unit 306 controls the conveyance unit 320 to cause the leading member 231 to recede at the same speed as that of the forcing member 232. Here, the respective torques of the FD alignment motor and the FD conveyance motor increase more than in the normal state, a force RLF of the leading member 231 for pulling the sheet stack STK and a force RSF of the forcing member 232 for pushing the sheet stack STK are greater than the force PLF and the force PSF in the normal state, respectively. In other words, a force RTF=PLF+PSF, which is applied to the sheet stack STK by the leading member 231 and the forcing member 232, is greater than the force NMF in the normal state.

Figure 34D:
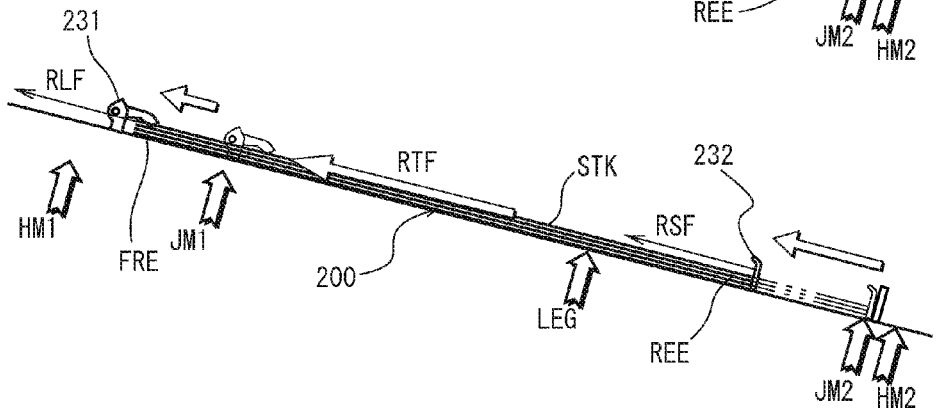
FIG. 34D is a schematic partial cross-sectional view of the first tray showing retrial operations in stages in the case where the paper jam is caused by the insufficient conveyance force, specifically showing the state at a time when the front edge conveyance member and the rear edge conveyance member convey the sheet stack in collaboration with each other.

FIG. 34D shows the state at a time when the leading member 231 and the forcing member 232 convey the sheet stack STK in collaboration with each other. Referring to FIG. 34D, the sheet stack STK is pulled up by the leading member 231 from the upper side in the FD direction, and is pushed up by the forcing member 232 from the lower side in the FD direction. Here, in the case where a force RTF, which is applied to the sheet stack STK by the leading member 231 and the forcing member 232, is sufficiently greater than a resistive force, which has increased by load excess of the sheet stack STK, the sheet stack STK is conveyed on the placement surface of the first tray 200 upward in the inclination direction while being sandwiched between the leading member 231 and the forcing member 232. During this movement, the detection unit 304 monitors whether the rear edge REE of the sheet stack STK has arrived at the lower end LEG of the placement surface of the first tray 200. In the case where the rear edge REE of the sheet STK arrives at the lower end LEG of the placement surface until the period elapsed since the forcing member 232 has left the retraction position HM2 reaches the threshold value for paper jam detection, the detection unit judges that conveyance retrial of the sheet STK has succeeded. Note that in the case where the FD alignment motor and the FD conveyance motor are each a stepping motor, the increase of the torques of the motors is equal to decrease of the target speed of the sheet from that in the normal state. Therefore, the threshold value is set greater than that in the normal state. However, the target speed decreases only in the case where conveyance is retried due to the paper jam that is guessed to have been caused by the insufficient conveyance force. Therefore, the post-processing period is maintained sufficiently short. In the case where the retrial has succeeded, control of the post-processing device 150 returns to processing in the normal state. The processing is restarted with the operation of horizontally pivoting the first tray 200 as shown in FIG. 13.

—Flow Chart of Post-Processing—

Figure 35:
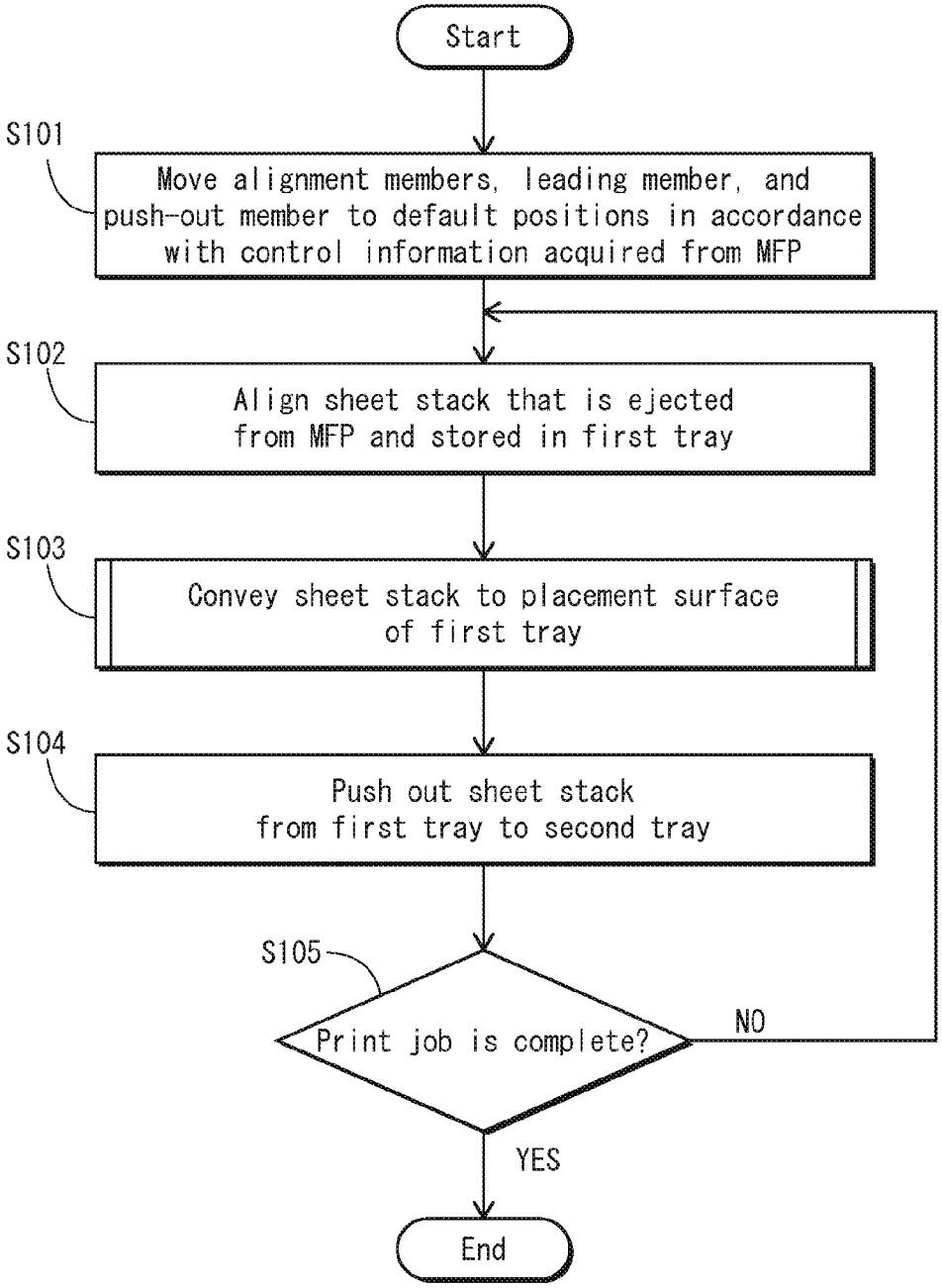
FIG. 35 is a flow chart of a modification of the post-processing.

FIG. 35 is a flow chart of post-processing in the present modification. This processing is started when the second control unit 300 included in the post-processing device 150 is notified of start of a print job by the first control unit 60 included in the MFP 100.

In Step S101, the second control unit 300 first acquires control information relevant to post-processing from the first control unit 60, and reads the size and orientation of sheets of one set of a sheet stack from the control information. Next, the second control unit 300 calculates respective default positions of the alignment members 221 and 222, the leading member 231, and the push-out member 260, and controls the alignment unit 310 to cause the members 221, 222, 231, and 260 to stand by at the respective default positions before a beginning sheet is ejected. Then, the processing proceeds to Step S102.

In Step S102, processing relevant to a sheet alignment operation shown in FIGS. 8 and 9 is performed. Specifically, in accordance with a pre-notification of sheet ejection transmitted from the first control unit 60, before start of ejection of a sheet through the paper ejection outlet 42 of the MFP 100, the second control unit 300 controls the alignment unit 310 to bring the alignment members 221 and 222, the leading member 231, and the push-out member 260 from the respective default positions close to the margin and the edge of the placement surface of the first tray 200. When the entire sheet is completely ejected to the outside of the paper ejection outlet 42, the second control unit 300 first controls the alignment unit 310 to move the leading member 231 toward the inside of the placement surface, and then move the alignment members 221 and 222 and the push-out member 260 toward the inside of the placement surface. As a result, the sheet is aligned by being sandwiched between these members. Then, the alignment unit 310 restores the members 221, 222, 231, and 260 to the respective original positions. Each time a new sheet is ejected, the above operations are repeatedly performed by these members 221, . . . , 260. In this way, one set of a sheet stack stored in the first tray 200 is aligned in both the FD direction and the CD direction. Then, the processing proceeds to Step S103.

In Step S103, processing is performed, which is relevant to sheet conveyance in the FD direction shown in FIGS. 10-12, 33A-33E, and 34A-34D. Specifically, when the sheet stack is stored in the first tray 200, the second control unit 300 controls the conveyance unit 320 to convey the sheet stack by moving the leading member 231 and the forcing member 232, while controlling the alignment unit 310 to hold the sheet stack by the alignment members 221 and 222 and the push-out member 260. The second control unit 300 further detects a paper jam through the sheet rear edge sensor 370A during conveyance of the sheet stack, and controls the conveyance unit 320 to retry sheet conveyance. The detailed flow on the processing relevant to conveyance is described later.

In the case where the control information acquired in Step S101 requests for staple processing of stapling the sheet stack by the stapler, the second control unit 300 controls the conveyance unit 320 to continue to move the leading member 231 and the forcing member 232 until the corner of the sheet stack arrives at a region between the clincher 250 and the stapler 251. When the corner of the sheet stack arrives at the region, the second control unit 300 controls the conveyance unit 320 to hold the sheet stack by the leading member 231 and the forcing member 232, and then controls the process unit 340 to drive the clincher 250 and the stapler 251 to staple the sheet stack. Then, the second control unit 300 controls the conveyance unit 320 to restart sheet conveyance.

When the entire sheet stack is placed on the placement surface of the first tray 200, the second control unit 300 controls the conveyance unit 320 to retract the leading member 231 from the placement surface, and controls the holding unit 330 to protrude the first holding members 241 and 242 or the second holding members 243 and 244 to hold the sheet stack therebetween. Then, the processing proceeds to Step S104.

In Step S104, the following processing is performed: processing relevant to a push-out operation of the sheet stack from the first tray 200 to the second tray 210 shown in FIGS. 13-15; and processing relevant to a restoration operation of the first tray 200 to the default position shown in FIG. 16. Then, the processing proceeds to Step S105.

In Step S105, the second control unit 300 compares the number of repetitions of Steps S102-104 with the number of target copies of a print job indicated by the control information. In the case where the number of repetitions has not yet reached the number of target copies, the print job is not complete. Accordingly, the processing is repeated from Step S102. In the case where the number of repetitions has already reached the number of target copies, the processing ends.

—Flow Chart of Processing Relevant to Conveyance—

Figure 36:
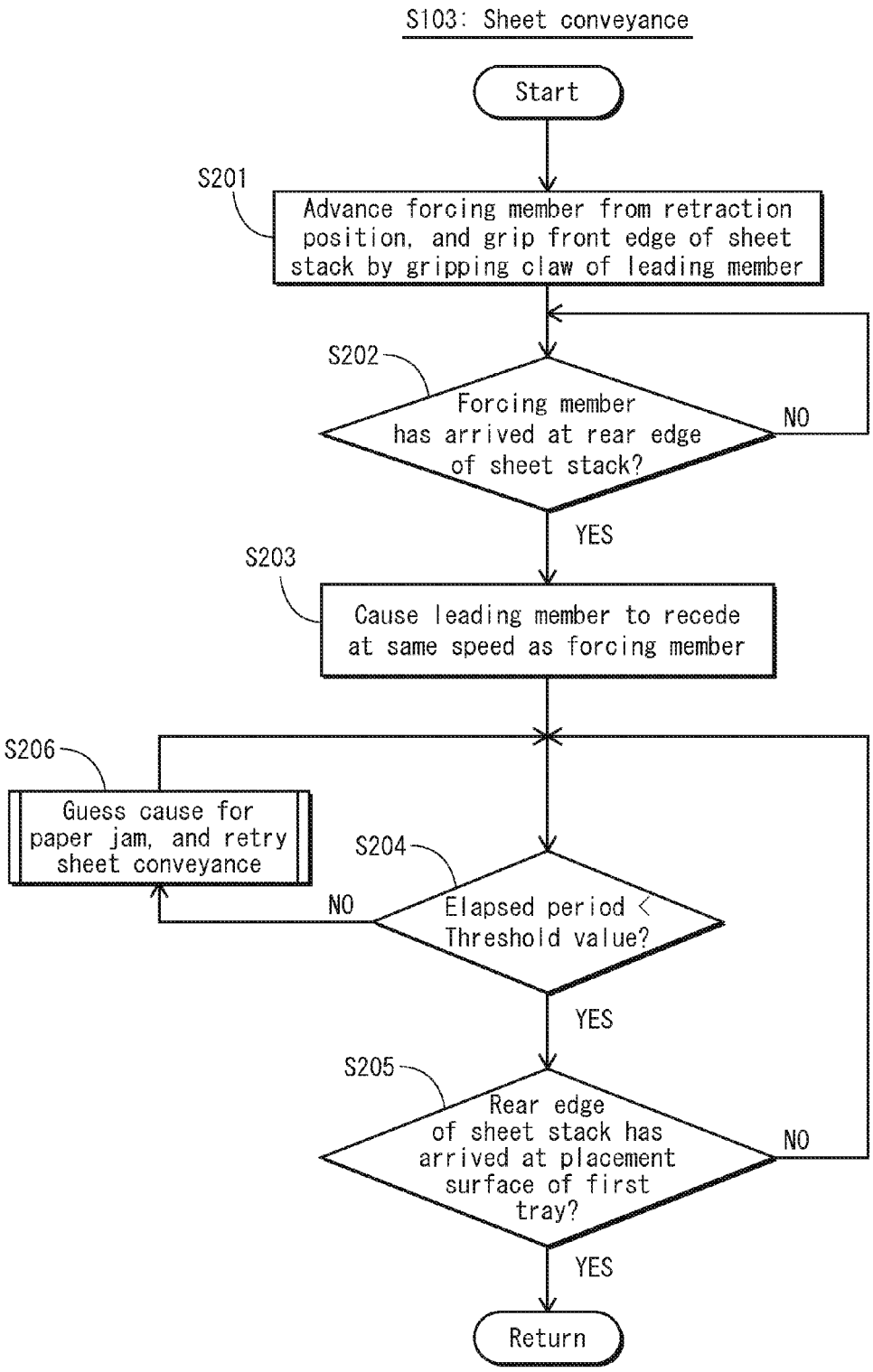
FIG. 36 is a flow chart of a subroutine in Step S103 shown in FIG. 35, namely, processing relevant to operations performed by the post-processing device conveying a sheet stack to the placement surface of the first tray.

FIG. 36 is a flow chart of a subroutine in Step S103 shown in FIG. 35, namely, processing relevant to the operations of conveying the sheet stack STK to the placement surface of the first tray 200 performed by the post-processing device 150.

In Step S201, as shown in FIGS. 10 and 11A, the second control unit 300 controls the conveyance unit 320 to advance the forcing member 232 from the retraction position HM2 in the FD direction while controlling the conveyance unit 320 to keep the front edge of the sheet stack STK held down by the leading member 231. In conjunction with this, the gripping claw 231A of the leading member 231 sandwiches the front edge part of the sheet stack STK between the gripping claw 231A and the upper surface of the base part 231B of the leading member 231. Then, the processing proceeds to Step S202.

In Step S202, the second control unit 300 judges whether the forcing member 232 has arrived at the lateral surface 207 of the lower end part of the housing 202 of the post-processing device 150. Specifically, the second control unit 300 first measures, based on notification transmitted from the conveyance unit 320, a period elapsed from a time when output from the position sensor disposed on the retraction position HM2 indicates that the forcing member 232 has departed from the retraction position HM2 (specifically, the number of pluses or rotations of the driving signal of the FD conveyance motor). Next, the second control unit 300 estimates a movement distance of the forcing member 232 from the elapsed period and a standard movement pattern of the forcing member 232. When detecting that the movement distance has reached a distance between the retraction position HM2 and the lateral surface 207 of the lower end part of the housing 202, the second control unit 300 judges that the forcing member 232 has arrived at the lateral surface 207 of the lower end part of the housing 202. In the case where the arrival is detected, the processing proceeds to Step S203. In the case where the arrival is not detected, the processing is repeated in Step S202.

In Step S203, since the forcing member 232 has already arrived at the lateral surface 207 of the lower end part of the housing 202, the forcing member 232 must be in contact with the rear edge of the sheet stack STK. Here, the second control unit 300 controls the conveyance unit 320 to cause the leading member 231 to recede at the same speed as that of the forcing member 232, in other words, move the leading member 231 in the FD direction. Then, the processing proceeds to Step S204.

In Step S204, the detection unit 304 measures a period elapsed since the forcing member 232 has left the retraction position HM2, and compares the measured elapsed period with the threshold value, namely, the period necessary for the leading member 231 and the forcing member 232 to convey the rear edge REE of the sheet stack STK to the lower end LEG of the placement surface of the first tray 200. In the case where the elapsed period has not yet reached the threshold value, the processing proceeds to Step S205. In the case where the elapsed period has reached or exceeded the threshold value, the processing proceeds to Step S206.

In Step S205, since the elapsed period has not yet reached the threshold value, the detection unit 340 judges whether the rear edge REE of the sheet stack STK has arrived at the lower end LEG of the placement surface of the first tray 200, through output from the sheet rear edge sensor 370A. In the case where the rear edge REE of the sheet stack STK has arrived at the lower end LEG of the placement surface, the processing returns to the flow shown in FIG. 35 and proceeds to Step S104. In the case where the rear edge REE of the sheet stack STK has not arrived at the lower end LEG, the processing is repeated from Step S204.

In Step S206, since the elapsed period has already reached the threshold value, the detection unit 340 judges that a paper jam has occurred in the sheet stack STK, and starts up the guess unit 305. As a result, the cause for the paper jam is guessed, and conveyance of the sheet stack STK is retried. Then, the processing is repeated from Step S204.

—Flow Chart of Processing Relevant to Conveyance Retrial—

Figure 37:
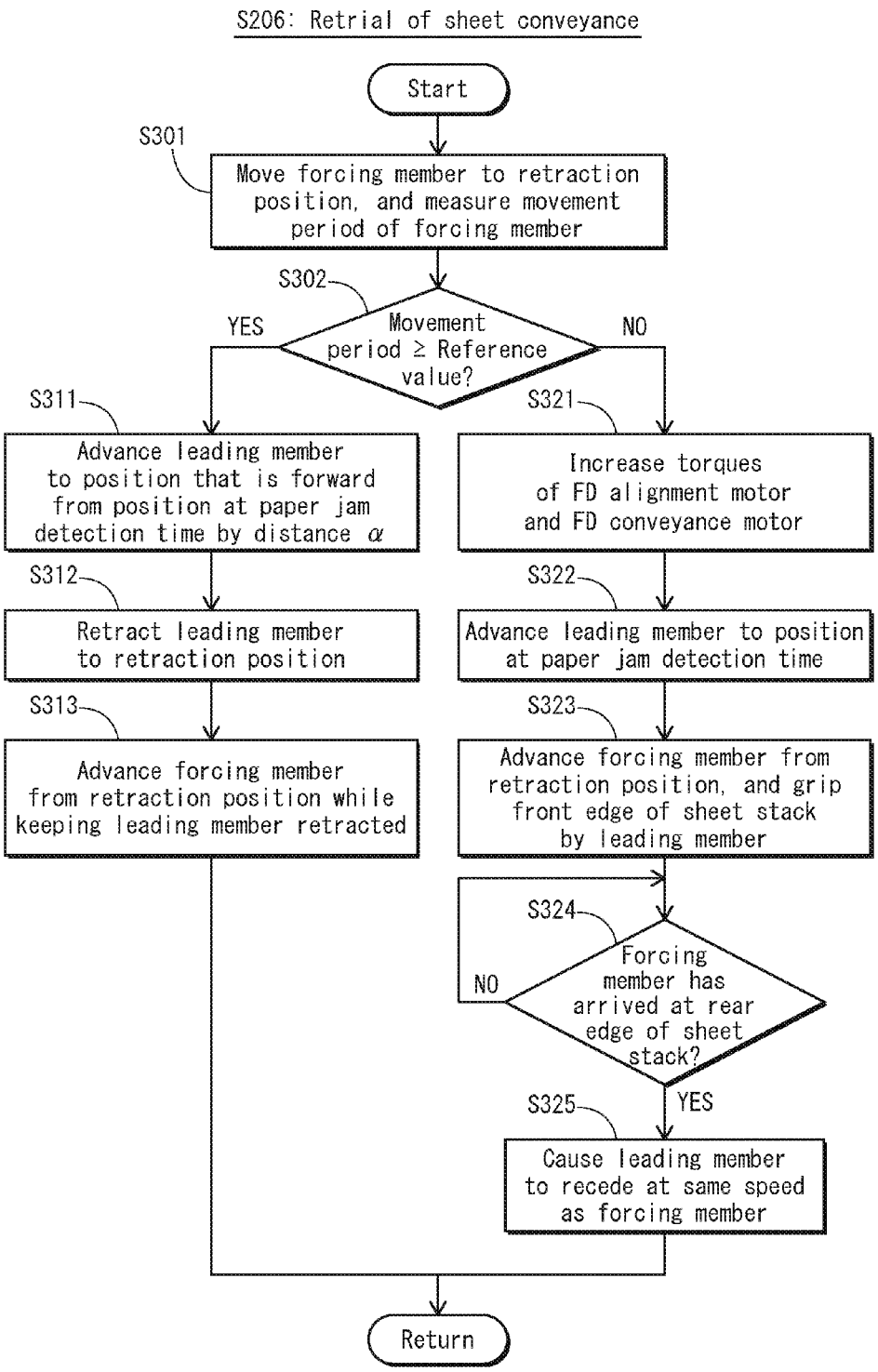
FIG. 37 is a flow chart of a subroutine in Step S206 shown in FIG. 36, namely, processing relevant to operations performed by the post-processing device guessing the cause for a paper jam and causing the front edge conveyance member to retry sheet conveyance in a mode in accordance with the guessed cause.

FIG. 37 is a flow chart of a subroutine in Step S206 shown in FIG. 36, namely, processing relevant to the operations performed by the post-processing device 150 for guessing the cause for the paper jam and retrying to convey the sheet stack STK by the leading member 231 and the forcing member 232 in a mode in accordance with the guessed cause.

In Step S301, the guess unit 305 controls the conveyance unit 320 to move the leading member 231 and the forcing member 232 from the respective positions JM1 and JM2 at the paper jam detection time to the respective retraction positions HM1 and HM2, as shown in FIG. 33B and FIG. 34B, respectively. Here, the guess unit 305 measures a period elapsed until the forcing member 232 has arrived at the retraction position HM2 after starting moving (specifically, the number of pluses or rotations of the driving signal of the FD conveyance motor). Then, the processing proceeds to Step S302.

In Step S302, the guess unit 305 compares the elapsed period with the reference value, namely, the period necessary for the forcing member 232 to move by the acceleration distance. In the case where the elapsed period is equal to or greater than the reference value, the processing proceeds to Step S311 as indicated by an arrow "YES" in FIG. 37. In the case where the elapsed period is less than the reference value, the processing proceeds to Step S321 as indicated by an arrow "NO" in FIG. 37.

In Step S311, since the elapsed period is equal to or greater than the reference value, the movement distance of the forcing member 232 equals or exceeds the acceleration distance as shown in FIG. 33A. Therefore, the guess unit 305 guesses the cause for the paper jam as sheet buckling. In accordance with this guess, the retrial control unit 306 first controls the conveyance unit 320 to advance the leading member 231 to the position that is forward from the position JM1 at the paper jam detection time by the push-back distance α, as shown in FIG. 33C. Then, the processing proceeds to Step S312.

In Step S312, the retrial control unit 306 controls the conveyance unit 320 to retract the leading member 231 from the position, which is forward from the position JM1 at the paper jam detection time by the push-back distance α, to the retraction position HM1 again as shown in FIG. 33D. Then, the processing proceeds to Step S313.

In Step S313, the retrial control unit 306 first controls the conveyance unit 320 to convey the sheet stack STK only by the forcing member 232 while controlling the conveyance unit 320 to keep the leading member 231 standing by on the retraction position HM1, as shown in FIG. 33E. Here, the detection unit 304 monitors whether the rear edge REE of the sheet stack STK arrives at the lower end LEG of the placement surface until the period elapsed since the forcing member 232 has left the retraction position HM2 reaches the threshold value. Then, the processing returns to the flow shown in FIG. 36, and the processing is repeated from Step S204.

In Step S321, since elapsed period is less than the reference value, the movement distance of the forcing member 232 does not reach the acceleration distance as shown in FIG. 34A. Therefore, the guess unit 305 guesses the cause for the paper jam as an insufficient conveyance force. In accordance with this guess, the retrial control unit 306 controls the conveyance unit 320 to increase the respective torques of the FD alignment motor and the FD conveyance motor. Then, the processing proceeds to Step S322.

In Step S322, the retrial control unit 306 controls the conveyance unit 320 to advance the leading member 231 to the position JM1 at the paper jam detection time as shown in FIG. 34C. Then, the processing proceeds to Step S323.

In Step S323, the retrial control unit 306 controls the conveyance unit 320 to advance the forcing member 232 to the position JM2 at the paper jam detection time as shown in FIG. 34C. In conjunction with this, the gripping claw 231A of the leading member 231 is brought down to sandwich the front edge part of the sheet stack STK between the gripping claw 231A and the upper surface of the base part 231B of the leading member 231. Then, the processing proceeds to Step S324.

In Step S324, the retrial control unit 306 judges whether the forcing member 232 has arrived at the position JM2 at the paper jam detection time. For example, it is judged as to whether the driving period of the FD conveyance motor (specifically, the number of pulses or rotations of the driving signal) has reached or exceeded a set value. This set value is calculated by the retrial control unit 306, and indicates the elapsed period measured in Step S301. In other words, the set value indicates a period necessary for the forcing member 232 to move, at speed corresponding to the torque of the FD conveyance motor which is increased in Step S321, by a movement distance estimated from a period necessary for the forcing member 232 to retract to the retraction position HM2 from the position JM2 at the paper jam detection time. In the case where the retrial control unit 306 judges that the forcing member 232 has arrived at the position JM2 at the paper jam detection time (for example, the driving period of the FD conveyance motor has reached or exceeded the set value), the processing proceeds to Step S325. In the case where the retrial control unit 306 judges that the forcing member 232 has arrived at the position JM2 at the paper jam detection time, the processing is repeated in Step S324.

In Step S325, since the forcing member 232 has arrived at the position JM2 at the paper jam detection time, the retrial control unit 306 controls the conveyance unit 320 to cause the leading member 231 to recede at the same speed as that of the forcing member 232 as shown in FIG. 34D. Here, the detection unit 304 monitors whether the rear edge REE of the sheet stack STK arrives at the lower end LEG of the placement surface until the period elapsed since the forcing member 232 has left the retraction position HM2 reaches the threshold value. Then, the processing returns to the flow shown in FIG. 36, and the processing is repeated from Step S204.

According to the post-processing device 150 in the present modification as described above, when the detection unit 304 detects an occurrence of a paper jam of a sheet stack STK which is conveyed in the FD direction, the guess unit 305 guesses whether the cause for the paper jam is sheet buckling or an insufficient conveyance force, based on a period elapsed until the forcing member 232 retracts from the position JM2 at the paper jam detection time to the retraction position HM2. Further, the retrial control unit 306 controls the conveyance unit 320 to retry to convey the sheet stack STK in a mode in accordance with the guessed cause.

This increases a possibility that the retrial resolves the paper jam, and therefore it is possible to reduce a frequency that the post-processing device 150 needs to suspend processing to cause the user to remove jammed papers. In this way, the post-processing device 150 can reduce delay of the post-processing caused by the paper jam. This improves the productivity of the image forming system.

(8) Alternatively, it may be possible to increase the possibility of resolving the paper jam by retrying sheet conveyance due to a paper jam in a mode different from the normal mode, without guessing the cause for the paper jam like in the modification (7).

The following explains the difference in <Retrial control on sheet conveyance> between an image forming system relating to the present modification and the image forming system relating to the modification (7).

In the present modification, the CPU 301 does not include the guess unit 305, and the retrial control unit 306 controls the conveyance unit 320 to retry sheet conveyance in a mode different from the normal mode.

When being started up, the retrial control unit 306 first controls the conveyance unit 320 to move the leading member 231 and the forcing member 232 from the respective positions at a paper jam detection time to the retraction positions HM1 and HM2. Then, the retrial control unit 306 controls the conveyance unit 320 to push back a sheet by the leading member 231. The retrial control unit 306 controls the conveyance unit 320 to increase the torque of the FD conveyance motor and convey the sheets only by the forcing member 232 while controlling the conveyance unit 320 to keep the leading member 231 standing by on the retraction position HM1.

Especially in the case where the FD alignment motor is a stepping motor, the retrial control unit 306 increases the torque of the FD alignment motor by increasing the pulse width of a driving signal to be applied to the FD alignment motor. With the increase of the torque, the rotation speed of the FD conveyance motor decreases due to increase between the pulse intervals, and as a result the target speed of the sheet decreases. However, the target speed decreases only in the case where sheet conveyance is retried. The target speed in the normal state may be set sufficiently high, and accordingly the post-processing period is maintained sufficiently short.

FIGS. 38A-38E are schematic partial cross-sectional views of the first tray 200 showing a retrial operation in stages in the case where a paper jam is caused by sheet buckling.

Figure 38A:
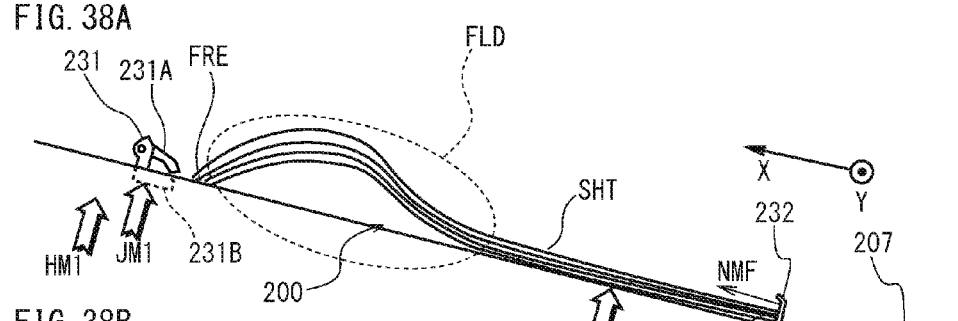
FIGS. 38A-38E show respective partial modifications of FIGS. 33A-33E.

FIG. 38A shows the state at a time when the paper jam has been detected. Referring to FIG. 38A, a folding FLD occurs in the front edge FRE of a sheet SHT due to that the front edge FRE of the sheet SHT is caught in the groove or the like of the placement surface of the first tray 200. Generally in this case, the leading member 231 cannot sufficiently sandwich the front edge FRE of the sheet SHT between the gripping claw 231A and the upper surface of the base part 231B, the leading member 231 cannot pull the front edge FRE of the sheet SHT by a sufficient force. On the other hand, a force PSF pushing the rear edge REE of the sheet SHT in the FD direction (the X-axis direction) is buffered by the folding FLD of the sheet SHT. In other words, the force PSF is prevented by a stress of the sheet SHT for restoring the folding FLD to the original shape. Accordingly, the forcing member 232 cannot push the rear edge REE of the sheet SHT by a sufficient force. This impairs a conveyance force for conveying the sheet SHT, and therefore the speed of the sheet SHT does not reach the target value. Accordingly, the rear edge REE of the sheet stack STK does not arrive at the lower edge LEG of the placement surface even after a period elapsed since the forcing member 232 has left the retraction position HM2 reaches the threshold value.

In addition to the above, a paper jam is caused by insufficiency of a conveyance force for conveying the sheet stack STK including the sheet SHT due to load excess of the sheet stack STK, in other words, insufficiency of a resultant force of a force of the leading member 231 for pulling the sheet stack STK and a force of the forcing member 232 for pushing the sheet stack STK. In this case, the leading member 231 and the forcing member 232 cannot move the sheet stack STK even by taking a long time.

In the case where the rear edge REE of the sheet STK does not arrive at the lower edge LEG of the placement surface even after a period elapsed since the forcing member 232 has left the retraction position HM2 reaches the threshold value, the detection unit 304 starts up the retrial control unit 306. First, the retrial control unit 306 controls the conveyance unit 320 to move the leading member 231 and the forcing member 232 from the respective positions JM1 and JM2 at the paper jam detection time to the respective retraction positions HM1 and HM2.

Figure 38B:
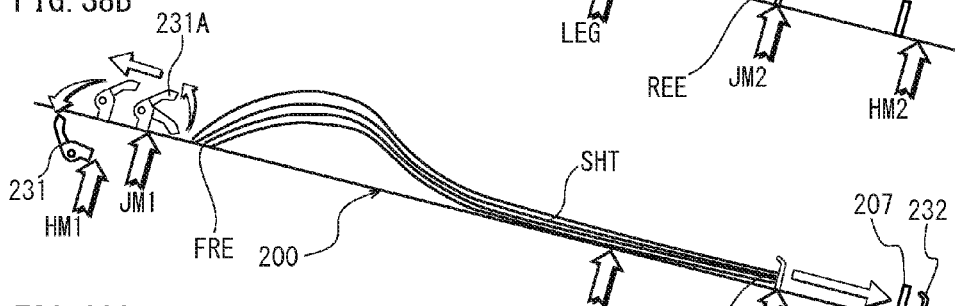

FIG. 38B shows the state at a time when the leading member 231 and the forcing member 232 have retracted to the respective retraction positions HM1 and HM2. The conveyance unit 320 notifies the retrial control unit 306 of a time when the leading member 231 and the forcing member 232 have started moving from the respective positions JM1 and JM2, and a time when the leading member 231 and the forcing member 232 have arrived at the respective retraction positions HM1 and HM2. The conveyance unit 320 regards the former time as for example a time when the FD alignment motor and the FD conveyance motor have been restarted up after detection of the paper jam, and regards the latter time as for example a time when the respective position sensors disposed on the retraction positions HM1 and HM2 have detected the leading member 231 and the forcing member 232, respectively. Based on the notification transmitted from the conveyance unit 320, the retrial control unit 306 calculates a period necessary for the leading member 231 and the forcing member 232 to move from the positions JM1 and JM2 at the paper jam detection time to the respective retraction positions HM1 and HM2, for example from the number of pulses or rotations of the driving signal of the FD alignment motor and the FD conveyance motor. Then, the retrial control unit 306 controls the conveyance unit 320 to push back the sheet SHT by the leading member 231 and release catching of the front edge FRE of the sheet SHT.

Figure 38C:
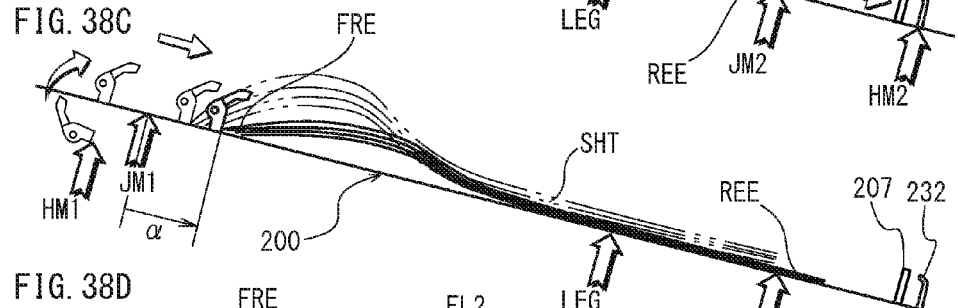

FIG. 38C shows the state at a time when the leading member 231 has pushed back the front edge FRE of the sheet SHT. Referring to FIG. 38C, the conveyance unit 320 moves from the retraction position HM1 to a position that is forward from the position JM1 at the paper jam detection time by a predetermined distance $\alpha$ (hereinafter, referred to as a push-back distance $\alpha$). Here, the driving period of the FD alignment motor (specifically, the number of pulses or rotations of the driving signal) is set by the retrial control unit 306 based on the period necessary for the leading member 231 to retract from the position JM1 at the paper jam detection time to the retraction position HM1 and a period necessary for the leading member 231 to move by the push-back distance $\alpha$. Then, designation of the driving period is transmitted to the conveyance unit 320. The push-back distance $\alpha$ is set based on an average distance between the front edge FRE and the rear edge REE of the sheet SHT at a time when buckling such as a folding FLD occurs in the sheet SHT, such that the leading member 231, which has advanced from the retraction position HM1, contacts the front edge FRE of the sheet SHT and pushes back the front edge FRE by a certain level of force. Note that the average distance is obtained for example by experiments in advance. Catching of the front edge FRE of the sheet SHT is generally caused by movement of the sheet SHT in the FD direction. Accordingly, the catching is most likely to be released as a result of push-back of the front edge FRE in the inverse direction by the leading member 231.

Next, the retrial control unit 306 controls the conveyance unit 320 to retract the leading member 231 from the position, which is forward from the position JM1 at the paper jam detection time by the push-back distance $\alpha$, to the retraction position HM1 again. Specifically, the conveyance unit 320 causes the leading member 231 to continue to recede until the position sensor, which is for example disposed on the retraction position HM1, detects the leading member 231.

Figure 38D:
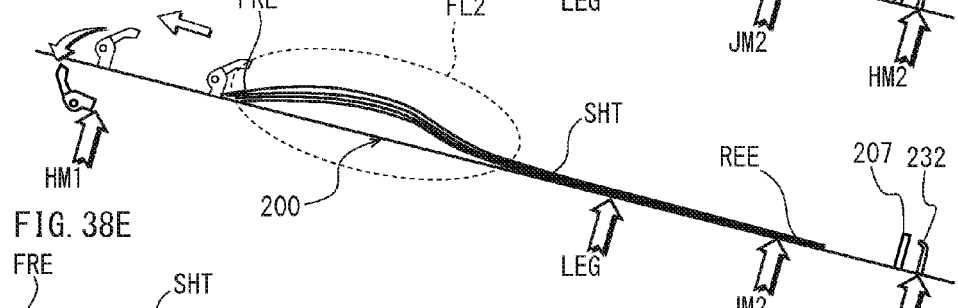

FIG. 38D shows the state at a time when the leading member 231 has retracted to the retraction position HM1 again.

Referring to FIG. 38D, the sheet SHT moves from the position at the paper jam detection time in a direction (the negative direction on the X-axis) inverse to the FD direction. Here, catching of the front edge FRE of the sheet SHT is generally released. A folding FL2 of the sheet SHT is loose compared with the folding FLD at the paper jam detection time shown in FIG. 38A. However, there is a high possibility that the leading member 231 can no longer sufficiently sandwich the front edge FRE of the sheet SHT between the gripping claw 231A and the upper surface of the base part 231B due to the folding FL2. Also, there is a high possibility that the position of the front edge FRE of the sheet SHT deviates from a position that is guessed from the size of the sheet SHT. For this reason, the retrial control unit 306 subsequently controls the conveyance unit 320 to convey the sheet SHT only by the forcing member 232 while controlling the conveyance unit 320 to keep the leading member 231 standing by on the retraction position HM1.

Figure 38E:
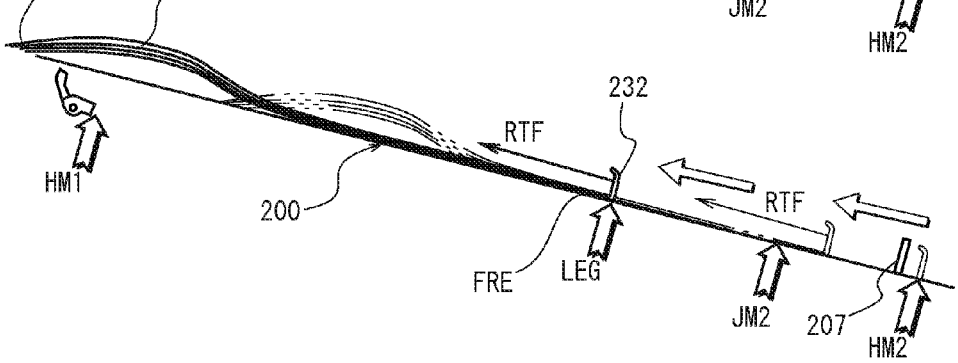

The retrial control unit 306 controls the conveyance unit 320 to increase the torque of the FD conveyance motor, and convey the sheets only by the forcing member 232 while controlling the conveyance unit 320 to keep the leading member 231 standing by on the retraction position HM1. FIG. 38E shows the state at a time when only the forcing member 232 conveys the sheet SHT while the leading member 231 is kept standing by on the retraction position HM1. Referring to FIG. 38E, the forcing member 232 again advances from the retraction position HM2, contacts the rear edge REE of the sheet SHT, and pushes the rear edge REE. Here, since the torque of the FD conveyance motor increases more than in the normal state, a force RTF of the forcing member 232 for pushing the rear edge REE is greater than a force NMF in the normal state.

In this way, in a paper jam caused by sheet buckling, in the case where catching of the front edge FRE of the sheet SHT is released by the leading member 231 pushing back the sheet SHT, the sheet SHT moves in the FD direction. In a paper jam caused by an insufficient conveyance force, in the case where the force RTF of the forcing member 232 exceeds the resistive force which has increased due to load excess of the sheet stack including the sheet SHT, the sheet SHT moves in the FD direction.

During movement of the sheet SHT, the detection unit 304 monitors whether the rear edge REE of the sheet SHT has arrived at the lower end LEG of the placement surface of the first tray 200. In the case where the rear edge REE of the sheet SHT arrives at the lower end LEG of the placement surface until the period elapsed since the forcing member 232 has left the retraction position HM2 reaches the threshold value, the detection unit 304 judges that conveyance retrial of the sheet SHT has succeeded. Note that in the case where the FD alignment motor is a stepping motor, the increase of the torque of the FD conveyance motor is equal to decrease of the target speed of the sheet from that in the normal state. Therefore, the threshold value is set greater than that in the normal state. Since the target speed decreases only in the case where sheet conveyance is retried, the post-processing period is maintained sufficiently short. In the case where the retrial has succeeded, control of the post-processing device 150 returns to processing in the normal state. The processing is restarted with the operation of horizontally pivoting the first tray 200 as shown in FIG. 13.

Figure 39:
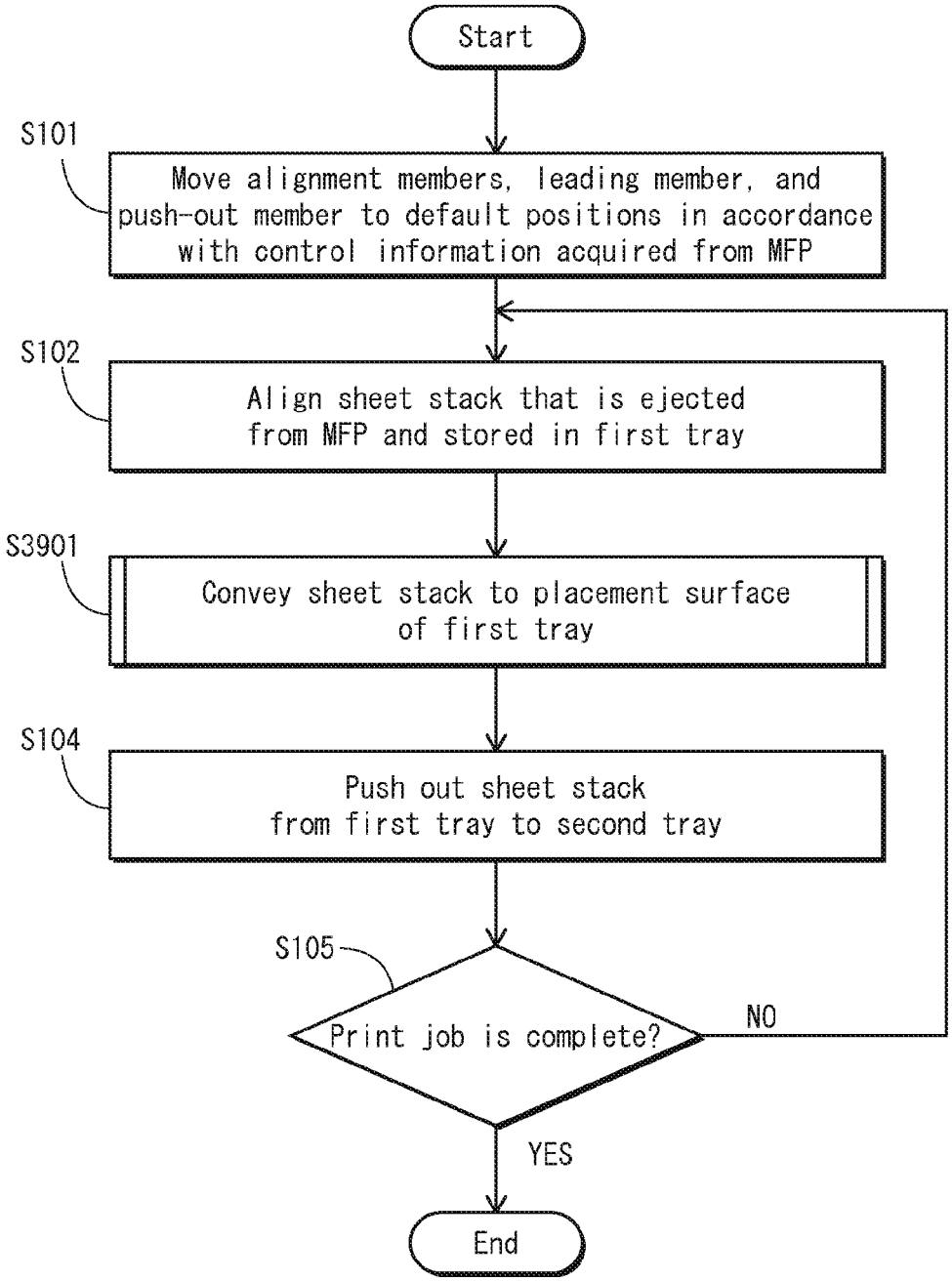
FIG. 39 is a flow chart of another modification of the post-processing.

The following explains the difference between a flow chart of the post-processing in the present modification shown in FIG. 39 and that in the modification (7). In FIG. 39, steps of the same processing as those in FIG. 35 have appended thereto the same step numbers as those in FIG. 35, and explanation thereof is omitted.

The processing shown in FIG. 39 differs from that shown in FIG. 35 only in terms of processing relevant to sheet conveyance in the FD direction (Step S3901), and accordingly the following explains the processing relevant to sheet conveyance.

Figure 40:
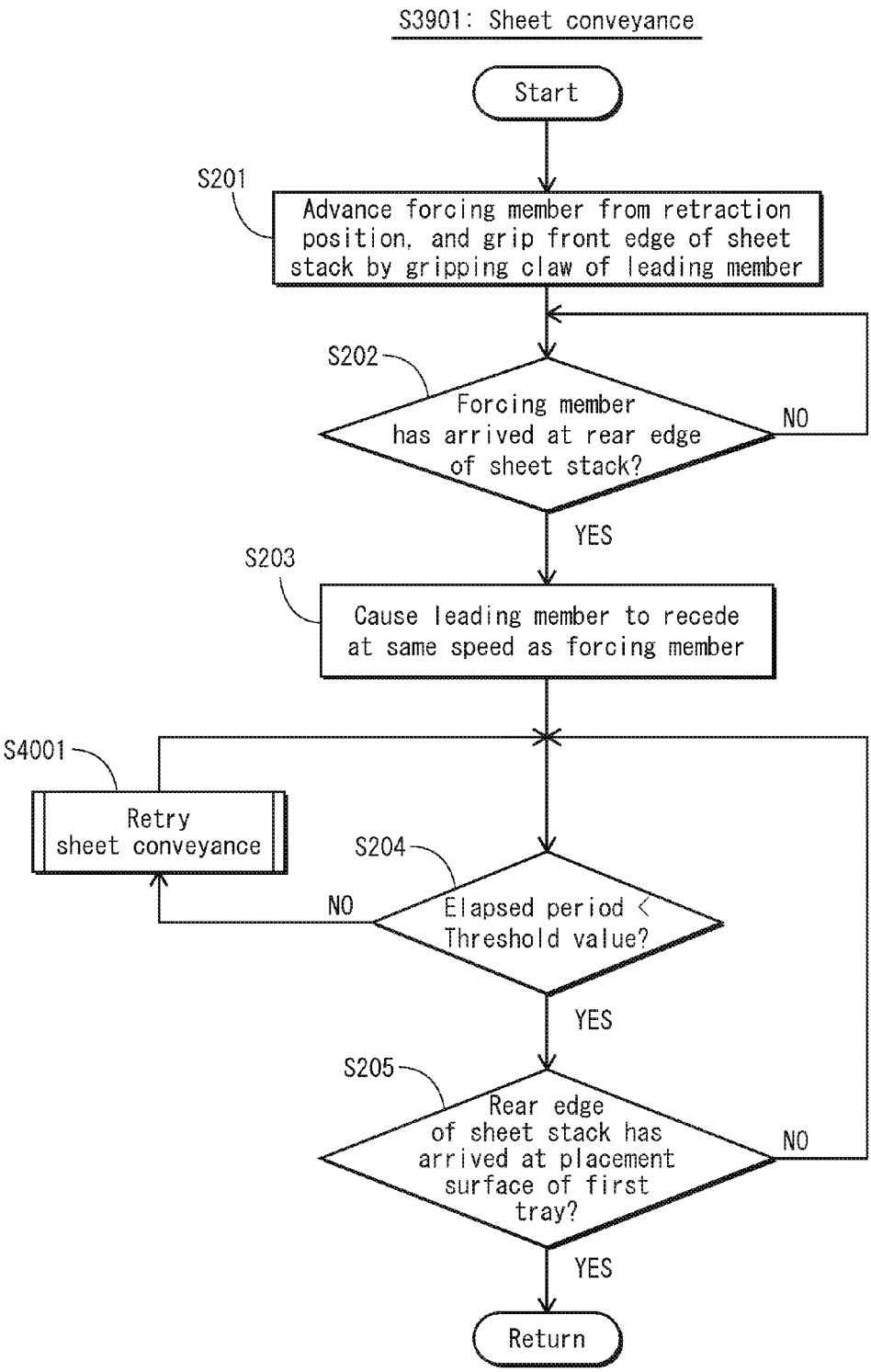
FIG. 40 is a flow chart of a subroutine in Step S3901 shown in FIG. 39, namely, processing relevant to operations performed by the post-processing device conveying a sheet stack to the placement surface of the first tray.

FIG. 40 is a flow chart of a subroutine in Step S3901 shown in FIG. 39, namely, processing relevant to the operations performed by the post-processing device 150 conveying the sheet stack STK to the placement surface of the first tray 200. In FIG. 40, steps of the same processing as those in FIG. 36 have appended thereto the same step numbers as those in FIG. 36, and explanation thereof is omitted.

The processing shown in FIG. 40 differs from that shown in FIG. 36 only in terms of processing relevant to retrial of sheet conveyance (Step S4001), and accordingly the following explains the processing relevant to retrial of sheet conveyance.

Figure 41:
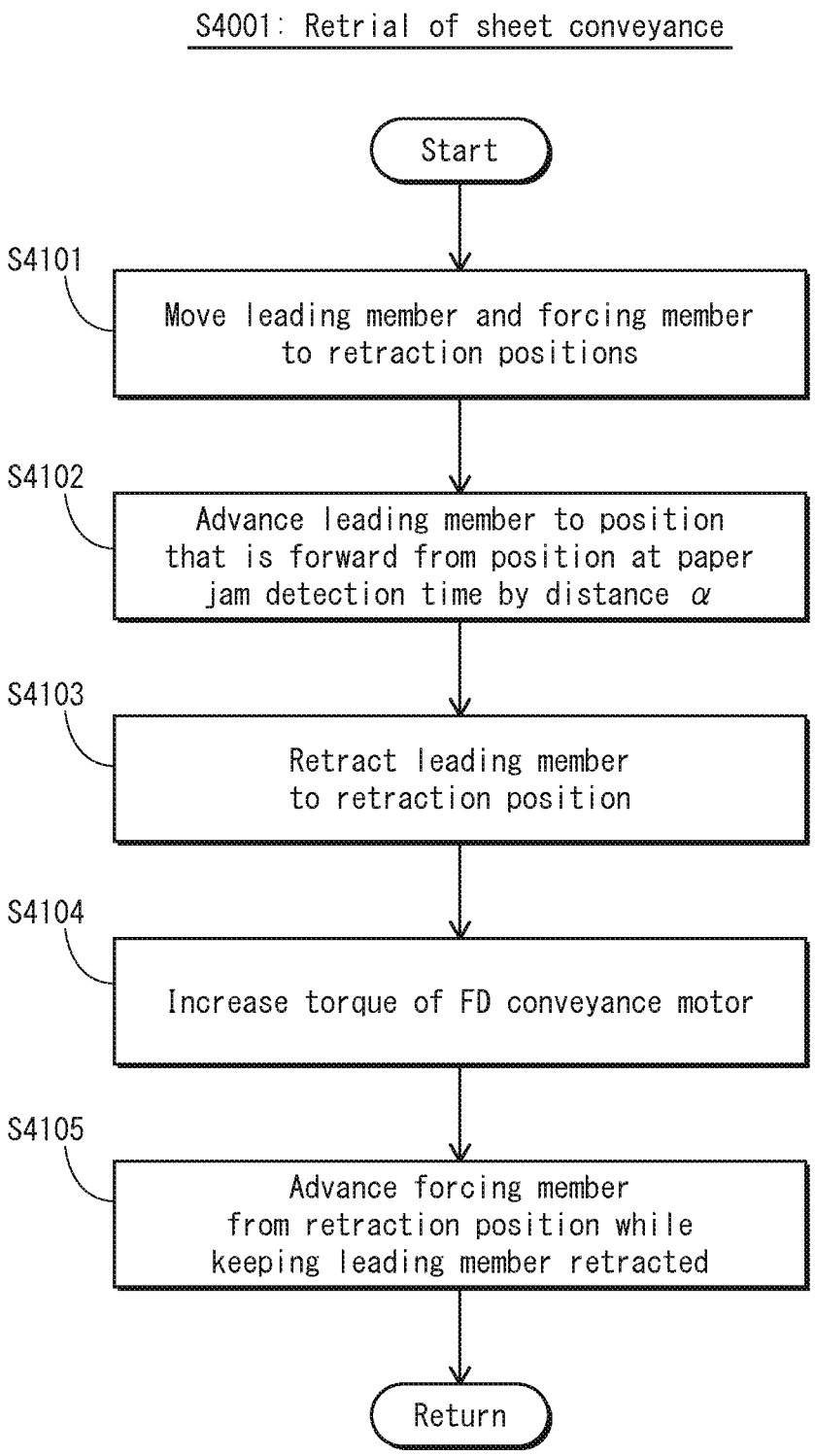
FIG. 41 is a flow chart of a subroutine in Step S4001 shown in FIG. 40, namely, processing relevant to operations performed by the post-processing device causing the conveyance unit to retry sheet conveyance in a mode different from the normal mode.

FIG. 41 is a flow chart of a subroutine in Step S4001 shown in FIG. 40, namely, processing relevant to the operations performed by the post-processing device 150 controlling the leading member 231 and the forcing member 232 to retry to convey a sheet in a mode different from the normal mode.

In Step S4101, the retrial control unit 306 controls the conveyance unit 320 to move the leading member 231 and the forcing member 232 from the respective positions JM1 and JM2 at the paper jam detection time to the respective retraction positions HM1 and HM2, as shown in FIG. 38B. Then, the processing proceeds to Step S302.

In Step S4102, the retrial control unit 306 controls the conveyance unit 320 to advance the leading member 231 to the position that is forward from the position JM1 at the paper jam detection time by the push-back distance $\alpha$, as shown in FIG. 38C. Then, the processing proceeds to Step S4103.

In Step S4103, the retrial control unit 306 controls the conveyance unit 320 to retract the leading member 231 from the position, which is forward from the position JM1 at the paper jam detection time by the push-back distance $\alpha$, to the retraction position HM1 again, as shown in FIG. 38D. Then, the processing proceeds to Step S4104.

In Step S4104, the retrial control unit 306 controls the conveyance unit 320 to increase the torque of the FD conveyance motor. Then, the processing proceeds to Step S4105.

In Step S4105, the retrial control unit 306 controls the conveyance unit 320 to convey the sheet stack SHT only by the forcing member 232 while controlling the conveyance unit 320 to keep the leading member 231 standing by on the retraction position HM1, as shown in FIG. 38E. Here, since the torque of the FD conveyance motor increases more than in the normal state, a force RTF of the forcing member 232 for pushing the rear edge REE of the sheet SHT is greater than a force NMF in the normal state. The detection unit 304 monitors whether the rear edge REE of the sheet SHT arrives at the lower end LEG of the placement surface until the period elapsed since the forcing member 232 has left the retraction position HM2 reaches the threshold value. Then, the processing returns to the flow shown in FIG. 40, and the processing is repeated from Step S204.

According to the post-processing device 150 in the present modification as described above, when the detection unit 304 detects a paper jam of a sheet SHT which is conveyed in the FD direction, the retrial control unit 306 controls the conveyance unit 320 to retry to convey the sheet SHT in a mode different from the normal mode.

In the different mode, after the leading member 231 pushes back the front edge FRE of the sheet SHT by the distance $\alpha$, only the forcing member 232 pushes the rear edge REE of the sheet SHT by the force RTF which is greater than the force NMF in the normal state, as shown in FIGS. 38A-38E. This increases a possibility that the retrial of sheet conveyance resolves the paper jam irrespective of whether the cause for the paper jam is sheet buckling or an insufficient conveyance force. Therefore, it is possible to reduce a frequency that the post-processing device 150 needs to suspend processing to cause the user to remove jammed papers. In this way, the post-processing device 150 can reduce delay of the post-processing caused by the paper jam. This improves the productivity of the image forming system.

(9) In the above embodiment and the modifications (1)-(8), an MFP is used as an image forming apparatus. Alternatively, a laser printer, an inkjet printer, a facsimile, a copier, or the like may be used as an image forming apparatus, instead of the MFP.

(10) In the above embodiment and the modifications (1)-(8), the lift motor 204, the CD alignment motor, the FD alignment motor, the CD conveyance motor, and the FD conveyance motor are independent from each other as a driving source of the movable members included in the post-processing devices 150 and 150A. Alternatively, part or all of these motors may be common as a driving source of the movable members included in the post-processing devices 150 and 150A.

(11) In the above embodiment and the modifications (1)-(8), the lift motor 204 and the cam mechanism 205 are used for pivoting the first tray 200. In addition, a mechanism capable of vertically moving the placement surface of the first tray 200 may be used as a mechanism for displacing the first tray 200 between a period in which sheets ejected from the MFP 100 or 100A are stored and a period in which the stored sheets are pushed out to the second tray 210.

(12) In the above embodiment and the modifications (1)-(8), the forcing member 232 is disposed in the lower end part 200B of the first tray 200, and forces a sheet by pushing the rear edge of the sheet in the FD direction. Alternatively, the forcing member may be disposed in one or both of the marginal parts of the first tray 200 in the CD direction, and move a sheet in the FD direction by moving in the FD direction while holding the sheet by one or both of the sides thereof in the CD direction. The forcing member may be a conveyance belt extending above the upper surface of the first tray 200 in the FD direction. The conveyance belt can convey a sheet in the FD direction by rotating in the FD direction while placing the sheet thereon.

(13) In the above embodiment and the modifications (1)-(8), the gripping claw 231A of the leading member 231 is brought down in conjunction with advance of the forcing member 232 from the retraction position HM2. In addition, the gripping claw 231A may pivot independently movement of the forcing member 232. In this case, the following configuration may be employed: the leading member 231 waits for the front edge of the sheet, which is conveyed, to be pushed up to the position of the leading member 231, and starts pulling up the sheet by gripping the sheet with use of the gripping claw 231A only after contacting the front edge of the sheet. Also, in the case where the pushing force NMF of the forcing member 232 for pushing the sheet, which is conveyed, is sufficiently strong, the gripping claw 231A of the leading member 231 may be omitted.

(14) In the above embodiment and the modifications (1)-(8), the post-processing performed by the post-processing device 150 includes processing of aligning sheets on the first tray 200, processing of stapling a sheet stack by the stapler 251, and processing of load sheets for each sheet stack on the second tray 210 to sort the sheets. However, the type of the post-processing is not limited to these processing, and known type of the post-processing functions may be implementable. For example, the process units 250 and 251 or another equipment adjacent thereto may perform processing of creating a stapling hole in sheets immediately therebelow, processing of applying an adhesive agent to sheets, or processing of folding sheets in half or the like.

(15) In the above embodiment and the modifications (1)-(8), the driving units 310-360 detect that the movable members 200, 221, 222, 231, 232, 241-244, and 260 are each in a specific position or orientation, with use of an optical sensor as a position sensor. Alternatively, a sensor employing another method may be used as the position sensor. Similarly, the sheet rear edge sensor 370A may be a sensor other than an optical sensor. Also, the position sensor may be capable of detecting that the movable member is in an arbitrary position or orientation with use of a number of detectors that are provided in short intervals along an orbit of the movable member. In this case, the conveyance unit 320 especially can detect the positions JM1 and JM2 at the paper jam detection time is detected directly based on output from the position sensor relating to the leading member 231 and the forcing member 232.

(16) In the modifications (7) and (8), in the case where another paper jam is further detected during retrial of sheet conveyance due to a paper jam, retrial of sheet conveyance is further repeated. In the case where detection of paper jam and retrial of sheet conveyance are repeated as above, the following configuration may be employed. Specifically, the upper limit is set to the number of repetition times for detection of paper jam and retrial of sheet conveyance. In the case where the number of repetition times exceeds the upper limit, or in the case where the torque of the FD conveyance motor reaches the upper limit, the retrial control unit 306 suspends the post-processing device 150, and notifies the user of occurrence of a paper jam by displaying any message on the operation panel 170 or the like.

Also, in the modification (7), in the case where a paper jam due to an insufficient conveyance force is repeatedly detected, the respective torques of the FD alignment motor and the FD conveyance motor are increased. Accordingly, when the torques of these motors reach the upper limit, the retrial control unit 306 may suspend the post-processing device 150 and notify the user of occurrence of a paper jam.

(17) In the modifications (7) and (8), in the case where the FD alignment motor and the FD conveyance motor, or the FD conveyance motor are each (is) a stepping motor, the retrial control unit 306 increases the torque of the motor by increasing the pulse width of the driving signal of the motor. However, the method of increasing the torque is not limited to this. In the case where the FD alignment motor and the FD conveyance motor are of another type, the retrial control unit 306 should increase the torque by a method appropriate to the other type, such as a method of increasing electric current of a direct current motor. Alternatively, in the case where a gear ratio of a driving mechanism from the FD conveyance motor to the forcing member 232 is variable, the retrial control unit 306 may increase the torque that is transmitted from the FD conveyance motor to the forcing member 232 by increasing the gear ratio.

(18) In the modifications (7) and (8), after conveyance retrial of a sheet stack succeeds, a subsequent sheet stack is conveyed in the normal mode. Also, at least one sheet stack subsequent to the sheet stack which has succeeded in conveyance retrial may be conveyed in the same mode as that in the conveyance retrial. Especially in the case where the cause for a paper jam is guessed as an insufficient conveyance force or in the case where the cause is the insufficient conveyance force, there is a risk that a paper jam might repeatedly occur due to the same cause because the type of sheets and so on are the same unless a print job is switched. Therefore, a possibility of avoiding the paper jam is increased by maintaining the torque of the FD conveyance motor to be a value greater than that in the normal state. In this way, conveyance may be repeated under the conditions adopted in the retrial until continuous conveyance of sheet stacks by a predetermined number of sets is complete with no occurrence of a paper jam, for example until the print job is complete with no detection of another paper jam.

(19) In the modification (7), in the case where the cause for a paper jam is guessed as sheet buckling, the retrial control unit 306 controls the conveyance unit 320 to push back, by the leading member 231, the front edge FRE of a sheet SHT in which the paper jam has occurred by the distance α. The distance α may be set such that the rear edge REE of the sheet SHT contacts the lateral surface 207 of the lower end part of the housing 202 of the post-processing device 150.

Also, the leading member 231 does not necessarily need to push back the sheet SHT. In other words, there is a possibility that catching of the front edge FRE of the sheet SHT can be released only by releasing contact with the leading member 231 or releasing gripping by the gripping claw 231A. Therefore, the push-back may be omitted. On the contrary, the push-back may be repeated a plurality of times per retrial.

(20) In the modification (7), a paper jam, which is guessed to have been caused by an insufficient conveyance force, is assumed to have occurred due to load excess of the sheet stack loaded on the first tray 200. Alternatively, this type of paper jam may be assumed to be caused by size excess of the sheet stack.

The size excess of the sheet stack indicates the state without load excess of the sheet stack where width of the entire sheet stack in the CD direction or height of the placement surface of the first tray 200 in the normal direction exceeds the permissible upper limit in the normal state. The permissible upper limit is set to the upper limit of the size of a space that needs to be provided above the placement surface of the first tray 200 in order to smoothly convey the sheet stack in the FD direction, based on the assumption that the sheet stack is appropriately aligned. Size excess might occur for example in the case where apparent width or height of a sheet stack excessively increases due to distortion of a sheet stack caused by misalignment. In the case where size excess occurs, there is a risk that part of the sheet stack that exceeds the permissible upper limit in terms of width or height contacts a structural object in the periphery of the placement surface of the first tray 200, and a resistive force, which is applied from the structural object, makes a conveyance force of conveying the sheet stack insufficient. In this case, a conveyance force in the normal state cannot increase speed of the sheet stack to the target speed, and as a result movement of the sheet stack delays and a paper jam occurs.

In the modification (7), as long as a period elapsed until the forcing member 232 retracts from the position JM2 at the paper jam detection time to the retraction position HM2 is less than the reference value, the cause for a paper jam is guessed as an insufficient conveyance force. This increases the respective torques of the FD alignment motor and the FD conveyance motor more than in the normal state irrespective of whether a paper jam is caused by load excess or excess size of a sheet stack. Accordingly, respective conveyance forces of the leading member 231 and the forcing member 232 are greater than those in the normal state. In the case where the paper jam is caused by the excess size of the sheet stack, retrial of sheet conveyance succeeds as long as the respective conveyance forces of the leading member 231 and the forcing member 232 are greater than a resistive force applied to part of the sheet stack that exceeds the permissible upper limit in terms of width or height from the peripheral structural object. This increases a possibility that the retrial resolves the paper jam, and therefore the post-processing device 150 can reduce delay of processing caused by the paper jam.

(21) In the modification (7), the guess unit 305 compares the period necessary for the forcing member 232 to move from the position JM2 at the paper jam detection time to the retraction position HM2 with the period for the forcing member 232 to move by the acceleration distance. Alternatively, the guess unit 305 may calculate a movement distance of the forcing member 232 during the period, which is necessary for the forcing member 232 to the retraction position HM2, based on the number of pulses of a driving signal applied to the FD conveyance motor during the period or the number of rotations of the FD conveyance motor measured with use of the encoder during the period, and directly compare the calculated movement distance with the acceleration distance. Further alternatively, the guess unit 305 may measure speed of the forcing member 232 at the paper jam detection time by monitoring the number of rotations of the FD conveyance motor with use of the encoder, and compare the measured speed with the target speed. Yet alternatively, the guess unit 305 may directly measure a distance from the position JM2 at the paper jam detection time to the retraction position HM2 with use of a number of the position sensors, which are disposed along the orbit of the forcing member 232 (the groove 209 generated in the lower end part 200B of the first tray 200 in the FD direction and an extension thereof), and compare the measured distance with the acceleration distance. Further alternatively, the guess unit 305 may directly measure speed of the forcing member 232 at the paper jam detection time, and compare the measured speed with the target speed.

(22) In the modification (7), the guess unit 305 sets both the reference value for guessing the cause for a paper jam as sheet buckling and the reference value for guessing the cause for a paper jam as an insufficient conveyance force to the period necessary for the forcing member 232 to move by the acceleration distance. Alternatively, the guess unit 305 may set a different reference value for each cause. For example, assume a case that in the case where a period elapsed until the forcing member 232 moves from the position JM2 at the paper jam detection time to the retraction position HM2 is greater than a first reference value, the cause for a paper jam is guessed as sheet buckling, and in the case where the elapsed period is less than a second reference value, the cause for the paper jam is guessed as an insufficient conveyance force. In such a case, the first reference value and the second reference value may be set to different values. In this case, in the case where the cause cannot be uniquely guessed from the elapsed period, the guess unit 305 may judge whether another paper jam is detected as a result of retrial of sheet conveyance in the normal mode, namely, retrial of sheet conveyance using both the leading member 231 and the forcing member 232 by a normal driving force. In addition, when a paper jam occurs, the guess unit 305 may immediately suspend the post-processing device 150 and notify the user of occurrence of the paper jam.

(23) In the modification (7), the guess unit 305 guesses the cause for a paper jam as either one of the two types of sheet buckling and an insufficient conveyance force. The cause for the paper jam may include, in addition to these two types of causes, a cause that is guessable from an automatically measurable amount such as the position or orientation of the movable member such as the forcing member 232. For example, in the case where the rear edge of a sheet floats up from the placement surface of the first tray 200 higher than the forcing member 232 due to deflection of the sheet or the like, a paper jam might occur because the forcing member 232 cannot contact the rear edge and this results in insufficiency of a conveyance force and delay of sheet conveyance. In this case, a movement distance of the forcing member 232 until the paper jam is detected is generally greater than that in the case where a paper jam is caused by catching of the front edge of a sheet. Therefore, the guess unit 305 can judge whether the cause for the paper jam is deformation of the rear edge of the sheet or buckling of the front edge of the sheet, for example by judging whether the period elapsed until the forcing member 232 moves from the position at the paper jam detection time to the retraction position HM2 is longer than the period elapsed until the forcing member 232 moves by the acceleration distance by a constant threshold value or greater. Further, in the case where a member for depressing the rear edge of a sheet stored in the first tray 200 from above so as to be restored to be flat (for example, a depressing member) is mounted in the post-processing device 150, only when sheet conveyance is retried due to a paper jam that is guessed to be caused by deformation of the rear edge of the sheet, the retrial control unit 306 may control the conveyance unit 320 to restore the rear edge of the sheet so as to be flat by the depressing member, such that the forcing member 232 forces the rear edge of the sheet.

(24) In the modification (8), the retrial control unit 306 controls the conveyance unit 320 to push back, by the leading member 231, the front edge FRE of a sheet SHT in which the paper jam has occurred by the distance $\alpha$. The distance $\alpha$ may be set such that the rear edge REE of the sheet SHT contacts the lateral surface 207 of the lower end part of the housing 202 of the post-processing device 150.

Also, the leading member 231 does not necessarily need to push back the sheet SHT. In other words, there is a possibility that catching of the front edge FRE of the sheet SHT may be released only by releasing contact with the leading member 231 or releasing gripping by the gripping claw 231A. Therefore, the push-back may be omitted. On the contrary, the push-back may be repeated a plurality of times per retrial.

(25) In the modification (8), based on the assumption that the cause for a paper jam in the above embodiment includes two types of sheet buckling and insufficient conveyance, a mode that meets the both two types is adopted as the mode for retrial of sheet conveyance that is different from the normal mode. Alternatively, another mode may be adoptable as the different mode.

For example, in the case where a paper jam is possibly caused by another cause for the paper jam that is different from the above two types, the different mode may be corrected so as to meet the other cause. Specifically, the other cause for the paper jam may be the state where the rear edge of a sheet floats up from the placement surface of the first tray 200 higher than the forcing member 232 due to deflection of the sheet or the like. In this state, in fact, a paper jam might occur because the forcing member 232 cannot contact the rear edge and this results in insufficiency of a conveyance force and delay of sheet conveyance. In this case, the different mode may be corrected as shown below. First, a member for depressing the rear edge of a sheet stored in the first tray 200 from above so as to be restored to be flat (for example, a depressing member) is mounted in the post-processing device 150. Next, only when sheet conveyance is retried, the retrial control unit 306 control the conveyance unit 320 to restore the rear edge of the sheet so as to be flat by the depressing member, such that the forcing member 232 forces the rear edge of the sheet.

On the contrary, the cause for the paper jam may be limited to one of the above two types, and the different mode may be corrected so as to meet only the one type. This is advantageous in the case where a paper jam caused by the one type occurs at an extremely higher frequency than that of the other type. Specifically, in the case where the cause for a paper jam is limited to sheet buckling, the torque of the FD conveyance motor may be maintained as in the normal state while sheet conveyance is retired by only the forcing member. In the case where the cause for the paper jam is limited to an insufficient conveyance force, the respective torques of the FD alignment motor and the FD conveyance motor may be increased more than in the normal state while sheet conveyance is retried by both the leading member and the forcing member.

<Summary>

The post-processing device relating to one embodiment of the present invention disclosed above is a post-processing device for receiving sheets ejected one by one from an image forming device, and storing, in a storage tray, a number of sheets included in one set on which post processing is to be performed at a post-processing position at once, the post-processing device comprising: a conveyance unit configured to perform conveyance processing of conveying one set of a sheet stack stored in the storage tray to the post-processing position, and ejecting the sheet stack on which the post processing has been performed from the storage tray to an ejection unit; a detection unit configured to detect a paper jam of the sheet stack during the conveyance processing; a retrial judgment unit configured, when the detection unit detects the paper jam, to predict a first time and a second time, and judge that retrial of the conveyance processing is possible when the first time is no earlier than the second time, the first time being a time when a beginning sheet included in a subsequent set that is ejected from the image forming apparatus arrives at the storage tray, the second time being a time when ejection of the sheet stack in which the paper jam is detected is complete in the case where the conveyance processing is retried; and a retrial control unit configured to, when the retrial judgment unit judges that the retrial is possible, control the conveyance unit to retry the conveyance processing.

Here, the post-processing device may further comprise a standby judgment unit configured, at a detection time of the paper jam, to judge whether a sheet standby unit is able to cause the beginning sheet included in the subsequent set to stand by during conveyance of the beginning sheet, wherein when the standby judgment unit judges that the sheet standby unit is able to cause the beginning sheet to stand by, the retrial control unit may control the conveyance unit preferentially to retry the conveyance processing while controlling the sheet standby unit to cause the beginning sheet to stand by.

Also, the image forming apparatus may be configured to form an image by transferring a toner image that is formed on an image carrier onto a sheet at a transfer position, the sheet standby unit may be a resist unit that is included in the image forming apparatus and includes a pair of resist rollers that are used for temporally suspending conveyance of the sheet and adjusting a timing of sending the sheet to the transfer position, and the standby judgment unit may judge that the standby is possible when the detection time of the paper jam is no later than a time when a front edge of the beginning sheet included in the subsequent set contacts a nip part of the pair of resist rollers and the beginning sheet is sent to the transfer position.

Also, the sheet standby unit may be a stack unit that is included in the image forming apparatus and configured to temporarily stack, on an upstream side with respect to an ejection unit in a conveyance direction, a sheet on which an image is formed, the ejection unit being configured to eject the sheet to the post-processing device, and the standby judgment unit may judge that the standby is possible when the detection time of the paper jam is earlier than a time when a front edge of the beginning sheet included in the subsequent set arrives at a switching member, the switching member switching between a conveyance path to the ejection unit and a conveyance path to the stack unit.

Also, the post-processing device may further comprise the sheet standby unit that has: a holding member that holds a sheet above the storage tray; and a guide member that switches a conveyance path of a sheet that is ejected from the image forming apparatus from a path guiding to the storage tray to a path guiding to the holding member, wherein the standby judgment unit may judge that the standby is possible when a state of the guide member at the detection time of the paper jam is either in a state where the beginning sheet included in the subsequent set is able to be guided by the guide unit to the holding member or in a state where the beginning sheet will be able to be guided by the guide unit to the holding member.

Here, the conveyance unit may include: a front edge conveyance member that contacts a front edge in a conveyance direction of the sheet stack that is stored in the storage tray to lead the sheet stack to the conveyance direction, retracts to a predetermined retraction position at a detection time of the paper jam, and again contacts the front edge in the conveyance direction of the sheet stack to retry the conveyance processing; and a rear edge conveyance member that contacts a rear edge in the conveyance direction of the sheet stack to lead the sheet stack to the conveyance direction, retracts to a predetermined retraction position at the detection time of the paper jam, and again contacts the rear edge in the conveyance direction of the sheet stack to retry the conveyance processing, and when the number of sheets of the sheet stack in which the paper jam is detected or a basis weight of each of the sheets is no greater than a threshold value, the retrial control unit may control the conveyance unit to cause one of the front edge conveyance member and the rear edge conveyance member to retract to the corresponding retraction position, and prevent the other of the front edge conveyance member and the rear edge conveyance member from retracting to the corresponding retraction position and to retry the conveyance processing from a position where the paper jam is detected.

Also, the image forming system relating to one embodiment of the present invention disclosed above is an image forming system that includes an image forming device and a post-processing device for receiving sheets ejected one by one from the image forming device, and storing, in a storage tray, a number of sheets included in one set on which post processing is to be performed at a post-processing position at once, the image forming device comprising a sheet standby unit configured to cause a sheet to stand by during conveyance of the sheet to the storage tray, and the post-processing device comprising: a conveyance unit configured to perform conveyance processing of conveying one set of a sheet stack stored in the storage tray to the post-processing position, and ejecting the sheet stack on which the post processing has been performed from the storage tray to an ejection unit; a detection unit configured to detect a paper jam of the sheet stack during the conveyance processing; a retrial judgment unit configured, when the detection unit detects the paper jam, to predict a first time and a second time, and judge that retrial of the conveyance processing is possible when the first time is no earlier than the second time, the first time being a time when a beginning sheet included in a subsequent set that is ejected from the image forming apparatus arrives at the storage tray, the second time being a time when ejection of the sheet stack in which the paper jam is detected is complete in the case where the conveyance processing is retried; a retrial control unit configured to, when the retrial judgment unit judges that the retrial is possible, control the conveyance unit to retry the conveyance processing; and a standby judgment unit configured, at a detection time of the paper jam, to judge whether the sheet standby unit is able to cause the beginning sheet included in the subsequent set to stand by during conveyance of the beginning sheet, wherein when the standby judgment unit judges that the sheet standby unit is able to cause the beginning sheet to stand by, the retrial control unit controls the conveyance unit preferentially to retry the conveyance processing while controlling the sheet standby unit to cause the beginning sheet to stand by.

Here, the image forming apparatus may be configured to form an image by transferring a toner image that is formed on an image carrier onto a sheet at a transfer position, the sheet standby unit may be a resist unit that includes a pair of resist rollers that are used for temporally suspending conveyance of the sheet and adjusting a timing of sending the sheet to the transfer position, and the standby judgment unit may judge that the standby is possible when the detection time of the paper jam is no later than a time when a front edge of the beginning sheet included in the subsequent set contacts a nip part of the pair of resist rollers and the beginning sheet is sent to the transfer position.

Also, the sheet standby unit may be a stack unit configured to temporarily stack, on an upstream side with respect to an ejection unit in a conveyance direction, a sheet on which an image is formed, the ejection unit being configured to eject the sheet to the post-processing device, and the standby judgment unit may judge that the standby is possible when the detection time of the paper jam is earlier than a time when a front edge of the beginning sheet included in the subsequent set arrives at a switching member, the switching member switching between a conveyance path to the ejection unit and a conveyance path to the stack unit.

With the above configuration, the first time is predicted, which is a time when the beginning sheet included in a set subsequent to a sheet stack in which a paper jam is detected arrives at the storage tray after being ejected from the image forming apparatus. Also, the second time is predicted, which is a time when ejection of the sheet stack in which the paper jam is detected to the ejection unit is complete in the case where conveyance processing is retried. Conveyance processing of the sheet stack in which the paper jam is detected is retried in the following case where the first time is no earlier than the second time and there is no possibility that the beginning sheet included in the subsequent set is ejected from the image forming apparatus to the post-processing device during a retrial operation, and contacts the sheet stack under the retrial, and as a result another paper jam occurs.

This prevents from making processing for removing paper jams more complicated and increasing processing burden imposed on the user due to complication of processing for removing another jammed papers caused by the retrial. Therefore, in a post-processing device capable of retrying sheet conveyance, it is possible to prevent increase in processing burden imposed on the user for removing jammed papers.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A post-processing device for receiving sheets ejected one by one from an image forming apparatus, and storing, in a storage tray, a number of sheets included in one set on which post processing is to be performed at a post-processing position at once, the post-processing device comprising:

a conveyance unit configured to perform conveyance processing of conveying one set of a sheet stack stored in the storage tray to the post-processing position, and ejecting the sheet stack on which the post processing has been performed from the storage tray to an ejection unit;

a detection unit configured to detect a paper jam of the sheet stack during the conveyance processing;

a retrial judgment unit configured, when the detection unit detects the paper jam, to predict a first time and a second time, and judge that retrial of the conveyance processing is possible when the first time is no earlier than the second time, the first time being a time when a beginning sheet included in a subsequent set that is ejected from the image forming apparatus arrives at the storage tray, the second time being a time when ejection of the sheet stack in which the paper jam is detected is complete in the case where the conveyance processing is retried; and a retrial control unit configured to, when the retrial judgment unit judges that the retrial is possible, control the conveyance unit to retry the conveyance processing.

2. The post-processing device of claim 1, further comprising a standby judgment unit configured, at a detection time of the paper jam, to judge whether a sheet standby unit is able to cause the beginning sheet included in the subsequent set to stand by during conveyance of the beginning sheet, wherein when the standby judgment unit judges that the sheet standby unit is able to cause the beginning sheet to stand by, the retrial control unit controls the conveyance unit preferentially to retry the conveyance processing while controlling the sheet standby unit to cause the beginning sheet to stand by.

3. The post-processing device of claim 2, wherein the image forming apparatus is configured to form an image by transferring a toner image that is formed on an image carrier onto a sheet at a transfer position, the sheet standby unit is a resist unit that is included in the image forming apparatus and includes a pair of resist rollers that are used for temporally suspending conveyance of the sheet and adjusting a timing of sending the sheet to the transfer position, and the standby judgment unit judges that the standby is possible when the detection time of the paper jam is no later than a time when a front edge of the beginning sheet included in the subsequent set contacts a nip part of the pair of resist rollers and the beginning sheet is sent to the transfer position.

4. The post-processing device of claim 2, wherein the sheet standby unit is a stack unit that is included in the image forming apparatus and configured to temporarily stack, on an upstream side with respect to an ejection unit in a conveyance direction, a sheet on which an image is formed, the ejection unit being configured to eject the sheet to the post-processing device, and the standby judgment unit judges that the standby is possible when the detection time of the paper jam is earlier than a time when a front edge of the beginning sheet included in the subsequent set arrives at a switching member, the switching member switching between a conveyance path to the ejection unit and a conveyance path to the stack unit.

5. The post-processing device of claim 2, further comprising the sheet standby unit that has:

a holding member that holds a sheet above the storage tray; and a guide member that switches a conveyance path of a sheet that is ejected from the image forming apparatus from a path guiding to the storage tray to a path guiding to the holding member, wherein the standby judgment unit judges that the standby is possible when a state of the guide member at the detection time of the paper jam is either in a state where the beginning sheet included in the subsequent set is able to be guided by the guide unit to the holding member or in a state where the beginning sheet will be able to be guided by the guide unit to the holding member.

6. The post-processing device of claim 1, wherein the conveyance unit includes:

a front edge conveyance member that contacts a front edge in a conveyance direction of the sheet stack that is stored in the storage tray to lead the sheet stack to the conveyance direction, retracts to a predetermined retraction position at a detection time of the paper jam, and again contacts the front edge in the conveyance direction of the sheet stack to retry the conveyance processing; and a rear edge conveyance member that contacts a rear edge in the conveyance direction of the sheet stack to lead the sheet stack to the conveyance direction, retracts to a predetermined retraction position at the detection time of the paper jam, and again contacts the rear edge in the conveyance direction of the sheet stack to retry the conveyance processing, and when the number of sheets of the sheet stack in which the paper jam is detected or a basis weight of each of the sheets is no greater than a threshold value, the retrial control unit controls the conveyance unit to cause one of the front edge conveyance member and the rear edge conveyance member to retract to the corresponding retraction position, and prevent the other of the front edge conveyance member and the rear edge conveyance member from retracting to the corresponding retraction position and to retry the conveyance processing from a position where the paper jam is detected.

7. The image forming system of claim 6, wherein the image forming apparatus is configured to form an image by transferring a toner image that is formed on an image carrier onto a sheet at a transfer position, the sheet standby unit is a resist unit that includes a pair of resist rollers that are used for temporally suspending conveyance of the sheet and adjusting a timing of sending the sheet to the transfer position, and the standby judgment unit judges that the standby is possible when the detection time of the paper jam is no later than a time when a front edge of the beginning sheet included in the subsequent set contacts a nip part of the pair of resist rollers and the beginning sheet is sent to the transfer position.

8. The image forming system of claim 6, wherein the sheet standby unit is a stack unit configured to temporarily stack, on an upstream side with respect to an ejection unit in a conveyance direction, a sheet on which an image is formed, the ejection unit being configured to eject the sheet to the post-processing device, and the standby judgment unit judges that the standby is possible when the detection time of the paper jam is earlier than a time when a front edge of the beginning sheet included in the subsequent set arrives at a switching member, the switching member switching between a conveyance path to the ejection unit and a conveyance path to the stack unit.

9. An image forming system that includes an image forming apparatus and a post-processing device for receiving sheets ejected one by one from the image forming apparatus, and storing, in a storage tray, a number of sheets included in one set on which post processing is to be performed at a post-processing position at once, the image forming apparatus comprising a sheet standby unit configured to cause a sheet to stand by during conveyance of the sheet to the storage tray, and the post-processing device comprising:

a conveyance unit configured to perform conveyance processing of conveying one set of a sheet stack stored in the storage tray to the post-processing position, and ejecting the sheet stack on which the post processing has been performed from the storage tray to an ejection unit;

a detection unit configured to detect a paper jam of the sheet stack during the conveyance processing;

a retrial judgment unit configured, when the detection unit detects the paper jam, to predict a first time and a second time, and judge that retrial of the conveyance processing is possible when the first time is no earlier than the second time, the first time being a time when a beginning sheet included in a subsequent set that is ejected from the image forming apparatus arrives at the storage tray, the second time being a time when ejection of the sheet stack in which the paper jam is detected is complete in the case where the conveyance processing is retried;

a retrial control unit configured to, when the retrial judgment unit judges that the retrial is possible, control the conveyance unit to retry the conveyance processing; and a standby judgment unit configured, at a detection time of the paper jam, to judge whether the sheet standby unit is able to cause the beginning sheet included in the subsequent set to stand by during conveyance of the beginning sheet, wherein when the standby judgment unit judges that the sheet standby unit is able to cause the beginning sheet to stand by, the retrial control unit controls the conveyance unit preferentially to retry the conveyance processing while controlling the sheet standby unit to cause the beginning sheet to stand by.

* * * * *